US005340677A

United States Patent [19]

Baba et al.

[11] Patent Number: 5,340,677

[45] Date of Patent: Aug. 23, 1994

[54] CARRIER FOR ELECTROPHOTOGRAPHY, TWO-COMPONENT TYPE DEVELOPER FOR ELECTROSTATIC IMAGES, PROCESS FOR PRODUCING CARRIER FOR ELECTROPHOTOGRAPHY, AND IMAGE FORMING METHOD

[75] Inventors: Yoshinobu Baba; Takeshi Ikeda; Tada Tatsuya, all of Yokohama; Yuko Sato, Kawasaki; Yasuko Amano, Tokyo, all of Japan

[73] Assignee: Canon Kabushiki Kaisha, Tokyo, Japan

[21] Appl. No.: 872,979

[22] Filed: Apr. 24, 1992

[30] Foreign Application Priority Data

| | | | |
|---|---|---|---|
| Apr. 26, 1991 | [JP] | Japan | 3-122831 |
| Apr. 26, 1991 | [JP] | Japan | 3-122832 |
| Apr. 26, 1991 | [JP] | Japan | 3-122833 |
| Apr. 26, 1991 | [JP] | Japan | 3-122834 |

[51] Int. Cl.[5] ..... G03G 9/10

[52] U.S. Cl. ..... 430/106.6; 430/108; 430/122

[58] Field of Search ..... 430/108, 106.6, 122

[56] References Cited

U.S. PATENT DOCUMENTS

| | | | |
|---|---|---|---|
| 4,546,060 | 10/1985 | Miskinis et al. | 430/108 |
| 4,834,920 | 5/1989 | Bugner et al. | 260/501.15 |
| 5,108,862 | 4/1992 | Kishimoto et al. | 430/108 |
| 5,126,225 | 6/1992 | Wilson et al. | 430/108 |

FOREIGN PATENT DOCUMENTS

| | | |
|---|---|---|
| 0426124 | 5/1991 | European Pat. Off. . |
| 54-66134 | 5/1979 | Japan . |
| 58-21750 | 2/1983 | Japan . |
| 61-9659 | 1/1986 | Japan . |
| 62-229256 | 10/1987 | Japan . |

OTHER PUBLICATIONS

Patent Abstract of Japan, vol. 7, No. 150 (P-207) [1295] Jun. 30, 1983.

Patent Abstract of Japan, vol. 14, No. 138 (P-1022) [4081] Mar. 15, 1990.

Patent Abstract of Japan, vol. 14, No. 179 (P-1034) [4122] Apr. 10, 1990.

Patent Abstract of Japan, vol. 14, No. 258 (P-1055) [4201] Jun. 4, 1990.

*Primary Examiner*—John Goodrow

*Attorney, Agent, or Firm*—Fitzpatrick, Cella, Harper & Scinto

[57] ABSTRACT

A carrier for electrophotography comprises a carrier core material and a coating resin material with which the surface of the carrier core material is coated. The carrier core material has a binder resin and fine magnetic material particles dispersed in the binder resin. The coating resin material contains at least one of the following members:

(a) a vinyl copolymer having a hydroxyl value of from 1 to 100 (KOHmg/g);

(b) a styrene-acrylic copolymer having an acrylic component in a monomer percentage of from 30% by weight to 90% by weight, a weight average molecular weight (Mw) of from 30,000 to 70,000 and a weight average molecular weight/number average molecular weight (Mw/Mn) of from 2 to 10; and (c) an insulating resin and a quaternary ammonium salt represented by the following Formula (I):

(I)

wherein $R_1$, $R_2$, $R_3$ and $R_4$ may be the same of different and each represent an alkyl group, an aryl group or an aralkyl group; and A represents an organic anion or a polyacid ion.

101 Claims, 2 Drawing Sheets

CARRIER FOR ELECTROPHOTOGRAPHY, TWO-COMPONENT TYPE DEVELOPER FOR ELECTROSTATIC IMAGES, PROCESS FOR PRODUCING CARRIER FOR ELECTROPHOTOGRAPHY, AND IMAGE FORMING METHOD

BACKGROUND OF THE INVENTION

1. Field of the invention

The present invention relates to a magnetic material dispersed type carrier and a process for producing the carrier. The present invention also relates to a two-component type developer for developing electrostatic images, comprises of a toner and a carrier, and an image forming method for developing a latent image by the use of the two-component type developer under application of a bias voltage in a developing zone.

2. Related Background Art

In general, in electrostatic recording apparatus making use of electrophotography, commonly employed is a method in which a photoconductive material such as selenium, OPC (organic photoconductive material) or α-Si is used in an electrostatic image bearing member, where the electrostatic image bearing member is uniformly charged by various means, thereafter the charged surface of the electrostatic image bearing member is irradiated with a light image to form on its surface an electrostatic latent image corresponding to the light image, and the latent image is converted to a visible image by making toner adhere thereto by magnetic brush development or other developing process.

This developing method makes use of a toner that converts the latent image to a visible image and carrier particles comprising a magnetic material, called a carrier. The carrier imparts the toner to a proper quantity of positive or negative electrostatic charges by triboelectric charging, and also carries the toner on its particle surfaces by the electrostatic attraction force of the triboelectricity.

The developer having such a toner and a carrier is coated on a developing sleeve provided with a magnet in its inside, in a given layer thickness by means of a developer layer thickness control member, and then transported by utilizing a magnetic force, to a developing zone formed between the electrostatic image bearing member described above and the developing sleeve.

A given development bias voltage is applied between the electrostatic image bearing member and the developing sleeve. The toner is fed to the developing zone and performs development on the electrostatic image bearing member.

In general, the carrier that composes the two-component type developer can be roughly grouped into a conductive carrier and an insulative carrier. There are various performances required in these carriers. Particularly important performances are proper chargeability, breakdown strength against applied electric fields, impact resistance, wear resistance, anti-spent properties, developing performance and productivity.

The conductive carrier is usually comprised of oxidized or unoxidized iron powder. A developer comprised of this iron powder carrier, however, has the problem that the triboelectric chargeability to toner is so unstable that fogging may occur on visible images formed using the developer. More specifically, as the developer is used, toner particles adhere to the surfaces of the iron powder carrier particles, so that the electrical resistance of carrier particles increases to lower bias currents, and also to make the triboelectric chargeability unstable, resulting in a lowering of the image density of a visible image formed and an increase of fog.

The insulative carrier is commonly typified by a carrier comprising carrier core particles comprised of a ferromagnetic material such as iron, nickel or ferrite whose surfaces are uniformly coated with an insulating resin. A developer that employs this carrier may little cause the melt-adhesion of toner particles to the carrier surfaces, compared with the case of the conductive carrier, and hence has the advantage that it is suitable particularly for high-speed electrophotographic copying machines in view of its superior durability and long lifetime.

Meanwhile, in either conductive or insulative carriers conventionally available, an increase in true specific gravity results in an increase in the load applied to the developer when the developer is made to have a given layer thickness on the sleeve by means of the developer layer thickness control member. Hence, (a) toner filming, (b) carrier break and (c) deterioration of toner tend to occur during long-term use of the developer, so that the developer tends to deteriorate, accompanied with a deterioration of image quality of developed images. An increase in particle size of the carrier results in an increase in the load applied to the developer and hence the above (a) to (c) is more liable to occur, so that the developer is more subject to deteriorate. It also brings about (d) a poor fine-line reproduction, in other words, a poor developing performance as well known.

Thus, the carriers that tend to cause the above (a) to (c) make it necessary to take troubles to periodically change developers, and are enconomically disadvantageous. Hence, it is necessary to decrease the load applied to the developer or improve impact resistance and anti-spent properties of carriers so that the above (a) to (c) can be prevented to make the lifetime of developers longer.

To cope with the problem on developing performance as noted in the above (d), it is necessary to make the particle size of carriers smaller.

To cope with the problems (a) to (d), a small particle size carrier comprising a binder resin and magnetic particles dispersed therein may be used, as exemplified by a magnetic material dispersed type small particle size carrier prepared by pulverization, as disclosed in Japanese Patent Application Laid-open No. 54-66134, and a magnetic material dispersed type small particle size carrier prepared by polymerization, as disclosed in Japanese Patent Application Laid-open No. 61-9659.

However, unless a large quantity of magnetic material is added to carrier particles, the above magnetic material dispersed type small particle size carriers have so small a saturated magnetization for their particle size that they have a problem of (e) adhesion of carrier to photosensitive members, which may occur during development. This makes it necessary to replenish the developer or provide in an image forming apparatus a mechanism for collecting adhered carriers. Thus, they can not be drastic countermeasures for making the lifetime of developers longer.

In the case when a large quantity of magnetic material is added to the magnetic material dispersed type small particle size carriers, the quantity of the magnetic material increases with respect to the binder resin and hence the impact resistance becomes weak. This tends to cause falling-off of the magnetic material from the carrier when the developer is made to have a given layer thickness on the sleeve by means of the developer layer thickness control member. As a result, the developer tends to deteriorate. Thus, also in this case, they can not be drastic countermeasures for making the lifetime of developers longer.

In addition, in the case when a large quantity of magnetic material is added to the magnetic material dispersed type small particle size carriers, resistance of the carrier decreases because of an increase in the quantity of a magnetic material having a low resistance. As a result, they tend to cause (f) faulty images because of a leak of the bias voltage applied during development.

Thus, these magnetic material dispersed type small particle size carriers are disadvantageous in that they can not be drastic countermeasures for improving developing performance and making the lifetime of developers longer.

A technique in which carrier particles are coated with a resin as disclosed in Japanese Patent Application Laid-open No. 58-21750 can also be another countermeasure. Such a resin-coated carrier can improve anti-spent properties, impact resistance and breakdown strength against applied voltage. Since it can also control charge performance on account of the charge performance of the resin with which the carrier particles are coated, selection of the resin make it possible to impart desired charge to toner.

This resin-coated carrier, however, also has a problem as follows: If the coating resin is in a large quantity to give a carrier with a high resistance, what is called the charge-up of toner tends to occur, which is phenomenon in which electrostatic charge of toner become large in quantity in a low-humidity environment. If the coating resin is in a small quantity, the carrier may have so excessively low a resistance that faulty images caused by a leak of development bias voltage tends to occur. Thus, it is difficult to control its coating weight.

Some coating resins, even those which can be considered to have given a proper resistance when the resistance of a resin-coated carrier is measured, tend to cause faulty images because of a leak-of development bias voltage. Thus, such a resin-coated carrier also has the problem of a difficulty in its control when developing performance is taken into account.

The electrostatic charge of a developer making use of such carriers coated with an insulating resin commonly tends to vary depending on variations in environmental conditions as in a low-temperature low-humidity environment or a high-temperature high-humidity environment. As a result, problems may occur such that the charge-up causes a decrease in image density in a low-temperature low-humidity environment and a decrease in triboelectricity causes fogging or black spots around line images in a high-temperature high-humidity environment.

Thus, under existing circumstances, no carrier having reached a satisfactory level has been discovered in regard to the carrier coated with an insulating resin.

As to a carrier coated with no insulating resin, various attempts have been made. For example, Japanese Patent Application Laid-open No. 62-229256 discloses a carrier comprising ferrite particles to the surfaces of which a water-soluble quaternary ammonium salt is adhered. Use of the water-soluble quaternary ammonium salt, however, has caused the disadvantage that the quaternary ammonium salt on the ferrite particle surfaces is dissolved out or eliminated after a toner has been left standing for a long period of time in a high-temperature high-humidity environment or after running, so that the properties of the particles gradually become close to the properties of untreated ferrite particles. In addition, since the particles are not coated with a resin, the quaternary ammonium salt on the ferrite particle surfaces tends to be eliminated not only after running in a high-temperature high-humidity environment but also after that in a usual environment of normal temperature and normal humidity. Even if the quaternary ammonium salt is not eliminated, as compared with the resin-coated carrier, there has been, after all, a problem that a toner forms a film on the surface of the carrier, i.e., the problem that a toner is so susceptible to the toner-spent that a developer has a short lifetime. In addition, unless the particles are coated with a resin having insulating properties to a certain degree, neither iron oxide powder nor ferrite particles can be suitable for preventing the leak of current in a developing system in which a bias voltage is applied or the adhesion of carrier onto a photosensitive member. Thus, in respect of the durability and anti-spent properties of carriers, no method is presently available which may be superior to the coating of the carrier with an insulating resin.

As discussed above, taking account of the performances required of carriers, the carriers conventionally used still have problems to be settled and no well satisfactory carrier is known at present.

In particular, in magnetic material dispersed type carriers comprising a binder resin and magnetic particles dispersed therein and whose particle surfaces are coated with a resin, no carrier is known at present as to those which can be well satisfactory on the following:

(1) Anti-spent properties.
(2) Impact resistance (preventing carrier from breaking).
(3) Preventing toner from deteriorating.
(4) Developing performance.
(5) Preventing carrier from adhering onto photosensitive members.
(6) Controlling resistance of carrier.
(7) Stabilizing chargeability of toner (making lifetime longer in regard to chargeability).
(8) Stabilizing chargeability of toner against environmental variations.

In particular, in recent years, there is a tendency that toner particles are made finer from the standpoint of a higher image quality, and hence the electrostatic charges of toner may more greatly vary depending on environmental changes in temperature and humidity. Thus there is the problem that it is more difficult to prevent both the toner scatter and fogging accompanying a decrease in electrostatic charge in a high-humidity environment and the decrease in image density due to the charge-up in a low-humidity environment.

SUMMARY OF THE INVENTION

An object of the present invention is to solve the problems as discussed above, involved in the carriers for electrophotography in which a magnetic material whose particles surfaces are coated with a resin is dispersed, and, as a result, to provide a carrier for electrophotography that requires no replenishment of carrier during running and also gives a superior developing performance and developer lifetime because of the stabilization of chargeability of toner during running and under variations of humidity.

Another object of the present invention is to provide a carrier for electrophotography, that has an appropriate resistance and may cause less leak of current even when a bias voltage is applied or less adhesion of carrier onto an electrostatic image bearing member (a photosensitive member).

A further object of the present invention is to provide a carrier for electrophotography, that may give less shear to a toner, can prohibit a toner from deteriorating and can stably give high-quality images over a long period of time.

A still further object of the present invention is to provide a process for producing a carrier for electrophotography, that can solve the problems as discussed above.

A still further object of the present invention is to provide an image forming method that may cause less leak of current or less adhesion of carrier to an electrostatic image bearing member, when a latent image is developed under application of a bias voltage in a developing zone.

A still further object of the present invention is to provide a two-component type developer for developing electrophotostatic images, that may be less affected by environmental variations even in use of a toner with a small particle size which is 10 μm or less in weight average particle diameter.

The present invention provides a carrier for electrophotography, comprising a carrier core material and a coating resin material with which the surface of said carrier core material is coated, wherein;

said carrier core material has a binder resin and fine magnetic material particles dispersed in said binder resin; and said coating resin material contains at least one member selected from the group consisting of;

(a) a vinyl copolymer having a hydroxyl value of from 1 to 100 (KOHmg/g);

(b) a styrene-acrylic copolymer having an acrylic component in a monomer percentage of from 30% by weight to 90% by weight, a weight average molecular weight (Mw) of from 30,000 to 70,000 and a weight average molecular weight/number average molecular weight (Mw/Mn) of from 2 to 10; and (c) an insulating resin and a quaternary ammonium salt represented by the following Formula (I):

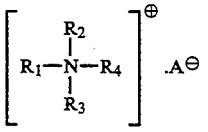

(I)

wherein $R_1$, $R_2$, $R_3$ and $R_4$ may be the same or different and each represent an alkyl group, an aryl group or an aralkyl group; and A represents an organic anion or a polyacid ion.

The present invention also provides a two-component type developer for developing electrostatic images, comprising a toner and a carrier, said carrier comprising a carrier core material and a coating resin material with which the surface of said carrier core material is coated, wherein;

said carrier core material has a binder resin and fine magnetic material particles dispersed in said binder resin; and said coating resin material contains at least one member selected from the group consisting of;

(a) a vinyl copolymer having a hydroxyl value of from 1 to 100 (KOHmg/g);

(b) a styrene-acrylic copolymer having an acrylic component in a monomer percentage of from 30% by weight to 90% by weight, a weight average molecular weight (Mw) of from 30,000 to 70,000 and a weight average molecular weight/number average molecular weight (Mw/Mn) of from 2 to 10; and (c) an insulating resin and a quaternary ammonium salt represented by the following Formula (I):

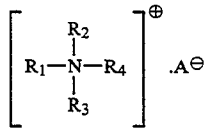

(I)

wherein $R_1$, $R_2$, $R_3$ and $R_4$ may be the same or different and each represent an alkyl group, an aryl group or an aralkyl group; and A represents an organic anion or a polyacid ion.

The present invention still also provides a process for producing a carrier for electrophotography, comprising the steps of;

preparaing a coating solution or coating dispersion in which a coating resin material is dissolved or dispersed; said coating resin material containing at least one member selected from the group consisting of;

(a) a vinyl copolymer having a hydroxyl value of from 1 to 100 (KOHmg/g);

(b) a styrene-acrylic copolymer having an acrylic component in a monomer percentage of from 30% by weight to 90% by weight, a weight average molecular weight (Mw) of from 30,000 to 70,000 and a weight average molecular weight/number average molecular weight (Mw/Mn) of from 2 to 10; and (c) an insulating resin and a quaternary ammonium salt represented by the following Formula (I);

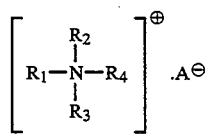

(I)

wherein $R_1$, $R_2$, $R_3$ and $R_4$ may be the same or different and each represent an alkyl group, an aryl group or an aralkyl group; and A represents an organic anion or a polyacid ion;

coating the surface of a carrier core material with the coating solution or coating dispersion thus prepared; said carrier core material having a binder resin and fine magnetic material particles dispersed in said binder resin; and drying the coated carrier core material to give a carrier.

The present invention still also provides an image forming method comprising;

developing a latent image formed on an electrostatic image bearing member, by the use of a two-component type developer comprising a toner and a carrier, under application of a bias voltage in a developing zone;

said carrier comprising a carrier core material and a coating resin material with which the surface of said carrier core material is coated, wherein;

said carrier core material has a binder resin and fine magnetic material particles dispersed in said binder resin; and said coating resin material contains at least one member selected from the group consisting of;

(a) a vinyl copolymer having a hydroxyl value of from 1 to 100 (KOHmg/g);

(b) a styrene-acrylic copolymer having an acrylic component in a monomer percentage of from 30% by weight to 90% by weight, a weight average molecular weight (Mw) of from 30,000 to 70,000 and a weight average molecular weight/number average molecular weight (Mw/Mn) of from 2 to 10; and (c) an insulating resin and a quaternary ammonium salt represented by the following Formula (I):

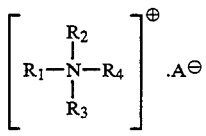

(I)

wherein $R_1$, $R_2$, $R_3$ and $R_4$ may be the same or different and each represent an alkyl group, an aryl group or an aralkyl group; and A represents an organic anion or a polyacid ion.

DESCRIPTION OF THE PREFERRED EMBODIMENTS

Figure 1:
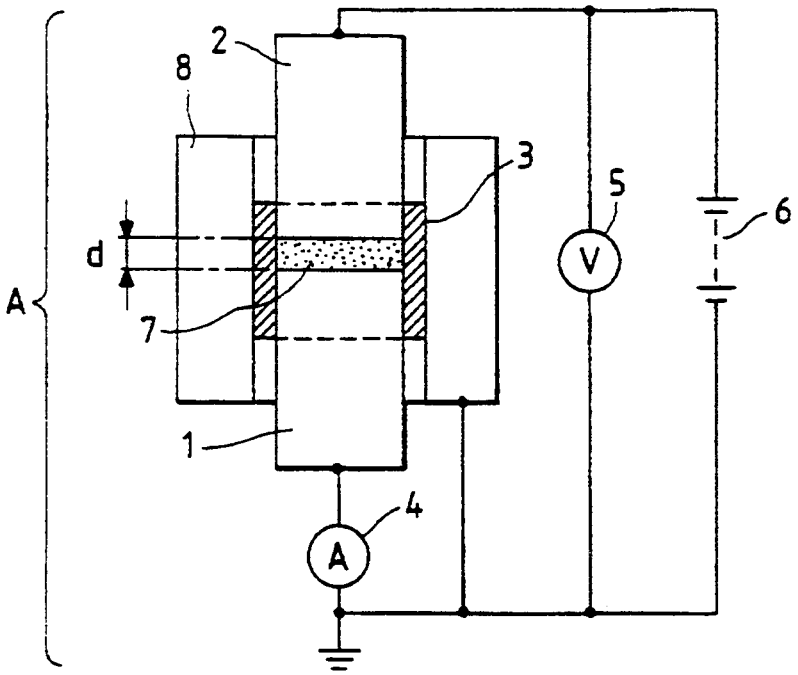
FIG. 1 is a schematic view diagrammatically illustrating an apparatus for measuring electrical resistance.

The carrier of the present invention can overcome the disadvantages involved in the conventional resin-coated, magnetic material dispersed type carriers, has a superior impact resistance, electrical resistivity, stability in imparting charge to toner over a long period of time and stability in providing charge to toner without dependence on environmental variations, and therefore can give a much superior developing performance and developer lifetime. Although details are unclear, the reason therefor may be presumed as follows:

The carrier of the present invention, when its particle surfaces were observed using a scanning electron microscope (SEM), was in a state that the carrier core material was uniformly covered with the coating resin. Hence, such a uniform coating performance is presumed to have improved the impact resistance, resistivity, and stability in imparting electrostatic charge to toner, of the magnetic material dispersed type carrier used in the present invention.

More specifically, assuming that the particle surface of the carrier is divided into minute parts, the impact resistance, resistivity, and stability in imparting electrostatic charge to toner can be considered to be the same at every part when the coating is uniform.

On the other hand, when the coating is not uniform, the impact resistance, resistivity, and stability in imparting electrostatic charge to toner can be considered different at some parts of the carrier particle surface. Hence, since, for example, the measurement of resistivity is an evaluation procedure wherein the carrier is viewed from a macroscopic standpoint, even those presumed to have a proper resistivity in measurement are considered to tend to cause charge-up in a low-humidity environment when the coating is not uniform, or tend to cause faulty images because of a leak of development bias voltage.

In the case where the coating resin material with which the surface of the carrier core material is coated contains a vinyl copolymer having a hydroxyl value of from 1 to 100 (KOHmg/g), the coating resin material can be firmly adhered to the surface of the carrier core material because of excellent binding properties of the vinyl copolymer. This coating resin material may preferably further contain a fluorine-containing resin.

In the case where the coating resin material with which the surface of the carrier core material is coated contains a styrene-acrylic copolymer having an acrylic component in a monomer percentage of from 30% by weight to 90% by weight, a weight average molecular weight (Mw) of from 30,000 to 70,000 and a weight average molecular weight/number average molecular weight (Mw/Mn) of from 2 to 10, the surface of the carrier core material can be uniformly coated with the coating resin material and a high strength for impact resistance can be achieved. This coating resin material may preferably further contain a fluorine-containing resin.

In the case where the coating resin material with which the surface of the carrier core material is coated contains an insulating resin and a quaternary ammonium salt represented by the following Formula (I):

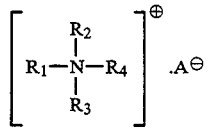

(I)

wherein $R_1$, $R_2$, $R_3$ and $R_4$ may be the same or different and each represent an alkyl group, an aryl group or an aralkyl group; and A represents an organic anion or a polyacid ion; the quaternary ammonium salt used in the present invention can decrease the environment dependence of the coating resin material applied to the surface of the carrier core material, although its mechanism is unclear. Presumably, the reason that such an effect can be obtained is that the quaternary ammonium salt of the present invention serves as a leak site and hence prevents the phenomenon of charge-up caused by the insulating coating resin in a low-humidity environment.

The vinyl copolymer used in the present invention, having the stated hydroxyl value, may include copolymers of vinyl monomers having a hydroxyl group and other vinyl monomers. The vinyl monomers having a hydroxyl group are exemplified by 2-hydroxyethyl acrylate, 2-hydroxypropyl acrylate, 2-hydroxybutyl acrylate, 2-hydroxy-3-phenyloxypropyl acrylate, 2-hydroxyethyl methacrylate, 2-hydroxypropyl methacrylate, 2-hydroxybutyl methacrylate and 2-hydroxy-3-phenyloxypropyl methacrylate. These monomers must be so used that the the copolymer has a hydroxyl value of from 1 to 100 (KOHmg/g), preferably from 5 to 70 (KOHmg/g), and more preferably from 10 to 50 (KOHmg/g).

If the hydroxyl value is less than 1, no effect attributable to the presence of hydroxyl groups can be obtained. In the case where the coating resin material further contains a fluorine-containing resin, the fluorine-containing resin can not be well effectively exposed to the carrier surface to cause a lowering of charge-imparting ability of the carrier. If the hydroxyl value is more than 100, moisture absorption may increase to cause a lowering of charge stability in a high-temperature high-humidity environment.

Other vinyl monomers with which these vinyl monomers having a hydroxyl group are copolymerized may include vinyl monomers such as styrene, styrene derivatives as exemplified by α-methylstyrene, p-methylstyrene, p-t-butylstyrene and p-chlorostyrene, methyl methacrylate, ethyl methacrylate, propyl methacrylate, butyl methacrylate, pentyl methacrylate, hexyl methacrylate, heptyl methacrylate, octyl methacrylate, nonyl methacrylate, decyl methacrylate, undecyl methacrylate, dodecyl methacrylate, undecyl methacrylate, dodecyl methacrylate, glycidyl methacrylate, methoxyethyl methacrylate, propoxyethyl methacrylate, butoxyethyl methacrylate, benzyl methacrylate, cyclohexyl methacrylate, methyl acrylate, ethyl acrylate, propyl acrylate, butyl acrylate, pentyl acrylate, hexyl acrylate, heptyl acrylate, octyl acrylate, nonyl acrylate and decyl acrylate.

Of these other vinyl monomers, styrene, styrene derivatives, methacrylates and acrylates are preferable as vinyl monomers having one vinyl group in the molecule. In particular, methacrylic acid or acrylic acid alkyl esters whose alkyl group has 1 to 5 carbon atoms are preferred.

Of these vinyl monomers, the vinyl monomers having a hydroxyl group is so used that the copolymer has a hydroxyl value of from 1 to 100 (KOHmg/g). These vinyl monomers are polymerized by a process such as suspension polymerization, emulsion polymerization or solution polymerization.

The copolymer thus obtained may preferably have a weight average molecular weight of from 10,000 to 70,000. A copolymer with a weight average molecular weight less than 10,000 tends to give an insufficient impact resistance. A weight average molecular weight more than 70,000 is not preferable since it becomes difficult to coat the carrier core material and also agglomerates may be formed. This copolymer may have been cross-linked using a melamine aldehyde or using an isocyanate. In the present invention, the hydroxyl value refers to a value measured according to JIS-K0070.

In the present invention, the coating resin material may preferably contain a fluorine-containing resin as previously mentioned. This can give excellent binding properties to the vinyl copolymer having an hydroxyl value of from 1 to 100 (KOHmg/g), used as a coating resin for the core material in the present invention. At the same time, mixing with the fluorine-containing resin inherently having excellent release properties gives a remarkable effect that the flourine-containing resin is exposed on the coated-carrier surface by the action of the vinyl copolymer having a hydroxyl group, so that the anti-spent properties of the carrier can be improved.

The fluorine-containing resin contained in the coating resin material used in the present invention, together with the vinyl copolymer having the stated hydroxyl value, may include perfluoropolymers such as polyvinyl fluoride, polyvinylidene fluoride, polytrifluoroethylene, polytrifluorochloroethylene, polytetrafluoroethylene and polyperfluoropropylene, fluorocopolymers such as a copolymer of vinylidene fluoride with acrylic monomers, a copolymer of vinylidene fluoride with trifluorochloroethylene, a copolymer of tetrafluoroethylene with hexafluoropropylene, a copolymer of vinyl fluoride with vinylidene fluoride, a copolymer of vinylidene fluoride and tetrafluoroethylene, a copolymer of vinylidene fluoride with hexafluoropropylene, and fluoroterpolymers such as a terpolymer of tetrafluoroethylene, vinylidene fluoride and non-fluorinated monomers.

The mixing proportion of any of these fluorine-containing resins to the vinyl resin having a hydroxyl group, specifically, the proportion (weight ratio) of the fluorine-containing resin to the vinyl resin having a hydroxyl group may preferably be 5:95 to 95:5, and more preferably from 10:90 to 90:10. If the fluorine-containing resin is contained in an amount less than 5% by weight, the quantity of the fluorine-containing resin being exposed on a uniform resin-coated layer tends to become insufficient. On the other hand, if the fluorine-containing resin is contained in an amount more than 95% by weight, the amount of the vinyl resin having a hydroxyl group, present in the coating resin material, becomes smaller to tend to lower adhesion properties of the resin-coated layer to the core material.

The fluorine-containing resin should preferably have a weight average molecular weight of from 50,000 to 400,000, and preferably from 100,000 to 250,000. If the molecular weight is less than 50,000, wear resistance tends to become insufficient. If it is more than 400,000, it becomes difficult to effect uniform coating on the carrier material.

The styrene-acrylic copolymer used in the present invention, having an acrylic component in a monomer percentage of from 30% by weight to 90% by weight, a weight average molecular weight (Mw) of from 30,000 to 70,000 and a weight average molecular weight/number average molecular weight (Mw/Mn) of from 2 to 10 includes copolymers of styrene derivatives with acrylates and copolymers of styrene derivatives with methacrylates. Monomers constituting these styrene-acrylic copolymers can be exemplified by the following compounds. That is, the styrene derivatives may include styrene, o-methylstyrene, m-methylstyrene, p-methylstyrene, p-phenylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyene, p-methoxystyrene, p-chlorostyrene, 3,4-dichlorostyrene, m-nitrostyrene, o-nitrostyrene and p-nitrostyrene.

The acrylates may include, for example, methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate and phenyl acrylate.

The methacrylates may include, for example, methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate.

In the present invention, the monomer percentage of the acrylic component in the coating resin, styrene-acrylic copolymer, must be from 30% by weight to 90% by weight as stated above, and preferably from 40 to 90% by weight. If it is less than 30% by weight, no coating uniformity good enough to contribute the present invention can be obtained, resulting in a lack in charge stability of the toner. If it is more than 90% by weight, although uniform coating performance can be achieved, the strength for impact resistance of the carrier may become short.

The weight average molecular weight of the copolymer that can be used in the coating resin for the carrier core material in the present invention must be from, 30,000 to 70,000, and should preferably be from 30,000 to 60,000. At the same time, its weight average molecular weight/number average molecular weight (Mw/Mn) must be from 2 to 10, and should preferably be from 2 to 8. If the weight average molecular weight is less than 30,000, no sufficient strength for impact resistance of the carrier can be obtained, and if it is more than 70,000, coating performance on the carrier core may become poor, resulting in a lack of carrier strength and also charge stability. What is more important is that, here, even if the weight average molecular weight is within this range, the present invention can not be effective unless the weight average molecular weight-/number average molecular weight (Mw/Mn) is within the range of from 2 to 10. If the weight average molecular weight/number average molecular weight (Mw/Mn) is smaller than 2, although uniform coating performance can be achieved, the impact resistance may become poor. If the weight average molecular weight/number average molecular weight (Mw/Mn) is larger than 10, coating uniformity on the carrier core may become poor, bringing about no carrier strength and no desired charge stability.

In the present invention, the coating resin material in the above embodiment may preferably contain a fluorine-containing resin as previously mentioned. In such an instance, the fluorine-containing resin can be uniformly dispersed in the coating resin material and hence charge performance and anti-spent properties can be uniformly obtained.

The fluorine-containing resin contained in the coating resin material used in the present invention, together with the specific styrene-acrylic copolymer, may include the same resins as those previously described for the fluorine-containing resin contained in the coating resin material together with the vinyl copolymer having the stated hydroxyl value.

The mixing proportion of any of these fluorine-containing resins to the styrene-acrylic copolymer may preferably be 5:95 to 95:5, and more preferably from 10:90 to 90:10, in weight ratio (the weight of the fluorine-containing resin to the weight of the copolymer). So long as they are contained within the above range, the desired charge stability can be obtained in developers with either positive polarity or negative polarity. If, however, the fluorine-containing resin is contained in an amount less than 5% by weight, the charge stability of developers showing charge performance in positive polarity may be lowered. If, on the other hand, the fluorine-containing resin is contained in an amount more than 95% by weight, not only the charge stability of developers showing charge performance in negative polarity may be lowered, but also wettability becomes poor, so that it becomes difficult to effect uniform coating on the core material.

The fluorine-containing resin should preferably have a weight average molecular weight of from 50,000 to 400,000, and preferably from 100,000 to 250,000. If the molecular weight is less than 50,000, wear resistance tends to become insufficient. If it is more than 400,000, it becomes difficult to effect uniform coating on the carrier material.

In the present invention, the molecular weight and molecular weight distribution of the coating resin usable as the coating resin material for the carrier core material and the molecular weight of the fluorine-containing resin refer to values determined in the light of a calibration curve obtained by GPC (gel permeation chromatography), using a monodispers standard polystyrene. Measurement conditions are as follows:

Apparatus: GPC-150C (Waters Co.)
Columns: Shodex KF, a series of seven columns
Temperature: 40° C.
Solvent: THF (tetrahydrofuran)
Flow rate: 1.0 ml/min
Sample: Injected 0.4 ml of 0.15% sample.

The quaternary ammonium salt used in the present invention is in some instances contained in a toner as a positive charge control agent of the toner. The effect obtainable in the present invention, however, can not be exhibited in other commonly available positive charge control agents.

The quaternary ammonium salt used in the present invention is represented by Formula (I) shown below.

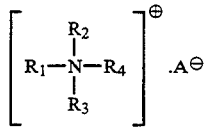

(I)

In the formula, $R_1$, $R_2$, $R_3$ and $R_4$ may be the same or different and each represent an alkyl group, an aryl group or an aralkyl group; and A represents an organic anion or a polyacid ion. The organic and polyacid ion may specifically includes organic sulfate ions, organic sulfonate ions, organic phosphate ions, carboxylate ions isopolyacid irons. In particular, it preferably includes organic anions, and more preferably aromatic anions. The reason therefor is that the present invention is greatly characterized by the employment of a slightly soluble or insoluble quaternary ammonium salt, and the quaternary ammonium salt slightly soluble in water can be formed when the A is any of the above anions, thus giving the properties that no dissolution or elimination occurs in a high-humidity environment. Moreover, since in the present invention this quaternary ammonium salt is mixed in the insulating coating resin material, the quaternary ammonium salt should preferably be slightly soluble in water also in view of the fact that it should be well compatible with that resin and it should be uniformly mixed.

The alkyl group, aryl group or aralkyl group represented by $R_1$, $R_2$, $R_3$ and $R_4$ may preferably have 1 to 20 carbon atoms, and more preferably 1 to 18 carbon atoms.

The quaternary ammonium salt used in the present invention can be roughly grouped into two types, a type in which $R_4$ is an alkyl group and a type in which $R_4$ is an aryl group or an aralkyl group.

In the present invention, there are two ways of mixing the quaternary ammonium salt. One of them is a method in which a carrier coating solution is prepared by dispersing in a solution in which a resin material is dissolved or dispersed a quaternary ammonium salt kept in the form of non-soluble particles. The other is a method in which a carrier coating solution is prepared by mixing in a solution in which a resin is dissolved or dispersed a quaternary ammonium salt previously dissolved in a solvent. In particular, the latter is preferred since the quaternary ammonium salt can be uniformely dispersed in the coating resin material and at the same time a satisfactory effect can be obtained in its use in a small amount.

In the latter method, it is necessary to select a solvent capable of well dissolving the quaternary ammonium salt and is compatible with the solvent in which a resin has been dissolved. Stated specifically, it is necessary to use a solvent in which the quaternary ammonium salt used in the present invention can be dissolved in a solubility of 1 g/100 g (solvent). Such a solvent includes ketones, amines and alcohols each having a strong polarity. In general, alcohols can be preferably used. Selection thereof, however, can not primarily depend only upon the solubility of the quaternary ammonium salt to the solvent. It is also necessary to take account of the compatibility between the resin and the solvent.

It is important for the quaternary ammonium salt used in the present invention to be insoluble or only slightly soluble in water, as previously described. When its degree is defined as the solubility to water on the basis of the weight (g) of the quaternary ammonium salt dissolving in 100 g of water of 20° C., the quaternary ammonium salt used in the present invention has a solubility to water of less than 1.0 g/100 g ($H_2O$, 20° C.), and preferably less than 0.3 g/100 g ($H_2O$, 20° C.).

The solubility of the quaternary ammonium salt to water can be measured by the method described below.

In an Erlenmeyer flask with a ground stopper, 100 g of distilled water and 2.00 g of a quaternary ammonium salt to be dissolved are added, and the flask is hermetically stoppered, which is then shaken for 8 hours in a shaking thermostatic water bath at a temperature of 20°±0.5° C. and at shaking times of 60 shakes/min. Thereafter, the shaken mixture is filtered using a filter medium such as filter paper, and χg of insoluble matters are weighed. The solubility (quantity) of the quaternary ammonium salt dissolved in 100 g of distilled water is expressed by:

$$2.00-\chi(\text{g}/100\text{ g } H_2O).$$

Next, as a method of measuring what solubility to a certain solvent a quaternary ammonium salt has when the carrier coating solution is prepared by dissolving the above-described quaternary ammonium salt in a solvent, the following method can be employed.

In an Erlenmeyer flask with a ground stopper, 100 g of a solvent and 50.0 g of a quaternary ammonium salt to be dissolved are added, and the flask is hermetically stoppered, which is then shaken for 8 hours in a shaking thermostatic water bath at a temperature of 20°±0.5° C. and at shaking times of 60 shakes/min. Thereafter, the shaken mixture is filtered using a filter medium such as filter paper, and χg of insoluble matters are weighed. The solubility (quantity) of the quaternary ammonium salt dissolved in 100 g of a solvent is expressed by:

$$50.0-\chi(\text{g}/100\text{ g solvent})$$

It is preferred for the quaternary ammonium salt used in the present invention to have a solubility to a solvent, of preferably not less than 1.0 g/100 g (solvent), and more preferably not less than 5.0 g/100 g (solvent).

Of the quaternary ammonium salts usable in the present invention, specific exemplary compounds of the type in which $R_4$ is an alkyl group are shown below.

Exemplary Compound 1:

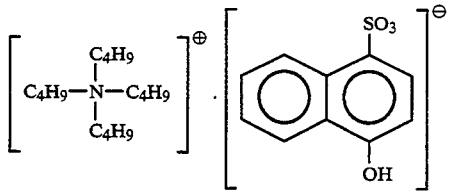

(Solubility to water: less than 0.2 g/100 $H_2O$)

Exemplary Compound 2:

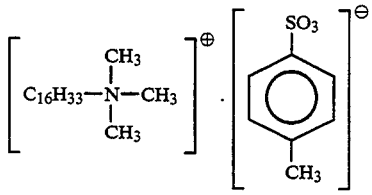

(Solubility to water: less than 0.3 g/100 $H_2O$)

Exemplary Compound 3:

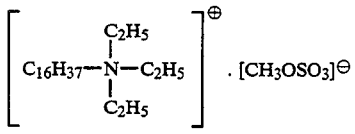

(Solubility to water: less than 0.3 g/100 $H_2O$)

Exemplary Compound 4:

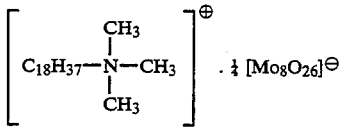

(Solubility to water: less than 0.3 g/100 $H_2O$)

Of the quaternary ammonium salts usable in the present invention, specific exemplary compounds of the type in which $R_4$ is an aryl group or an aralkyl group are shown below.

Exemplary Compound 5:

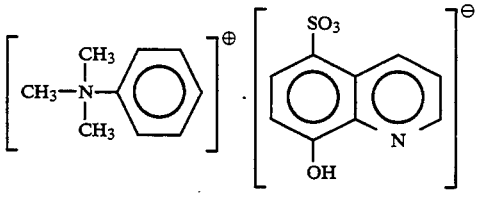

(Solubility to water: less than 0.2 g/100 $H_2O$)

-continued

Exemplary Compound 6:

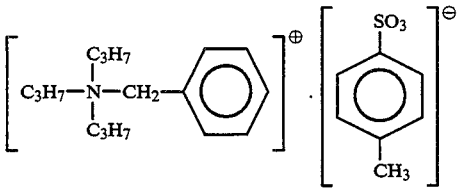

(Solubility to water: less than 0.3 g/100 $H_2O$)

Exemplary Compound 7:

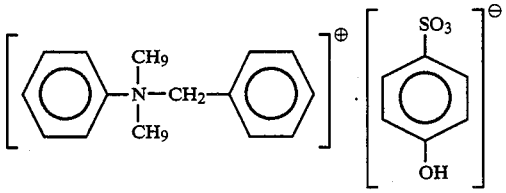

(Solubility to water: less than 0.2 g/100 $H_2O$)

Exemplary Compound 8:

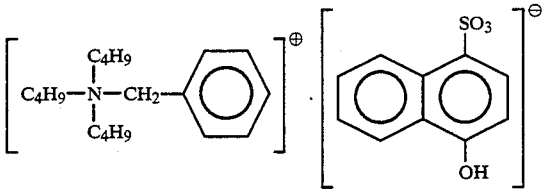

(Solubility to water: less than 0.2 g/100 $H_2O$)

Exemplary Compound 9:

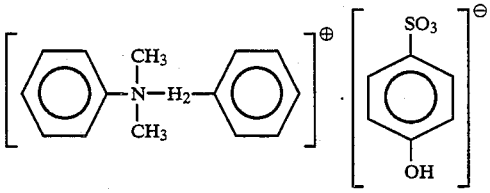

(Solubility to water: less than 0.3 g/100 $H_2O$)

Exemplary Compound 10:

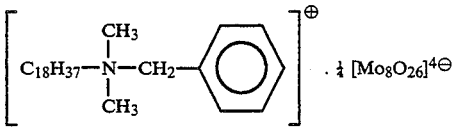

(Solubility to water: less than 0.2 g/100 $H_2O$)

Exemplary Compound 11:

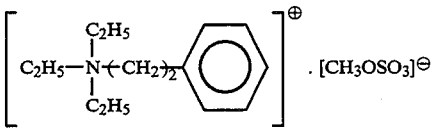

(Solubility to water: less than 0.2 g/100 $H_2O$)

Exemplary Compound 12:

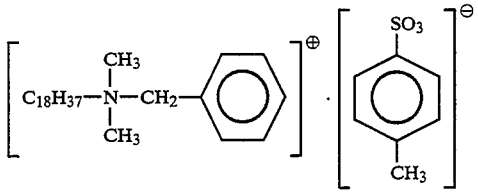

(Solubility to water: less than 0.2 g/100 $H_2O$)

The quaternary ammonium salt used in the present invention includes the lake compounds as shown in exemplary compounds 4 and 10. These lake compounds can be obtained by treating a usual quaternary ammonium salt with a commonly available lake-forming agent. This lake-forming agent may include heteropolyacids and polyacids as exemplified by tungstophosphoric acid and tungstomolybdic acid.

In the coating resin material, the quaternary ammonium salt of the present invention may preferably be contained in an amount ranging from 0.5% to 30% by weight, and more preferably ranging from 1.0% to 20% by weight, based on the resin. Its addition in an amount less than 0.5 may bring about no satisfactory effect of making stable the resistance to environmental variations and the quantity of triboelectricity. Its addition in an amount more than 30% by weight may make non-uniform the coating on the carrier core material.

The insulating resin used in the present invention in the coating resin material includes single materials or mixtures of insulating resins used in usual carrier coating.

The insulating resin may preferably include vinyl resins. For example, it is possible to use polymers obtained using i) styrene or a styrene derivative such as o-methylstyrene, m-methylstyrene, p-methylstyrene, p-phenylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxylstyrene, p-chlorostyrene, 3,4-dichlorostyrene, m-nitrostyrene, o-nitrostyrene or p-nitrostyrene, and ii) one or more selected from ethylene and unsaturated monoolefins such as ethylene, propylene, butylene and isobutylene; unsaturated diolefins such as butadiene and isoprene; halogenated vinyls such as vinyl chloride, vinylidene chloride, vinyl bromide and vinyl fluoride; vinyl esters such as vinyl acetate, vinyl propionate and vinyl benzoate; methacrylic acid and $\alpha$-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate and phenyl methacrylate; acrylic acid and acrylates such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate and phenyl acrylate; maleic acid and maleic half esters; vinyl ethers such as methyl vinyl ether, ethyl vinyl ether and isobutyl vinyl ether; vinyl ketones such as methyl vinyl ketone, hexyl vinyl ketone and methyl isopropenyl ketone; N-vinyl compounds such as N-vinylpyrrole, N-vinylcarbazole, N-vinylindole and N-vinylpyrrolidone; vinylnaphthalenes; acrylic acid or methacrylic acid derivatives such as acrylonitrile, methacrylonitrile and acrylamide; and acroleins.

Acrylic copolymer resins such as styrene-methacrylate copolymers and styrene-acrylate copolymers are preferred on account of their superior durability and long lifetime.

It is effective to copolymerize an acrylic resin containing a hydroxyl group particularly in view of the adhesion to the carrier core material and the action by which the quaternary ammonium salt is made to come to the surface of the carrier.

Monomers of the acrylic resin containing a hydroxyl group include, for example, 2-hydroxyethyl acrylate, 2-hydroxypropyl acrylate, hydroxybutyl acrylate, 2-hydroxy-3-phenyloxypropyl acrylate, 2-hydroxyethyl methacrylate, 2-hydroxypropyl methacrylate, hydroxybutyl methacrylate and 2-hydroxy-3-phenyloxypropyl methacrylate. These monomers may preferably give a hydroxyl value of a copolymer in the range of from 1 to 100 (KOHmg/g), and more preferably from 5 to 70 (KOHmg/g).

In the present invention, a resin used as the binder resin that constitutes the carrier core material may include all sorts of resins obtained by polymerizing vinyl monomers. The vinyl monomers herein referred to can be exemplified by styrene and styrene derivatives such as o-methylstyrene, m-methylstyrene, p-methylstyrene, p-phenylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxylstyrene, p-chlorostyrene, 3,4-dichlorostyrene, m-nitrostyrene, o-nitrostyrene or p-nitrostyrene; ethylene and unsaturated monoolefins such as ethylene, propylene, butylene and isobutylene; unsaturated diolefins such as butadiene and isoprene; halogenated vinyls such as vinyl chloride, vinylidene chloride, vinyl bromide and vinyl fluoride; vinyl esters such as vinyl acetate, vinyl propionate and vinyl benzoate; methacrylic acid and $\alpha$-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate and phenyl methacrylate; acrylic acid and acrylates such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate and phenyl acrylate; maleic acid and maleic half esters; vinyl ethers such as methyl vinyl ether, ethyl vinyl ether and isobutyl vinyl ether; vinyl ketones such as methyl vinyl ketone, hexyl vinyl ketone and methyl isopropenyl ketone; N-vinyl compounds such as N-vinylpyrrole, N-vinylcarbazole, N-vinylindole and N-vinylpyrrolidone; vinylnaphthalenes; acrylic acid or methacrylic acid derivatives such as acrylonitrile, methacrylonitrile and acrylamide; and acroleins. Polymers obtained using one or more kinds of any of these can be used.

Besides the resins obtained by polymerizing vinyl monomers, it is also possible to use non-vinyl condensation type resins such as polyester resins, epoxy resins, phenol resins, urea resins, polyurethane resins, polyimide resins, cellulose resins and polyether resins, or mixtures of any of these and the vinyl resins described above.

A magnetic material used in the fine magnetic material particles that constitute the carrier core material in the present invention may include, for example, ferromagnetic metals such as iron, cobalt and nickel, iron oxides such as ferrite, magnetite and hematite, and alloys or compounds containing an element exhibiting ferromagnetic properties, such as cobalt or nickel. The fine magnetic material particles used in the present invention may preferably have a saturation magnetization of 60 emu/g or higher under application of a magnetic field of 10 kOe. If the saturation magnetization is lower than 60 emu/g, the carrier tends to adhere to the electrostatic image bearing member even if the fine magnetic material particles is in a large content. The magnetic force is measured using VSM, manufactured by Toei Kogyo K.K.

The fine magnetic material particles used in the present invention may preferably have a primary average particle diameter of 2.0 $\mu$m or smaller. If the primary average particle diameter is larger than 2.0 $\mu$m, the core material can have no dense surface and the coating formed by the coating resin on the carrier core material used in the present invention tends not to be in a uniform state. In the carrier of the present invention, the fine magnetic material particles should preferably be contained in an amount of not less than 30% by weight, and more preferably not less than 50% by weight, based on the total weight of the carrier. If they are in an amount less than 30% by weight, the carrier tends to adhere to the electrostatic image bearing member and also it becomes difficult to control specific resistance of the carrier.

One of important properties of the magnetic material dispersed carrier of the present invention in which magnetic material is dispersed, is a toner charge controllability. Use of the coating resin material in the present invention enables appropriate control of the specific resistance of the carrier, in particular, enables prevention of the charge-up of toner in a low-humidity environment.

The fine magnetic material particles described above may preferably have a specific resistance of not higher than $10^9$ $\Omega$.cm for the purpose of controlling the specific resistance of the carrier in the present invention. The specific resistance of the fine magnetic material particles can be measured according to the method of measuring the specific resistance of the carrier as described later.

The carrier used in the present invention may preferably has an average particle diameter ranging from 10 to 60 $\mu$m. A carrier with an average particle diameter smaller than 10 $\mu$m tends to cause its adhesion to the electrostatic image bearing member. A carrier with an average particle diameter larger than 60 $\mu$m may give a large shear to a developer in a developing assembly, tending to cause deterioration of the developer, in particular, separation of an external additive from toner particles, and a change in shapes. Moreover, a large particle diameter results in a small specific surface area, and hence the quantity of the toner that can be held as a component for the developer decreases, tending to give images lacking in preciseness. The particle size of the carrier used in the present invention is indicated as horizontal direction maximum chord length, and measured by the microscopic method, where 300 or more carrier particles are selected at random, and their diameters actually measured are used as carrier particle diameters in the present invention.

The carrier of the present invention may preferably have a true specific gravity ranging from 1.5 to 5.0, and more preferably from 1.5 to 4.5. If its true specific gravity is more than 5.0, a large load may be applied to the developer in a developing assembly, and is not preferable from the viewpoint of deterioration of the developer. If its true specific gravity is less than 1.5, it is actually difficult to obtain a magnetic force strong enough to prevent the adhesion of carrier to the electrostatic image bearing member. The true specific gravity of the carrier used in the present invention is measured using True Denser (manufactured by Seishin Kigyo).

The carrier used in the present invention may preferably have a specific resistance ranging from $10^7$ to $10^{14}$ Ω.cm. If its specific resistance is lower than $10^7$ Ω.cm, electric currents may leak from the sleeve toward the surface of the electrostatic image bearing member in a developing zone in the case of the development in which a bias voltage is applied, resulting in a difficulty in obtaining good images. If its specific resistance is higher than $10^{14}$ Ω.cm, the charge-up may occur in a low-humidity environment to cause image deterioration such as density decrease, faulty transfer or fogging.

In the present invention, the specific resistance is measured using a measuring method as shown in FIG. 1. That is, used is a method in which a carrier is packed in a cell A and electrodes 1 and 2 are so provided as to come into contact with the packed carrier, where a voltage is applied between the electrodes and the electric currents flowing at that time are measured to determine specific resistance $\rho$ (Ω.cm). In this measuring method, a change may occur in packing because the carrier is a powder, which may be accompanied with a change in specific resistance, and thus care must be taken. The specific resistance in the present invention is measured under conditions of a contact area S between the packed carrier and the electrodes of about 2.3 $cm^2$, a thickness of about 1 mm, a load of the upper electrode 2 of 175 g, and an applied voltage of 100 V.

In view of the feature that the specific resistance of the carrier of the present invention is regulated within the above range, what is characteristic of the present invention is that the specific resistance can be readily controlled by coating the low-resistance core material containing the fine magnetic material particles, with the coating resin material in the present invention. What is characteristic of the present invention is that the specific resistance can be readily controlled by giving a uniform coating in such a coat configuration. In other words, the state of surface exposure of the fine magnetic material particles in the core material and the state of coating of the coating resin are closely concerned with the properties of the carrier. For example, even when the resistance is the same in measurement, a carrier particle with a partially low resistance tends to cause any irregularity on images. Accordingly, in order to achieve a good developing performance, it is necessary to keep substantially constant the resistance at every part of the carrier particle surface.

In order for the resistance at every part of the core material surface to have a uniform resistance, it is considered preferable for the fine magnetic material particles to be uniformly dispersed on every part of the core material surface. As a result of observation by the present inventors using a scanning electron microscope to examine the state of dispersion of the fine magnetic material particles on the core material, they have found that the carrier in the present invention is in such a state that the fine magnetic material particles are uniformly dispersed at every part of the core material surface and at least part of the surfaces of the fine magnetic material particles is substantially exposed on the surface of the core material.

The carrier of the present invention should have a sphericity (major axis/minor axis) of not more than 2. If the sphericity is more than 2, the carrier of the present invention tends to become less effective for decreasing the shear applied to the developer and for improving the fluidity required in developers. Thus, its sphericity may preferably be not more than 2 so that the effects that can be attained by the carrier of the present invention are not damaged, i.e., to prevent deterioration of the developer and to improve developing performance.

The carrier of the present invention can be made to have the sphericity of not more than 2 by a means including a method in which the core material is heated to bring its surface into heat fusion so as to be formed into a sphere, a method in which the core material is mechanically formed into a sphere, and a method in which the core material is prepared using a conventional suspension polymerization method comprising adding fine magnetic material particles, a polymerization initiator, a suspension stabilizer and other additives to a monomer solution of a binder resin used for the core material, and dispersing followed by granulation-polymerizing to give a core material.

The process for producing the carrier of the present invention will be described below.

The process for producing the carrier of the present invention comprises basically two steps of preparing the core material and thereafter coating the core with a resin.

In the first place, as methods of preparing the core material, there are a method in which the binder resin and the fine magnetic material particles are mixed in the desired weight ratio, which are then kneaded at a suitable temperature using a heating melt-mixing apparatus as exemplified by a three-roll mill or extruder, and, after cooled, the kneaded product is pulverized and classified; a method in which the binder resin is dissolved in a solvent, and the fine magnetic material particles are mixed therein to give a slurry, followed by granulation using a spray dryer and then drying; and a suspension polymerization method in which the fine magnetic material particles, a polymerization initiator, a suspension stabilizer and so forth are added to and dispersed in a monomer solution of the binder resin for the core material, followed by granulation-polymerizing. In particular, according to the polymerization method described above, not only it is easy to control the sphericity to be not more than 2 or less but also it is possible to make control to the state that the fine magnetic material particles are uniformly dispersed at every part of the core material surface and at least part of the surfaces of the fine magnetic material particles substantially is exposed to the surface of the core material. Thus, this method is preferred as a method of preparing the core material for obtaining the effect of the present invention.

Next, as methods of coating the core material with a resin, taking account of the fact that the core material is comprised of a resin, it is preferable to use a treating method by which a coating resin can be rapidly coated without mutual adhesion of core material particles. Preferably used is a treating method in which coating and drying is simultaneously carried out in such a way that selection of a solvent in which the coating resin is dissolved and conditions such as treatment temperature and time are well controlled and also the core material is always fluidized. Meanwhile, the coating weight of the coating resin material may vary depending on the true specific gravity of the carrier core material. The true specific gravity of the carrier being represented by X, an optimum value of the coating weight of the coating resin material may preferably satisfy the following relationship:

$$\frac{1}{2}X \leqq \text{coating weight of coating resin material} \leqq 50/X \text{ (\% by weight);}$$

and more preferably;

$$1/X \leqq \text{coating weight of coating resin material} \leqq 50/X \text{ (\% by weight).}$$

More specifically, if the coating weight of the coating resin material is less than ½X % by weight, the coating weight of the coating resin material is so small that it is difficult to uniformly coat the core material surface and, even if possible, the carrier can not have a satisfactory strength. If it is more than 50/X % by weight, the coating weight of the coating resin material is so large that it is also difficult to carry out uniform coating, and also an excess coating resin material tends to be present alone in the carrier. Consequently, not only it becomes difficult to make control resistance to its optimum value, which is a characteristic feature of the present invention, but also developing performance may deteriorate because of the adhesion of the excess coating resin material to the electrostatic image bearing member during development.

In the case where the quaternary ammonium salt is contained in the coating resin material, the quaternary ammonium salt used in the present invention can be dispersed in the carrier coating solution by a method in which the quaternary ammonium salt kept in the state of non-soluble particles is dispersed in the coating resin material solution, or a method in which the quaternary ammonium salt is previously dissolved in a solvent arbitrarily selected, and then mixed with the coating resin material solution, and further thoroughly mixed using a mixing machine to make both solutions dissolve together.

The former method is advantageous in that any compounds may be used so long as they are quaternary ammonium salts of the present invention, and can be selected from a vast range of the compounds.

The latter method, on the other hand, necessarily requires limitation of the quaternary ammonium salts to those capable of being dissolved in the solvent, giving a narrow range of selection, but is advantageous in the following:

Since the quaternary ammonium salt is dissolved, better results can be obtained with its use in a smaller amount, compared with the former method in which it is merely dispersed in the state of non-soluble particles. In addition, the quaternary ammonium salt is presumed to be microscopically dispersed and present in a uniform state, and hence the triboelectric chargeability to a toner in the same opportunity of contact can be more improved than that in the case when the compound is merely dispersed. It therefore becomes possible to quicken the rise of static charge of the toner.

In the two-component type developer for developing electrostatic images according to the present invention, the magnetic material dispersed carrier described above should preferably be used in a content of from 10 to 1,000 parts by weight, and more preferably from 30 to 500 parts by weight, based on 10 parts by weight of the carrier.

The toner used in the present invention should preferably have a weight average particle diameter of from 1 to 20 μm, more preferably from 4 to 13 μm, and still more preferably from 4 to 10 μm.

The toner used in the present invention may also preferably have a particle size distribution in the following range, in view of resolution and toner consumption.

That is, it is preferred that toner particles with particle diameters of 5 μm or less comprise 17% to 60% by number of the whole particles, toner particles with particle diameters ranging from 8 to 12.7 μm comprise 1% to 30% by number of the whole particles and toner particles with particle diameters of 16 μm or more comprise less than 2.0% by volume of the whole particles.

Preferred configuration of the toner used in the present invention will be described below in greater detail.

Toner particles with particle diameters of 5 μm or less should comprise 17% to 60% by number of the whole particles as described above, preferably from 25% to 50% by number, and more preferably from 30% to 50% by number. If the toner particles with particle diameters of 5 μm or less comprise less than 17% by number, toner particles effective for high image quality become short, in particular, an effective toner particle component may decrease as the toner is consumed during continuous copying or printing-out, resulting in a poor balance of particle size distribution of the toner and a gradual lowering of image quality. If they comprise more than 60% by number, agglomeration of toner particles tends to occur to form toner clusters larger than the original particle diameter, resulting in coarse images, a lowering of resolution and a great difference in density between edges and inner areas of latent images to tend to give images with a little blank areas.

Toner particles with particle diameters ranging from 8 to 12.7 μm should comprise 1% to 30% by number of the whole particles as described above, preferably from 1% to 23% by number, and more preferably from 8% to 20% by number. If they comprise more than 23% by number, in particular, more than 30% by number, images may become poor and at the same time excess development (i.e., over-application of toner) may occur to cause an increase in toner consumption. On the other hand, if they comprise less than 1% by number, it becomes difficult to obtain a high image density. Between % by number (N %) and % by volume of the group of toner particles with particle diameters of 5 μm or less, there is a relation of $N/V = -0.04N + k$, wherein k represents a positive number in the range of $4.5 \leqq k \leqq 6.5$, preferably $4.5 \leqq k \leqq 6.0$, and more preferably $4.5 \leqq k \leqq 5.5$. N is in the range of $17 \leqq N \leqq N \leqq 60$ as previously shown, preferably $25 \leqq N \leqq 50$, and more preferably $30 \leqq N \leqq 50$.

In the case of $k < 4.5$, toner particles with particle diameters smaller than 5.0 μm may become short to make poor image density, resolution and sharpness. In development, the presence of a proper amount of fine toner particles hitherto having been considered unnecessary contributes achievement of closest packing of the toner and formation of uniform images free from coarseness. In particular, it enables uniform filling of contours of fine lines and images, and hence more promotes sharpness also in visual sensation. In the case of $k < 4.5$, these performances may become poor because of a shortage of the component having this particle size distribution.

From another viewpoint, in order to satisfy the condition of $k<4.5$ in the manufacture, a large quantity of fine powder must be removed by such means as classification. This is disadvantageous from the viewpoints of yield and toner cost. In the case of $k>6.5$, the presence of excess fine powder tends to cause a decrease in image density during repeated copying. Such a phenomenon is presumed to occur when excessive fine-powdery non-magnetic toner particles having excess electrostatic charges are statically charged and adhere onto the developing sleeve and/or carrier to hinder normal performances for carrying non-magnetic toner to the developing sleeve or the carrier and for imparting electrostatic charges thereto.

The toner particles with particle diameters of 16 μm or more should preferably comprise less than 2.0% by volume as previously described, more preferably not more than 1.0% by volume, and still more preferably not more than 0.5% by volume. If they comprise more than 2.0% by volume, not only fine-line reproduction may be hindered but also faulty transfer images may be caused in a transfer step, which latter is due to the presence of a little coarse toner particles of 16 μm or larger, protruded from the surface of a developed toner particle thin layer on the electrostatic image bearing member, which makes irregular the delicate state of close contact between the electrostatic image bearing member and transfer paper interposing a toner layer.

The weight average particle diameter and particle size distribution of the toner can be measured by various methods. In the present invention, the measurement is carried out by using a Coulter counter.

A Coulter counter Type TA-II (manufactured by Coulter Electronics, Inc.) is used as a measuring device. An interface (manufactured by Nikkaki k.k.) that outputs number distribution and volume distribution and a personal computer CX-1 (manufactured by Canon Inc.) are connected. As an electrolytic solution, an aqueous 1% NaCl solution is prepared using first-grade sodium chloride. Measurement is carried out by adding as a dispersant from 0.1 to 5 ml of a surface active agent, preferably an alkylbenzene sulfonate, to from 100 to 150 ml of the above aqueous electrolytic solution, and further adding from 2 to 20 mg of a sample to be measured. The electrolytic solution in which the sample has been suspended is subjected to dispersion treatment for about 1 minute to about 3 minutes in an ultrasonic dispersion machine. The particle size distribution of particles of 2 μm to 40 μm is measured on the basis of their number by means of the above Coulter counter Type TA-II, using an aperture of 100μ as its aperture. Then the values according to the present invention are determined.

As the binder resin applied in the toner used in the present invention, the following toner binder resins can be used in the case where a heat-pressure roller fixing device having an oil applicator is used.

For example, usable ones are homopolymers of styrene or derivatives thereof such as polystyrene poly-p-chlorostyrene and polyvinyltoluene; styrene copolymers such as a styrene-p-chlorostyrene copolymer, a styrene-vinyltoluene copolymer, a styrene-vinylnaphthalene copolymer, a styrene-acrylate copolymer, a styrene-methacrylate copolymer, a styrene-methyl α-chloromethacrylate copolymer, a styrene-acrylonitrile copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer and a styrene-acrylonitrile-indene copolymer; polyvinyl chloride, phenol resins, natural resin modified phenol resins, natural resin modified maleic acid resins, acrylic resins, methacrylic resins, polyvinyl acetate, silicone resins, polyester resins, polyurethane resins, polyamide resins, furan resins, epoxy resins, xylene resins, polyvinyl butyral, terpene resins, cumarone indene resins, and petroleum resins.

In a heat-pressure roller fixing system to which oil is little applied, the offset-phenomenon in which part of the toner image on a toner image bearing member transfers to the roller and the adhesion of toner to the toner image bearing member are important problems. Toners capable of being fixed at less heat energy are usually subject to blocking or caking during storage or in a developing assembly and therefore these problems must be taken into account at the same time. Hence, in the case when the heat-pressure roller fixing system to which oil is little applied is used in the present invention, it is more important to select binder resins. Preferable binder resins include cross-linked styrene copolymers or cross-linked polyesters.

Comonomers copolymerizable with styrene monomers in styrene copolymers may include vinyl monomers such as monocarboxylic acids having a double bond and derivatives thereof as exemplified by acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile and acrylamide; dicarboxylic acids having a double bond and derivatives thereof as exemplified by maleic acid, butyl maleate, methyl maleate and dimethyl maleate; vinyl esters as exemplified by vinyl chloride, vinyl acetate and vinyl benzoate; olefins as exemplified by ethylene, propylene and butylene; vinyl ketones as exemplified by methyl vinyl ketone and hexyl vinyl ketone; and vinyl ethers as exemplified by methyl vinyl ether, ethyl vinyl ether and isobutyl vinyl ether; any of which may be used alone or in combination of two or more.

Here, as a cross-linking agent, compounds having at least two polymerizable double bonds may be used, including aromatic divinyl compounds as exemplified by divinyl benzene and divinyl naphthalene; carboxylic acid esters having two double bonds as exemplified by ethylene glycol diacrylate, ethylene glycol dimethacrylate and 1,3-butanediol dimethacrylate; divinyl compounds as exemplified by divinyl aniline, divinyl ether, divinyl sulfide and divinyl sulfone; and compounds having at least three vinyl groups; any of which may be used alone or in the form of a mixture. The cross-linking agent may be used at the time of the synthesis of the binder resin, in an amount of from 0.01% to 10% by weight, and preferably from 0.05% to 5% by weight, on the basis of the binder resin. This is preferable in view of anti-offset properties and fixing performance.

In use of a pressure fixing system, binder resins for pressure-fixing toner can be used, as exemplified by polyethylene, polypropylene, polymethylene, polyurethane elastomers, an ethylene-ethyl acrylate copolymer, an ethylene-vinyl acetate copolymer, ionomer resins, a styrene-butadiene copolymer, a styrene-isoprene copolymer, linear saturated polyesters, and paraffin.

In the toner used in the present invention, a charge control agent may preferably be used by compounding it into toner particles (internal addition) or blending it with toner particles (external addition). The charge control agent enables control of optimum electrostatic charges in conformity with developing systems. Particularly in the present invention, it can make more stable the balance between particle size distribution and charging. Thus, use of the charge control agent can make clearer both the function separation for making image quality higher for each particle diameter range described above and the mutually supplementary performance. A positive charge control agent may include Nigrosine and products modified with a fatty acid metal salt; quaternary ammonium salts such as tributylbenzylammonium 1-hydroxy-4-naphthoslulfonate and tetrabutylammonium teterafluoroborate; diorganotin oxides such as dibutyltin oxide, dioctyltin oxide and dicyclohexyltin oxide; and diorganotin borates such as dibutyltin borate, dioctyltin borate and dicyclohexyltin borate; any of which may be used alone or in combination of two or more kinds. Of these, Nigrosine type or quaternary ammonium salt type charge control agents may particularly preferably be used.

Homopolymers of monomers represented by the following Formula (II);

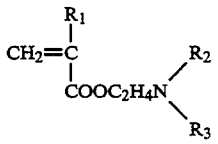

Formula (II)

$R_1$: H or $CH_3$ $R_2$, $R_3$: A substituted or unsubstituted alkyl group, preferably $C_1$ to $C_4$;

or copolymers of polymerizable monomers such as styrene, acrylates or methacrylates as described above may also be used as positive charge control agents. In this case, these charge control agents can also act as binder resins (as a whole or in part).

As a negative charge control agent usable in the present invention, for example, organic metal complex salts and chelate compounds are effective, as exemplified by aluminumacetylacetonato, iron (II) acetylacetonato and chromium 3,5-di-tert-butylsalicylate. In particular, acetylyacetone metal complexes (including monoalkyl derivatives and dialkyl derivatives), salicylic acid type metal complexes (including monoalkyl derivatives and dialkyl derivatives), or salts thereof are preferred. Salicylic acid type metal complexes or salicylic acid type metal salts are particularly preferred.

The charge control agents described above (those having no action as binder resins) may preferably be used in the form of fine particles. In this case, the charge control agent may preferably have a number average particle diameter of specifically 4 μm or less, and more preferably 3 μm or less.

When internally added to the toner, such a charge control agent may preferably be used in an amount of from 0.1 part to 20 parts by weight, and more preferably from 0.2 part to 10 parts by weight, based on 100 parts by weight of the binder resin.

Fine silica powder may preferably be added to the toner used in the present invention. Combination of the toner and fine silica powder brings about a remarkable decrease in friction because of interposition of fine silica powder between toner particles and carrier or sleeve surface. This enables achievement of a longer lifetime of the toner and the carrier and/or sleeve and also maintenance of stable charge performance, making it possible to give a much superior two-component type developer having toner and carrier even in its use for a long term.

In particular, in the case of a toner with a weight average particle diameter of 10 μm or less, its surface specific area and volume average particle diameter may become larger than those of a toner with a weight average particle diameter of 10 μm or more. Thus, when the former is brought into contact with toner particles to carry out triboelectric charging, frequency of contact between toner particles and carrier become larger than that in the latter toner with a weight average particle diameter of 10 μm or more, so that wear of toner particles or contamination of carrier tends to occur. In such a case, the addition of fine silica powder makes it possible to give better two-component type developer as stated above.

As the fine silica powder, both of fine silica powder produced by the dry process and that produced by the wet process may be used. In view of anti-filming and durability, it is preferred to use the dry process fine silica powder.

The dry process herein referred to is, for example, a process for producing fine silica powder formed by vapor phase oxidation of, for example, a silicon halide compound.

As for a method in which the fine silica powder used in the present invention is produced by the wet process, conventionally known various methods can be applied.

In the fine silica powder herein referred to, anhydrous silicon dioxide (colloidal silica) or a silicate such as aluminum silicate, sodium silicate, potassium silicate, magnesium silicate or zinc silicate can be applied.

Of the above fine silica powders, a fine silica powder having a surface specific area, as measured by the BET method using nitrogen absorption, of not less than 30 $m^2/g$, and preferably in the range of from 50 to 400 $m^2/g$, can give good results. The fine silica powder should preferably be used in an amount of from 0.01 part to 8 parts by weight, and more preferably from 0.1 part to 5 parts by weight, based on 100 parts by weight of the toner.

In the case where the toner used in the present invention is used as a positively chargeable toner, a positively chargeable fine silica powder, rather than a negatively chargeable one, may more preferably be used also as a fine silica powder added for the purpose of preventing wear of toner or preventing contamination of carrier or sleeve surface, since the charge stability is not damaged. In the case where it is used as a negatively chargeable toner, a negatively chargeable fine silica powder may more preferably be used for the same reasons.

In general, the fine silica powder is negatively chargeable. As methods of obtaining the positively chargeable fine silica powder, there are a method in which the untreated fine silica powder is treated with a silicone oil having an organo group having at least one nitrogen atom on its side chain, and a method in which it is treated with a nitrogen-containing silane coupling agent, or a method in which it is treated with both of these.

The positively chargeable silica used in the present invention refers to those having a plus triboelectric charge with respect to iron powder carrier when measured by the blow-off method.

As the silicone oil having a nitrogen atom on its side chain, used when the fine silica powder is treated, it is possible to use a silicone oil having at least a unit structure represented by the following Formula (III).

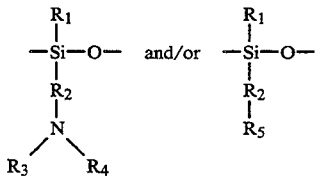

Formula (III)

wherein $R_1$ represents a hydrogen atom, an alkyl group, an aryl group or an alkoxyl group; $R_2$ represents an alkylene group or a phenylene group; $R_3$ and $R_4$ each represent a hydrogen atom, an alkyl group or an aryl group; and $R_5$ represents a nitrogen-containing heterocyclic ring.

In the above formula, the alkyl group, aryl group, alkylene group and phenylene group may each have an organo group having a nitrogen atom, or may have halogen substituent in a range of not damaging the charge performance. The above silicone oil should be used in an amount of from 1% to 50% by weight, and preferably from 5% to 30% by weight, on the basis of the fine silica powder.

The nitrogen-containing silane coupling agent used in the present invention generally have a structure represented by the following Formula (IV). Formula (IV)

Rm—Si—Yn wherein R represents an alkoxy group or a halogen atom; Y represents an amino group or an organo group having at least one nitrogen atom; and m and n are each an integer of 1 to 3, provided that m+n=4.

The organo group having at least one nitrogen atom can be exemplified by an amino group having an organic group as a substituent, a nitrogen-containing heterocyclic group, or a group having a nitrogen-containing heterocyclic group. The nitrogen-containing heterocyclic group may include unsaturated heterocyclic groups or saturated heterocyclic groups, and known groups can be applied for these. The unsaturated heterocyclic groups can be exemplified by the following:

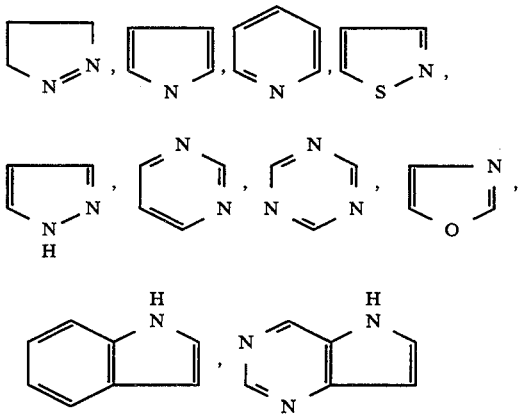

The saturated heterocyclic groups can be exemplified by the following:

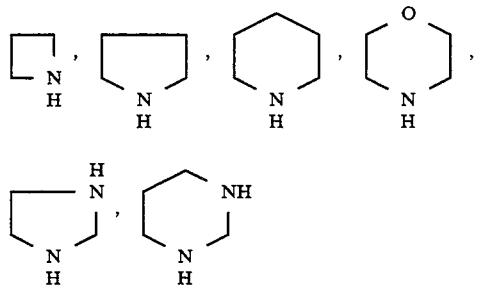

The heterocyclic groups used in the present invention should preferably be those of structure of 5 members or 6 members, taking account of stability.

Examples of such treating agents may be aminopropyltrimethoxysilane, aminopropyltriethoxysilane, dimethylaminopropyltrimethoxysilane, diethylaminopropyltrimethoxysilane, dipropylaminopropyltrimethoxysilane, dibutylaminopropyltrimethoxysilane, monobutylaminopropyltrimethoxysilane, dioctylaminopropyltrimethoxysilane, dibutylaminopropyltrimethoxysilane, dibutylaminopropyltrimethoxysilane, dibutylaminopropylmonomethoxysilane, dimethylaminophenyltriethoxysilane, trimethoxysilyl-γ-propylphenylamine and trimethoxysilyl-γ-propylbenzylamine. As the nitrogen-containing heterocylic group, those having the above structure can be used. Examples of such compounds may be methoxysilyl-γ-propylpiperidine, trimethoxysilyl-γ-propylmorphorine and trimethoxysilyl-γ-propylimidazole. The silane coupling agent described above should preferably be used in an amount of from 1% to 50% by weight, and more preferably from 5% to 30% by weight, on the basis of the fine silica powder.

These treated positive or negative fine silica powder can be effective when it is applied in an amount of from 0.01 part to 8 parts by weight based on 100 parts by weight of the toner, and, in particular, can exhibit positive or negative chargeability with an excellent stability when added in an amount of from 0.1 part to 5 parts by weight. A preferred embodiment for the mode of addition is in a state that the treated fine silica powder added in an amount of from 0.1 part to 3 parts by weight based on 100 parts by weight of the toner is adhered to the toner particle surfaces. The untreated fine silica powder may also be used in the same amount as this amount.

The fine silica powder used in the present invention may be optionally treated with a treating agent such as a silane coupling agent or an organic silicon compound for the purpose of making the powder hydrophobic, where it is treated with the teating agent capable of reactively or physically adhere to the fine silica powder. Such a treating agent may include, for example, hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, tirornanosilyl mercaptan, tirmethylsilyl mercaptan, tirornanosilyl acrylate, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and a dimethylpolysiloxane having 2–12 siloxane units a molecule and containing a hydroxyl group bonded to each Si in its units positioned at the terminals. Any of these may be used alone or in the form of a mixture of two or more kinds. The above treating agent may preferably be used in an amount of from 1% to 40% by weight on the basis of the fine silica powder.

Fine titanium oxide powder ($TiO_2$) with a BET specific surface area of from 50 to 400 $m^2/g$ may also be used in place of the fine silica powder. A mixed powder of the fine silica powder and the fine titanium oxide powder may also be used.

It is also possible to add to the toner used in the present invention a fine powder of fluorine-containing polymer as exemplified by a fine powder of polytetrafluoroethylene, polyvinylidene fluoride or a tetrafluoroethylene-vinylidene fluoride copolymer. In particular, fine polyvinylidene fluoride powder is preferred in view of fluidity and abrasive properties. Such a powder may preferably be added to the toner in an amount of from 0.01% to 2.0% by weight, particularly from 0.02% to 5% by weight, and more preferably from 0.02% to 1.0% by weight.

As a colorant, conventionally known dyes and/or pigments can be used. For example, carbon black, Phthalocyanine Blue, Peacock Blue, Permanent Red, Lake Red, Rhodamine Lake, Hanza Yellow, Permanent Yellow and Benzidine Yellow can be used. The colorant may be in a content of from 0.1 part to 20 parts by weight, and preferably from 0.5 part to 20 parts by weight, based on 100 parts by weight of the binder resin. In order to improve the transparency of an OHP film on which a toner image has been fixed, it should preferably be in a content of not more than 12 parts by weight, and more preferably from 0.5 part to 9 parts by weight.

For the purpose of improving releasability at the time of heat roll fixing, a waxy substance such as a low-molecular weight polyethylene, a low-molecular weight polypropylene, microcrystalline wax, carnauba wax, sazole wax or paraffin wax may be added to the toner used in the present invention, in an amount of from 0.5% to 5% by weight. This is also one of preferred embodiments of the present invention.

Other additives may optionally be further used in the toner of the present invention.

The toner used in the present invention can be produced by thoroughly mixing a vinyl type or non-vinyl type thermoplastic resin, optionally a pigment or dye as a colorant, a charge control agent and other additives using a mixing machine such as a ball mill, thereafter melt-kneading the mixture using a heat kneading machine such as a heat roll, a kneader or an extruder to make resins melt together, dispersing or dissolving a pigment or dye in the molten product, and solidifying it by cooling, followed by pulverization and strict classification to give toner particles.

Figure 2:
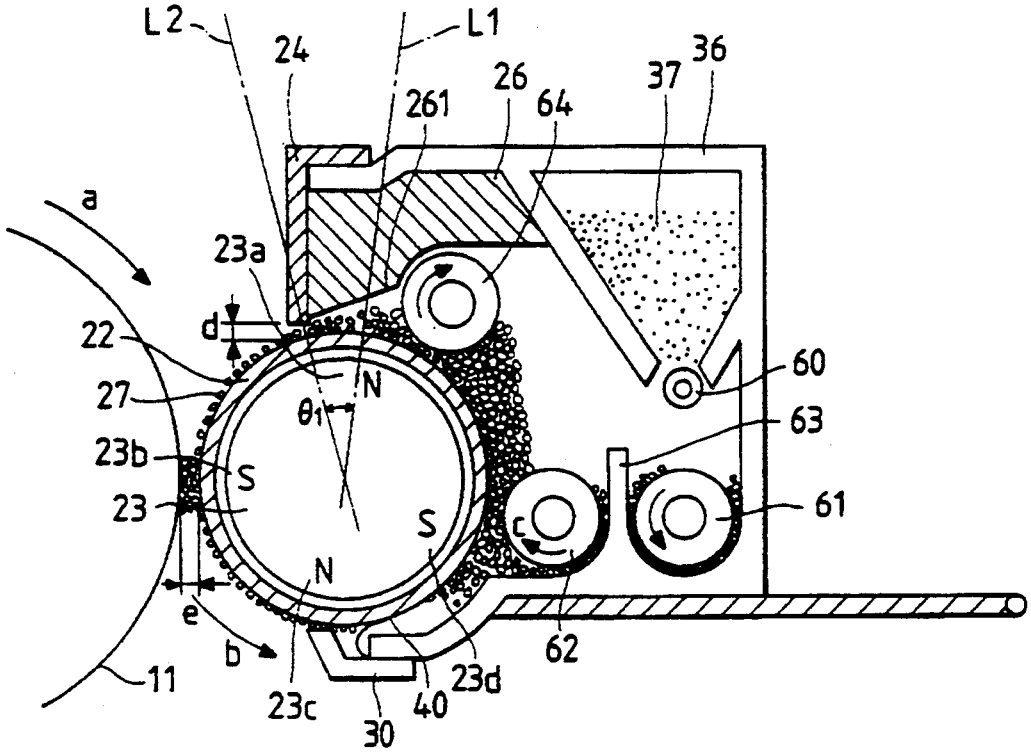
FIG. 2 illustrates an example of the developing apparatus used in the image forming method of the present invention.

The image forming method according to the present invention will be described below with reference to a developing apparatus shown in FIG. 2.

A electrostatic image bearing member 11 is an insulating drum for electrostatic recording or a photosensitive drum or photosensitive belt having a layer comprising a photoconductive insulating material such as α-Se, CdS, $ZnO_2$, OPC or α-Si. The electrostatic image bearing member 11 is rotated in the direction of arrow a by means of a driving device (not shown). Reference numeral 22 denotes a developing sleeve serving as a developer carrying member coming into proximity to or contact with the electrostatic image bearing member 11, the sleeve being comprised of a non-magnetic material such as aluminum or SUS 316 stainless steel. The developing sleeve 22 is laterally provided in a rotatably supported state on a shaft in such a manner that it is thrust into a developing container 36 by substantially the right half of its periphery, from an oblong opening formed in the longitudinal direction of the container 36 in the wall at its left lower side, and is exposed to the outside of the container by substantially the left half of its periphery, and is rotated in the direction of arrow b.

Reference numeral 23 denotes a stationary permanent magnet serving as a means for generating stationary magnetic fields, provided inside a developing sleeve (a developer carrying member) and held in alignment at the position and posture as shown in the drawing, and is stationarily held as it is, at the position and posture as shown in the drawing, even when the developing sleeve 22 is rotatingly driven. This magnet 23 has four magnetic poles of a north (N) magnetic pole **23*a*, a south (S) magnetic pole 23*b*, a north (N) magnetic pole 23*c* and a south (S) magnetic pole 23*d*. The magnet 23** may be comprised of an electromagnet in place of the permanent magnet.

Reference numeral 24 denotes a non-magnetic blade serving as a developer control member, provided on, and along the longitudinal direction of, the upper edge of the opening of a developer feeding device at which the developing sleeve 22 is disposed, in such a manner that its base is fixed on the side wall of the container and its tip protrudes to the opening of the container 36 more inside than the position of the upper edge of the opening. The blade is made of, for example, SUS316 stainless steel so worked as to be bent in the L-form in its lateral cross section.

Reference numeral 26 denotes a magnetic carrier limit control member the front surface of which is brought into contact with the inner surface of the lower side of the non-magnetic blade 24 and the forward bottom surface of which is made to serve as a developer guide surface 261. The part composed of the non-magnetic blade 24, the magnetic carrier limit control member 26 and so forth is a control zone.

Reference numeral 27 denotes the carrier of the present invention comprising the carrier core material comprised of fine magnetic material particles dispersed in a binder resin, and coated with the coating resin material. Reference numeral 37 denotes a non-magnetic toner. Reference numeral 40 denotes a seal member that seals the toner accumulating at the bottom part of the developing container 36. The seal member has an elasticity and is bent in the direction of the rotation of the developing sleeve 22 so that it is elastically pressed against the surface of the developing sleeve 22. This seal member 40 has its end on the downstream side of the direction in which the sleeve is rotated and in the area at which it comes into contact with the sleeve, so as to allow the developer to enter into the inner side of the container.

Reference numeral 30 denotes a scatter preventive electrode plate that causes a floating developer generated in a developing step to adhere to the photosensitive member side under application of a voltage having the same polarity as the developer so that the developer can be prevented from scattering.

Reference numeral 60 denotes a toner feed roller which is operated in accordance with an output obtained from a toner density sensor (not shown). As the sensor, it is possible to utilize a system by which the volume of the developer is detected, an antenna system in which a piezoelectric device, an inductance variation detecting device and an alternating current bias are utilized, or a system by which an optical density is detected. The non-magnetic toner 37 is fed by the rotating/stopping of the roller. A fresh developer fed with the non-magnetic toner 37 is blended and stirred while it is transported by means of a first screw 61. Hence, the toner fed is triboelectrically charged in the course of this transportation. Reference numeral 63 denotes a partition plate, which is cut out at the both ends of its longitudinal direction, and at these cutouts the fresh developer transported by the screw 61 is delivered to a second screw 62.

The S magnetic pole **23*d*** serve as a transport pole. It enables a recovered developer to be collected into the container after development has been carried out, and also the developer in the container to be transported to the control zone.

In the vicinity of the magnetic pole **23*d*, the fresh developer transported by the second screw 62** provided in proximity to the sleeve and the developer recovered after developing are intermingled.

Reference numeral 64 denotes a transport screw, which makes uniform the quantity of the developer in the direction of the developing sleeve axis.

The distance d between the lower end of the non-magnetic blade 24 and the surface of the developing sleeve 22 may be in the range of from 100 to 900 μm and preferably from 150 to 800 μm. If this distance is smaller than 100 μm, the magnetic particles as will be described later tend to cause clogging between them to give an uneven developer layer and also may make it impossible to apply the developer in the quantity necessary for carrying out good development, thus bringing about the disadvantage that only developed images with low density and much uneveness can be obtained. The distance d should preferably be not less than 400 μm in order to prevent non-uniform coating (what is called "blade clogging") caused by unusable particles included in the developer. If it is larger than 900 μm, the amount of the developer applied to the developing sleeve 22 may increase to make it impossible to control the developer layer to have a given thickness, so that magnetic particles may be adhered to the electrostatic image bearing member 11 in a large quantity and at the same time the circulation of developer and the development control attributable to the developer limit control member 26, as will be described later, may be weakened to bring about the disadvantages that the triboelectricity of toner becomes short and fog tends to occur.

When an imaginary line connecting the center of the developing sleeve 22 and the magnetic pole **23*a* is represented by $L_1$ and an imaginary line connecting the center of the developing sleeve 22 and the tip of the non-magnetic blade 24** serving as a developer limit control member is represented by $L_2$, the angle formed by the imaginary lines $L_1$ and $L_2$ is regarded as $\theta_1$.

This angle $\theta_1$ should ranges from $-5°$ to $35°$, and preferably from $0°$ to $25°$. In an instance of $\theta_1 < -5°$, a developer thin layer formed by the magnetic force, reflection force, cohesive force and so forth applied to the developer may become sparse and greatly uneven. In an instance of $\theta_1 > 35°$, the coating weight of the developer may increase even with use of the non-magnetic blade, making it difficult to apply a given amount of the developer.

When the developing sleeve 22 is rotatingly driven in the direction of arrow b, this layer comprising magnetic particles moves more slowly at its part apart from the surface of the developing sleeve 22 because of the balance between a restraint force based on gravity and a transport force acting in the direction of the movement of the developing sleeve 22. Of course, some of the layer may fall by the influence of gravity.

Accordingly, the positions at which the magnetic poles **23*a* and 23*d* are disposed and the fluidity and magnetic characteristics of the magnetic carrier 27 may be appropriately selected, so that the magnetic particle layer is more transported toward the magnetic pole 23*a* at its part near to the sleeve to form a mobile layer. With movement of this magnetic carrier 27, the toner is transported to a developing zone as the developing sleeve 22** is rotated, and used there to carry out development.

At this time, it is preferred that the developer layer on the developing sleeve 22 is made to have a thickness equal to or slightly larger than the distance e of the gap at which the developing sleeve 22 and the electrostatic image bearing member 11 are opposed, and an alternating electric field is applied to the gap. This distance e should be in the range of from 50 to 800 μm, and more preferably from 100 to 700 μm.

Application of an alternating electric field or a developing bias obtained by overlapping an alternating electric field and a direct-current electric field facilitates the movement of the non-magnetic toner 37 from the developing sleeve 22 to the electrostatic image bearing member 11, so that images with much better quality can be formed.

The alternating electric field as the above alternating electric field to be applied may preferably be not more than 2,000 Vpp. In the instance where the direct-current electric field is overlapped, the direct-current electric field may preferably be applied so as not to be more than 1,000 V.

A method of measuring the quantity of triboelectricity of the toner to the carrier in the present invention will be described in detail with reference to FIG. 3.

Figure 3:
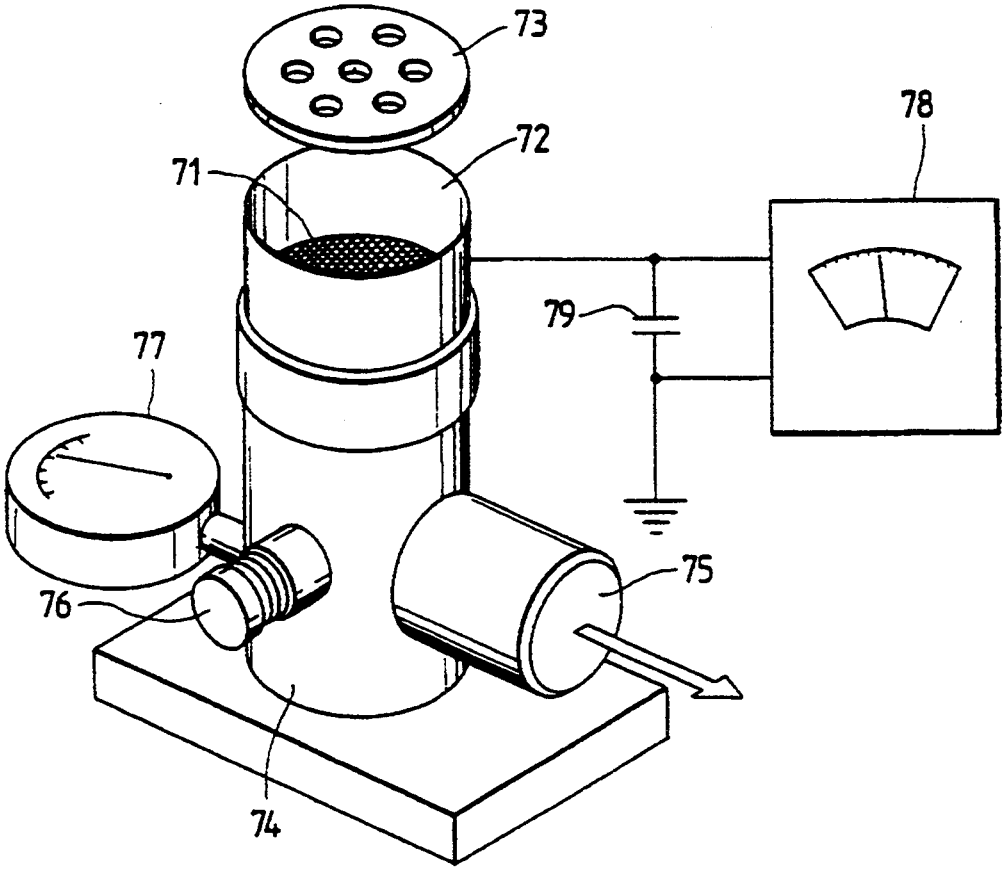
FIG. 3 is a schematic view to diagrammatically illustrate an apparatus for measuring triboelectric charges of a toner of the two-component type developer according to the present invention.

FIG. 3 illustrates an apparatus for measuring the quantity of triboelectricity. In a measuring container 72 made of a metal at the bottom of which is provided a conducting screen 71 of 400 meshes (appropriately changeable to the size the screen does not pass the carrier), magnetic particles (a mixture of a toner and the carrier of the present invention) on a developer supporting member are put and the container is covered with a plate 73 made of a metal. The total weight of the measuring container 72 in this state is weighed and is expressed by $W_1$ (g). Next, in a suction device (in which at least the part coming into contact with the measuring container 72 is made of insulating material), air is sucked from a suction opening 75 and an air-flow control valve 76 is operated to control the pressure indicated by a vacuum indicator 77 to be 70 mmHg. In this state, suction is sufficiently carried out (for about 1 minute) to remove the toner by suction. The potential indicated by a potentiometer 78 at this time is expressed by V (volt). Reference numeral 79 denotes a capacitor, whose capacitance is expressed by C (μF). The total weight of the measuring container after completion of the suction is also weighed and is expressed by W2 (g). The quantity Q (μC/g) of triboelectricity is calculated as shown by the following equation.

$$Q(\mu C/g) = C \times V/(W_1 - W_2).$$

The measurement is carried out under conditions of 23° C. and 65% RH.

As having been described above, the carrier for electrophotography according to the present invention comprises a carrier core material and a coating resin material with which the surface of the carrier core material is coated, the carrier core material has a binder resin and fine magnetic material particles dispersed in the binder resin, and also the carrier core material contains the specific components or members as already described. Thus, this carrier can be well satisfactory on the following;

(1) anti-spent properties;
(2) impact resistance (preventing carrier from breaking);
(3) preventing toner from deteriorating;
(4) developing performance;
(5) preventing carrier from adhering onto photosensitive members;
(6) controlling resistance of carrier;
(7) stabilizing chargeability of toner (making lifetime longer in regard to chargeability); and
(8) stabilizing chargeability of toner against environmental variations;

and can stably provide images with a high quality over a long period of time.

The two-component type developer for developing electrostatic images according to the present invention contains as a carrier the carrier comprised as described above, and brings about the following effects.

(1) Good images can be formed over a long period of time because of less carrier deterioration such as toner-spent caused by running.
(2) Electrostatic charges may undergo only a very slight change due to environmental variations, and hence it is possible to obtain images with a stable image density.
(3) The effect noted in the above (2) is not impaired even by running.

In the process for producing the carrier for electrophotography according to the present invention, a coating solution or coating dispersion containing the specific coating components described above is applied to the carrier core material to coat the surface of the carrier core material with the coating resin material. Hence, it is possible to obtain a carrier for electrophotography in which the coating components are uniformly dispersed in the coating resin material.

In the image forming method of the present invention, a latent image is developed using the two-component type developer comprised as described above, under application of a bias voltage in a developing zone. Hence, leak of electric current or adhesion of carrier to the electrostatic image bearing member can be decreased and good images can be formed over a long period of time.

EXAMPLES

The present invention will be described below by giving Examples, which by no means limit the present invention. In the following formulation, "%" and "part(s)" refer to "% by weight" and "part(s) by weight", respectively, in all occurrences unless particularly indicated. Mw and Mn indicates weight average molecular weight and number average molecular weight, respectively.

EXAMPLE 1

| | |
|---|---|
| Styrene | 22.2% |
| 2-Ethylhexyl acrylate | 11.1% |
| Reduced iron (particle diameter: 0.32 μm) | 66.7% |

The above materials were heated in a container to a temperature of 70° C., and dissolved to give a monomer mixture. Then, while the monomer mixture was maintained at 70° C., an initiator azobisisonitrile was added thereto and dissolved. A monomer composition was thus prepared. This was introduced in a 2 liter flask holding 1.2 liter of an aqueous 1% polyvinyl alcohol (PVA) solution, followed by stirring at 70° C. for 10 minutes at 4,500 rpm using a homogenizer to granulate the monomer composition. Thereafter, with stirring using a paddle stirrer, polymerization was carried out at 70° C. for 10 hours. After the polymerization was completed, the reaction product was cooled, and the resulting magnetic material dispersed styrene acrylic slurry was washed and filtered. The resulting product was dried to give a carrier core material.

The surface of the carrier core material thus obtained was coated with the following coating resin material.

| | |
|---|---|
| Styrene/2-hydroxyethyl methacrylate/methyl methacrylate copolymer (monomer composition weight ratio: 35:8:57; hydroxyl value (KOH mg/g): 30; weight average molecular weight (Mw): 52,000; weight average molecular weight/number average molecular weight (Mw/Mn): 2.5) | 50% |
| Vinylidene fluoride/tetrafluoroethylene copolymer (monomer composition weight ratio: 75:25; weight average molecular weight (Mw): 210,000) | 50% |

The above resin materials were dissolved in a concentration of 10% in a mixed solvent of acetone and methyl ethyl ketone (mix weight ratio: 1:1) so that resin coating weight becomes 0.8% according to the calculating system previously described. A carrier coating solution was thus prepared. With this carrier coating solution, the above carrier core material was coated using a coater (trade name: Spiracoater; manufactured by Okada Seiko k.K.) while coating and drying were simultaneously carried out. The resulting carrier core material having been thus coated was dried at a temperature of 90° C. for 2 hours to remove the solvent. A carrier for electrophotography comprising the carrier core material coated on its surface with the coating resin material was thus obtained. The resulting carrier for electrophotography was observed using an electron microscope to confirm that the carrier core material was uniformely coated with the resin and magnetic material particles were substantially exposed uniformly on the coating surface. Physical properties of the carrier are shown in Table 1.

| | |
|---|---|
| Polyester resin obtained by condensation of propoxydated bisphenol with fumaric acid | 100 parts |
| Phthalocyanine pigment | 5 parts |
| Chromium complex salt of di-tert-butylsalicylate | 4 parts |

The above materials were thoroughly premixed using a Henschel mixer, and the mixture was thereafter melt-kneaded three times using a three-roll mill. After cooled, the kneaded product was crushed using a hammer mill to have a particle diameter of about 1 to 2 mm. Subsequently, the crushed product was finely pulverized using a fine grinding mill of an air-jet system. The finely pulverized product obtained was then classified to give a cyan color powder (a toner) with a negative chargeability, having a weight average particle diameter of 12.3 μm.

Next, 100 parts of the cyan color powder and 0.4 part of a fine silica powder having been made hydrophobic by treatment with hexamethyldisilazane were mixed to give a cyan toner having fine silica powder on the toner particle surfaces.

This cyan toner and the above carrier for electrophotography were blended in an environment of temperature/humidity of N/N (23° C./60% RH) at a toner concentration of 10% to give a two-component type developer. Next, 100 g of the two-component type developer thus obtained was put in a 250 cc polyethylene bottle, followed by shaking for 1 hour using a tumbling mixer. Thereafter, this two-component type developer was taken out and the developer was observed using an electron microscope. As a result, neither falling-off of magnetic materials from carrier particles, separation of the coating material nor filming due to the toner was seen. Neither falling-off nor burying of external additives of the toner was also seen.

The cyan toner and the above carrier for electrophotography were blended in an environment of temperature/humidity of L/L (15° C./10% RH) in a toner concentration of 10% to give a two-component type developer. In the same environment, this developer was put in a developing assembly used for a full-color laser copier CLC-1, manufactured by Canon Inc., and unloaded drive was continued for 30 minutes by external motor driving (peripheral speed: 300 rpm). Thereafter, using the CLC-1, images were reproduced under development contrast of 300 V. As a result, density of solid images also was sufficiently high and reproduction at halftone areas was good.

Results of evaluation are shown in Table 2.

COMPARATIVE EXAMPLE 1

The same carrier as in Example 1 except that the carrier core material was not coated with the resin was used as a carrier for electrophotography to make the same measurement and tests as in Example 1. Physical properties of the carrier are shown in Table 1, and results of evaluation, in Table 2.

As a result of the shaking test, observation using an electron microscope revealed the falling-off of magnetic material from carrier.

COMPARATIVE EXAMPLE 2

Using reduced iron particles of 45 μm in place of the carrier core material used in Example 1, the coating resins used in Example 1 were applied at a resin coating weight of 0.8% in the same manner as in Example 1 to give a carrier for electrophotography, and the same measurement and tests as in Example 1 were made. Physical properties of the carrier are shown in Table 1, and results of evaluation, in Table 2.

As a result of the shaking test, the carrier for electrophotography had no difference from the one before shaking, but the burying of external additives on toner surfaces was seen a little. As a result of the image reproduction test, coarse images were seen particularly at halftone areas.

COMPARATIVE EXAMPLE 3

The same carrier core material as used in Example 1 was used.

Vinylidene fluoride/tetrafluoroethylene copolymer (monomer composition weight ratio: 75:25; weight average molecular weight (Mw): 210,000).

Using only the above material in place of the carrier coating resin material used in Example 1, this material was dissolved in a concentration of 10% in a mixed solvent of acetone and methyl ethyl ketone so that resin coating weight becomes 1.0%. A carrier coating solution was thus prepared.

With the carrier coating solution, the surface of the carrier core material was coated in the same manner as in Example 1 to give a carrier for electrophotography comprising the carrier core material coated on its surface with the coating resin material.

Microscopic observation revealed that the carrier core material was not uniformly coated.

Using this carrier for electrophotography, the same measurement and tests as in Example 1 were made. Physical properties of the carrier are shown in Table 1, and results of evaluation, in Table 2.

As a result of the shaking test, the separation of coating material was seen, and the falling-off of magnetic material from carrier was also seen. In addition, uneven images were formed in the image reproduction test.

EXAMPLE 2

| | |
|---|---|
| Styrene/2-ethylhexyl acrylate (55/45) copolymer | 50% |
| Reduced iron | 50% |

The above materials were thoroughly premixed using a Henschel mixer, and the mixture was thereafter melt-kneaded at least twice using a three-roll mill. After cooled, the kneaded product was crushed using a hammer mill to have a particle diameter of about 2 mm. Subsequently, the crushed product was finely pulverized using a fine grinding mill of an air-jet system to have a particle diameter of 50 μm. The finely pulverized product was introduced in Mechanomill MM-10 (trade name; manufactured by Okada Seiko K.K.) to mechanically make the particles spherical.

The finely pulverized particles made spherical were then classified to give a carrier core material. This carrier core material had a particle diameter of 49 μm.

The surface of the carrier core material thus obtained was coated with a coating resin material in the same manner as in Example 1 to give a carrier for electrophotography.

Using this carrier for electrophotography, the same measurement and tests as in Example 1 were made. Physical properties of the carrier are shown in Table 1, and results of evaluation, in Table 2.

As a result, in the shaking test and also in the image reproduction test, the same good results as in Example 1 were obtained.

EXAMPLE 3

| | |
|---|---|
| Polyester resin obtained by condensation of ethoxydated bisphenol, fumaric acid and trimellitic acid (50/40/10) | 40% |
| Magnetite (particle diameter: 0.26 μm) | 60% |

Using the above materials, a carrier core material made spherical was obtained in the same manner as in Example 2. This carrier core material had a particle diameter of 53 μm.

The surface of the carrier core material thus obtained was coated with the following coating resin material in the same manner as in Example 1.

| | |
|---|---|
| Styrene/2-hydroxymethyl methacrylate/methyl methacrylate/ethyl methacrylate copolymer (monomer composition weight ratio: 57:20:13;10; hydroxyl value (KOH mg/g): 40; weight average molecular weight (Mw): 54,000; weight average molecular weight/number average molecular weight (Mw/Mn): 3.2) | 40% |
| Methyl-etherified melamine formaldehyde resin | 10% |
| Vinyldiene fluoride/tetrafluoroethylene copolymer (monomer composition weight ratio: 75:25; weight average molecular weight (Mw): 210,000) | 50% |

Using a carrier coating solution prepared by dissolving the above resin materials in a concentration of 10% in a methyl ethyl ketone solution so that resin coating weight becomes 1.1%, the above carrier core material was coated in the same manner as in Example 1 to give a carrier for electrophotography. The same measurement and test as in Example 1 were carried out to obtain the same good results as in Example 1. Physical properties of the carrier are shown in Table 1, and results of evaluation, in Table 2.

EXAMPLE 4

A carrier core material was prepared in the same manner as in Example 3 except that the amount of magnetite used therein was changed to 38% (the balance was polyester resin). The same resin materials as used in Example 3 were dissolved at a concentration of 10% in a methyl ethyl ketone solution so that resin coating weight becomes 0.9%, to give a carrier coating solution. The carrier core material was coated therewith in the same manner as in Example 3. A carrier for electrophotography was thus obtained. Using this carrier for electrophotography, the same measurement and test as in Example 1 were made. Physical properties of the carrier are shown in Table 1, and results of evaluation, in Table 2. The same good results as in Example 3 were obtained in the shaking test. In the image reproduction test made in a low-humidity environment, the adhesion of carrier was slightly seen and the density of solid images became slightly lower than that in Example 3, which, however, were not particularly problematic in practical use.

EXAMPLE 5

| | |
|---|---|
| Phenol | 10.0% |
| Formaldehyde (formaldehyde: about 37%; methanol: about 10%; balance: water) | 5.0% |

-continued

| | |
|---|---|
| Magnetite (particle diameter: 0.25 μm) | 85.0% |

The above materials were stirred in an aqueous phase, using ammonia as a basic catalyst and calcium fluoride as a polymerization stabilizer, during which the temperature was gradually raised to 80° C. and polymerization was carried out for 2 hours to give a carrier core material. This carrier core material had a particle diameter of 41 μm. Using a methyl ethyl ketone solution in which the resin materials as used in Example 3 had been dissolved in a concentration of 10% so that resin coating weight becomes 1.0%, the carrier core material obtained was coated in the same manner as in Example 3 to give a carrier for electrophotography. Using this carrier for electrophotography, the same measurement and test as in Example 1 were carried out to obtain the same good results as in Example 1. Physical properties of the carrier are shown in Table 1, and results of evaluation, in Table 2.

COMPARATIVE EXAMPLE 4

The same carrier as prepared in Example 1 except that the carrier core material was not coated with the coating resin material was used as a carrier for electrophotography to make the same measurement and test as in Example 1. As a result, in the shaking test, the falling-off of magnetic material from carrier was seen. In the image reproduction test, image irregularity occurred which was presumably due to a lowering of applied bias voltage. Physical properties of the carrier are shown in Table 1, and results of evaluation, in Table 2.

EXAMPLE 6

| | |
|---|---|
| Styrene/2-ethylhexyl acrylate/dimethylaminoethyl methacrylate copolymer (monomer composition weight ratio: 80:15:5) | 100 parts |
| Copper phthalocyanine | 4 parts |
| Low-molecular weight polypropylene | 5 parts |

Using the above materials, blue particles with a weight average particle diameter of 11.7 μm were obtained in the same manner as in Example 1. In 100 parts of this particles, 0.8 part of positively chargeable colloidal silica having been treated with amino-modified silicone oil was mixed using a Henschel mixer to give a positively chargeable blue toner.

The above toner and the carrier for electrophotography as prepared in Example 5 were blended at a toner concentration of 8% to produce a two-component type developer, and the same measurement and test as in Example 1 were made using a copier NP-4835, manufactured by Canon Inc. As a result, in the image reproduction test, uniform images with a superior positive chargeability were obtained. Physical properties of the carrier are shown in Table 1, and results of evaluation, in Table 2.

TABLE 1

| | Coat material (%) | Hydroxyl value (KOH mg/g) | Acryl component monomer ratio (%) | Weight average molecular weight (Mw) | Mw/Mn |
|---|---|---|---|---|---|
| Example: | | | | | |
| 1 | St-2HEMA-MMA (50) | 30 | 65 | 52,000 | 2.5 |
| | VdF-TFE (5) | — | — | 210,000 | — |

TABLE 1-continued

| | | | | | |
|---|---|---|---|---|---|
| Comparative Example: | | | | | |
| 1 | — | — | — | — | — |
| 2 | The same as Ex. 1 | | The same as Example 1 | | |
| 3 | VdF-TFE | — | — | 210,000 | — |
| Example: | | | | | |
| 2 | The same as Ex. 1 | | The same as Example 1 | | |
| 3 | St-2HMMA-MMA-EMA (40) | 40 | 43 | 54,000 | 3.2 |
| | MEFA (10) | — | — | — | — |
| | VdF-TFE (50) | — | — | 210,000 | — |
| 4 | The same as Ex. 3 | | The same as Example 3 | | |
| 5 | The same as Ex. 3 | | The same as Example 3 | | |
| Comparative Example: 4 | — | — | — | — | — |
| Example: 6 | The same as Ex. 5 | | The same as Example 5 | | |

| | Carrier true specific gravity | Magnetic material σs (emu/g) | Carrier particle diameter (μm) | Carrier specific resistance (Ω · cm) | Magnetic material | Core preparation | Coating weight (charge weight) (%) |
|---|---|---|---|---|---|---|---|
| Example: 1 | 2.4 | 139 | 45 | $3 \times 10^{11}$ | Reduced iron | St-Ac polymerization | 0.8 |
| Comparative Example: | | | | | | | |
| 1 | 2.4 | 139 | 44 | $5 \times 10^{7}$ | Reduced iron | St-Ac polymerization | — |
| 2 | 7.8 | 142 | 45 | $6 \times 10^{9}$ | Reduced iron | — | 0.8 |
| 3 | 2.4 | 139 | 45 | $2 \times 10^{9}$ | Reduced iron | St-Ac polymerization | 1.0 |
| Example: | | | | | | | |
| 2 | 1.8 | 139 | 49 | $5 \times 10^{11}$ | Reduced iron | St-Ac pulverization | 1.1 |
| 3 | 1.9 | 83 | 53 | $9 \times 10^{11}$ | Magnetite | Polyester pulverization | 1.1 |
| 4 | 1.4 | 83 | 49 | $6 \times 10^{14}$ | Magnetite | Polyester pulverization | 1.2 |
| 5 | 3.1 | 83 | 41 | $4 \times 10^{10}$ | Magnetite | Phenol polymerization | 0.9 |
| Comparative Example: 4 | 3.1 | 83 | 41 | $1 \times 10^{6}$ | Magnetite | Phenol polymerization | — |
| Example: 6 | 3.1 | 83 | 41 | $4 \times 10^{10}$ | Magnetite | Phenol polymerization | 0.9 |

St-2HEMA-MMA: Styrene/2-hydroxyethyl methacrylate/methyl methacrylate copolymer
VdF-TFE: Vinylidene fluoride/tetrafluoroethylene copolymer
St-2HMMA-MMA-EMA: Styrene/2-hydroxymethyl methacrylate/methyl methacrylate/ethyl methacrylate
MEFA: Methyl-etherified melamine formaldehyde resin

TABLE 2

| | Carrier surface SEM observation | SEM observation after PE bottle shaking test | Image reproduction test after L/L unloaded drive: Solid image | Image reproduction test after L/L unloaded drive: Halftone image |
|---|---|---|---|---|
| Example: 1 | AA | AA | AA | AA |
| Comparative Example: | | | | |
| 1 | — | C*1 | A | C*2 |
| 2 | A | C*3 | B | C*2 |
| 3 | C*4 | C*5 | C*6 | C*2 |
| Example: | | | | |
| 2 | AA | AA | A | A |
| 3 | AA | AA | A | A |
| 4 | AA | A | B | B |
| 5 | AA | AA | AA | AA |
| Comparative Example: 4 | — | C*1 | C*7 | C*8 |
| Example: 6 | AA | AA | AA | AA |

TABLE 2-continued

AA: Excellent,
A: Good,
B: Passable,
C: Failure
*1 Falling-off of magnetic material occurred.
*2 Coarse images.
*3 External additive of toner buried.
*4 Uneven coating.
*5 Separation of coating material and falling-off of magnetic material occurred.
*6 Uneven images.
*7 Adhesion of carrier and image irregularity occurred.
*8 Irregular images.

EXAMPLE 7

| | |
|---|---|
| Styrene | 22.2% |
| 2-Ethylhexyl acrylate | 11.1% |

-continued

| | |
|---|---|
| Magnetite (particle diameter: 0.26 μm) | 66.7% |

The above materials were heated in a container to a temperature of 70° C., and dissolved to give a monomer mixture. Then, while the monomer mixture was maintained at 70° C., an initiator azobisisonitrile was added thereto and dissolved. A monomer composition was thus prepared. This was introduced in a 2 liter flask holding 1.2 liter of an aqueous 1% polyvinyl alcohol (PVA) solution, followed by stirring at 70° C. for 10 minutes at 4,500 rpm using a homogenizer to granulate the monomer composition. Thereafter, with stirring using a paddle stirrer, polymerization was carried out at 70° C. for 10 hours. After the polymerization was completed, the reaction product was cooled, and the resulting magnetic material dispersed styrene acrylic slurry was washed and filtered. The resulting product was dried to give a carrier core material.

The surface of the carrier core material thus obtained was coated with the following coating resin material.

Styrene/methyl methacrylate/2-ethylhexyl acrylate copolymer (monomer composition weight ratio: 45:35:20; weight average molecular weight (Mw): 41,000; weight average molecular weight/number average molecular weight (Mw/Mn): 2.5).

The above resin material was dissolved in a concentration of 10% in toluene so that resin coating weight becomes 0.8% according to the calculating system previously described. A carrier coating solution was thus prepared. With this carrier coating solution, the above carrier core material was coated using a coater (trade name: Spiracoater; manufactured by Okada Seiko k. K.) while coating and drying were simultaneously carried out. The resulting carrier core material having been thus coated was dried at a temperature of 40° C. for 1 hour to remove the solvent, followed by heating at a temperature of 110° C. for 2 hours. A carrier for electrophotography comprising the carrier core material coated on its surface with the coating resin material was thus obtained. The resulting carrier for electrophotography was observed using an electron microscope to confirm that the carrier core material was uniformely coated with the resin and magnetic material particles was uniformly substantially exposed to the coating surface.

Physical properties of the carrier are shown in Table 3.

| | |
|---|---|
| Polyester resin obtained by condensation of propoxydated bisphenol with fumaric acid | 100 parts |
| Phthalocyanine pigment | 5 parts |
| Chromium complex salt of di-tert-butylsalicylate | 4 parts |

The above materials were thoroughly premixed using a Henschel mixer, and the mixture was thereafter melt-kneaded three times using a three-roll mill. After cooled, the kneaded product was crushed using a hammer mill to have a particle diameter of about 1 to 2 mm. Subsequently, the crushed product was finely pulverized using a fine grinding mill of an air-jet system. The finely pulverized product obtained was then classified to give a cyan color powder (a toner) with a negative chargeability, having a weight average particle diameter of 12.3 μm.

Next, 100 parts of the cyan color powder and 0.4 part of a fine silica powder having been made hydrophobic by treatment with hexamethyldisilazane were mixed to give a cyan toner having fine silica powder on the toner particle surfaces.

This cyan toner and the above carrier for electrophotography were blended in an environment of temperature/humidity of N/N (23° C./60% RH) at a toner concentration of 10% to give a two-component type developer. Next, 100 g of the two-component type developer thus obtained was put in a 250 cc polyethylene bottle, followed by shaking for 1 hour using a tumbling mixer. Thereafter, this two-component type developer was taken out and the developer was observed using an electron microscope. As a result, neither falling-off of magnetic materials from carrier particles, separation of the coating material nor filming due to the toner was seen. Neither falling-off nor burying of external additives of the toner was also seen.

The cyan toner and the above carrier for electrophotography were blended in an environment of temperature/humidity of L/L (15° C./10% RH) at a toner concentration of 8% to give a two-component type developer. In the same environment, this developer was put in a developing assembly used for a full-color laser copier CLC-1, manufactured by Canon Inc., and unloaded drive was continued for 30 minutes by external motor driving (peripheral speed: 300 rpm). Thereafter, using the CLC-1, images were reproduced under development contrast of 300 V. As a result, density of solid images also was sufficiently high and reproduction at halftone areas was good. Results of evaluation are shown in Table 2.

EXAMPLE 8

| | |
|---|---|
| Styrene | 22.2% |
| 2-Ethylhexyl acrylate | 11.1% |
| Reduced iron (particle diameter: 0.32 μm) | 66.7% |

The above materials were heated in a container to a temperature of 70° C., and dissolved to give a monomer mixture. Then, while the monomer mixture was maintained at 70° C., an initiator azobisisonitrile was added thereto and dissolved. A monomer composition was thus prepared. This was introduced in a 2 liter flask holding 1.2 liter of an aqueous 1% polyvinyl alcohol (PVA) solution, followed by stirring at 70° C. for 10 minutes at 4,500 rpm using a homogenizer to granulate the monomer composition. Thereafter, with stirring using a paddle stirrer, polymerization was carried out at 70° C. for 10 hours. After the polymerization was completed, the reaction product was cooled, and the resulting magnetic material dispersed styrene acrylic slurry was washed and filtered. The resulting product was dried to give a carrier core material.

The surface of the carrier core material thus obtained was coated with the following coating resin material.

Styrene/2-ethylhexyl methacrylate copolymer (monomer composition weight ratio: 40:60; weight average molecular weight (Mw): 42,000; weight average molecular weight/number average molecular weight (Mw/Mn): 2.9)

The above resin material was dissolved in a concentration of 10% in toluene so that resin coating weight becomes 0.8% according to the calculating system previously described. A carrier coating solution was thus prepared. With this carrier coating solution, the above carrier core material was coated using a coater (trade name: Spiracoater; manufactured by Okada Seiko k.K.) while coating and drying were simultaneously carried out. The resulting carrier core material having been thus coated was dried at a temperature of 40° C. for 1 hour to remove the solvent, followed by heating at a temperature of 110° C. for 2 hours. A carrier for electrophotography comprising the carrier core material coated on its surface with the coating resin material was thus obtained. The resulting carrier for electrophotography was observed using an electron microscope to confirm that the carrier core material was uniformly coated with the resin and magnetic material particles had uniformly substantially exposed to the coating surface.

Physical properties of the carrier are shown in Table 3.

The cyan toner as used in Example 7 and the above carrier for electrophotography were blended in an environment of temperature/humidity of N/N (23° C./60% RH) at a toner concentration of 10% to give a two-component type developer. Next, 100 g of the two-component type developer thus obtained was put in a 250 cc polyethylene bottle, followed by shaking for 1 hour using a tumbling mixer. Thereafter, this two-component type developer was taken out and the developer was observed using an electron microscope. As a result, neither falling-off of magnetic materials from carrier particles, separation of the coating material nor filming due to the toner was seen. Neither falling-off nor burying of external additives of the toner was also seen.

The cyan toner as used in Example 7 and the above carrier for electrophotography were blended in an environment of temperature/humidity of L/L (15° C./10% RH) at a toner concentration of 8% to give a two-component type developer. In the same environment, this developer was put in a developing assembly used for a full-color laser copier CLC-1, manufactured by Canon Inc., and unloaded drive was continued for 30 minutes by external motor driving (peripheral speed: 300 rpm). Thereafter, using the CLC-1, images were reproduced under development contrast of 300 V. As a result, density of solid images also was sufficiently high and reproduction at halftone areas was good. Results of evaluation are shown in Table 4.

COMPARATIVE EXAMPLE 5

The same carrier as in Example 8 except that the carrier core material was not coated with the resin was used as a carrier for electrophotography to make the same measurement and tests as in Example 8. Physical properties of the carrier are shown in Table 3, and results of evaluation, in Table 4.

As a result of the shaking test, observation using an electron microscope revealed the falling-off of magnetic material from carrier.

COMPARATIVE EXAMPLE 6

Using reduced iron particles of 43 μm in place of the carrier core material used in Example 8, the coating resin used in Example 8 was applied at a resin coating weight of 0.8% in the same manner as in Example 8 to give a carrier for electrophotography, and the same measurement and tests as in Example 8 were made. Physical properties of the carrier are shown in Table 3. Using this carrier, the same measurement and test as in Example 8 were made. Results of evaluation are shown in Table 4.

As a result of the shaking test, the carrier for electrophotography had no difference from the one before shaking, but the burying of external additives on toner surfaces was seen a little. As a result of the image reproduction test, coarse images were seen particularly at halftone areas.

Comparative Example 7

The same carrier core material as used in Example 8 was used.

Styrene/2-ethylhexyl methacrylate copolymer (monomer composition weight ratio: 40:60; weight average molecular weight (Mw): 42,000; weight average molecular weight/number average molecular weight (Mw/Mn): 2.9))

Using the above material in place of the carrier coating resin material used in Example 8, this material was dissolved in a concentration of 10% in toluene so that resin coating weight becomes 0.8%. A carrier coating solution was thus prepared.

With the carrier coating solution, the surface of the carrier core material was coated in the same manner as in Example 8 to give a carrier for electrophotography comprising the carrier core material coated on its surface with the coating resin material. The carrier for electrophotography thus obtained was observed using an electron microscope to reveal that the carrier core material was not uniformly coated. Using this carrier for electrophotography, the same measurement and tests as in Example 8 were made. Physical properties of the carrier are shown in Table 3, and results of evaluation, in Table 4.

As a result of the shaking test, the separation of coating material was seen, and the falling-off of magnetic material from carrier was also seen. In addition, uneven images were formed in the image reproduction test.

EXAMPLE 9

| | |
|---|---|
| Styrene/2-ethylhexyl acrylate (55/45) copolymer | 50% |
| Reduced iron | 50% |

The above materials were thoroughly premixed using a Henschel mixer, and the mixture was thereafter melt-kneaded at least twice using a three-roll mill. After cooled, the kneaded product was crushed using a hammer mill to have a particle diameter of about 2 mm. Subsequently, the crushed product was finely pulverized using a fine grinding mill of an air-jet system to have a particle diameter of 50 μm. The finely pulverized product was introduced in Mechanomill MM-10 (trade name; manufactured by Okada Seiko K.K.) to mechanically make the particles spherical.

The finely pulverized particles made spherical were then classified to give a carrier core material. This carrier core material had a particle diameter of 48 μm.

The surface of the carrier core material thus obtained was coated with a coating resin material in the same manner as in Example 8 to give a carrier for electrophotography.

Using this carrier for electrophotography, the same measurement and tests as in Example 8 were made. Physical properties of the carrier are shown in Table 3, and results of evaluation, in Table 4.

As a result, in the shaking test and also in the image reproduction test, the same good results as in Example 8 were obtained.

EXAMPLE 10

| | |
|---|---|
| Polyester resin obtained by condensation of ethoxydated bisphenol, fumaric acid and trimellitic acid (50/40/10) | 40% |
| Magnetite (particle diameter: 0.26 μm) | 60% |

Using the above materials, a carrier core material made spherical was obtained in the same manner as in Example 9. This carrier core material had a particle diameter of 54 μm.

The surface of the carrier core material thus obtained was coated with the following coating resin material in the same manner as in Example 8. Styrene/phenyl acrylate copolymer (monomer composition weight ratio: 50:50; weight average molecular weight (Mw): 56,000; weight average molecular weight/number average molecular weight (Mw/Mn): 4.5)

Using a carrier coating solution prepared by dissolving the above resin material in a concentration of 10% in toluene so that resin coating weight becomes 1.2%, the above carrier core material was coated in the same manner as in Example 8 to give a carrier for electrophotography. The same measurement and test as in Example 8 were carried out to obtain the same good results as in Example 8. Physical properties of the carrier are shown in Table 3, and results of evaluation, in Table 4.

EXAMPLE 11

A carrier core material was prepared in the same manner as in Example 10 except that the amount of magnetite used therein was changed to 38% (the balance was polyester resin). The same resin materials as used in Example 10 were dissolved in a concentration of 10% in toluene so that resin coating weight becomes 1.2%, to give a carrier coating solution. The carrier core material was coated therewith in the same manner as in Example 10. A carrier for electrophotography was thus obtained. Using this carrier for electrophotography, the same measurement and test as in Example 8 were made. Physical properties of the carrier are shown in Table 3, and results of evaluation, in Table 4.

The same good results as in Example 10 were obtained in the shaking test. In the image reproduction test made in a low-humidity environment, the adhesion of carrier was slightly seen and the density of solid images became slightly lower than that in Example 10, which, however, were not particularly problematic in practical use.

EXAMPLE 12

| | |
|---|---|
| Phenol | 10.0% |
| Formaldehyde (formaldehyde: about 37%; methanol: about 10%; balance: water) | 5.0% |
| Magnetite (particle diameter: 0.25 μm) | 85.0% |

The above materials were stirred in an aqueous phase, using ammonia as a basic catalyst and calcium fluoride as a polymerization stabilizer, during which the temperature was gradually raised to 80° C. and polymerization was carried out for 2 hours to give a carrier core material. This carrier core material had a particle diameter of 38 μm. Using a methyl ethyl ketone solution in which the resin materials as used in Example 10 had been dissolved at a concentration of 10% so that resin coating weight becomes 1.1%, the carrier core material obtained was coated in the same manner as in Example 10 to give a carrier for electrophotography. Using this carrier for electrophotography, the same measurement and test as in Example 8 were carried out to obtain the same good results as in Example 8. Physical properties of the carrier are shown in Table 3, and results of evaluation, in Table 4.

COMPARATIVE EXAMPLE 8

The same carrier as prepared in Example 12 except that the carrier core material was not coated with the coating resin material was used as a carrier for electrophotography to make the same measurement and test as in Example 8. As a result, in the shaking test, the falling-off of magnetic material from carrier was seen. In the image reproduction test, image irregularity occurred which was presumably due to a lowering of applied bias voltage. Physical properties of the carrier are shown in Table 3, and results of evaluation, in Table 4.

TABLE 3

| | Coat material (%) | Hydroxyl value (KOH mg/g) | Acryl component monomer ratio (%) | Weight average molecular weight (Mw) | Mw/Mn |
|---|---|---|---|---|---|
| Example: | | | | | |
| 7 | St-MMA-2EHA | 0 | 65 | 41,000 | 2.5 |
| 8 | St-2EHMA | 0 | 60 | 42,000 | 2.9 |
| Comparative Example: | | | | | |
| 5 | — | — | — | — | — |
| 6 | The same as Ex. 8 | | The same as Example 8 | | |
| 7 | St-2EHMA | 0 | 60 | 110,000 | 20.2 |
| Example: | | | | | |
| 9 | The same as Ex. 8 | | The same as Example 8 | | |
| 10 | St-PheA | 0 | 50 | 56,000 | 4.5 |
| 11 | The same as Ex. 10 | | The same as Example 10 | | |
| 12 | The same as Ex. 10 | | The same as Example 10 | | |
| Comparative Example: 8 | — | — | — | — | — |

| | Carrier | Magnetic | Carrier | Carrier | Coating weight |
|---|---|---|---|---|---|

TABLE 3-continued

| | true specific gravity | material σs (emu/g) | particle diameter (μm) | specific resistance (Ω · cm) | Magnetic material | Core preparation | (charge weight) (%) |
|---|---|---|---|---|---|---|---|
| Example: | | | | | | | |
| 7 | 2.2 | 83 | 42 | $8 \times 10^{11}$ | Magnetite | St-Ac polymerization | 0.8 |
| 8 | 2.4 | 139 | 45 | $2 \times 10^{11}$ | Reduced iron | St-Ac polymerization | 0.8 |
| Comparative Example: | | | | | | | |
| 5 | 2.4 | 139 | 45 | $4 \times 10^{7}$ | Reduced iron | St-Ac polymerization | — |
| 6 | 7.8 | 142 | 43 | $3 \times 10^{9}$ | Reduced iron | — | 0.8 |
| 7 | 2.4 | 139 | 45 | $1 \times 10^{8}$ | Reduced iron | St-Ac polymerization | 0.8 |
| Example: | | | | | | | |
| 9 | 1.8 | 139 | 48 | $3 \times 10^{11}$ | Reduced iron | St-Ac pulverization | 1.2 |
| 10 | 1.9 | 83 | 54 | $1 \times 10^{12}$ | Magnetite | Polyester pulverization | 1.2 |
| 11 | 1.4 | 83 | 51 | $7 \times 10^{14}$ | Magnetite | Polyester pulverization | 1.2 |
| 12 | 3.1 | 83 | 38 | $5 \times 10^{10}$ | Magnetite | Phenol polymerization | 1.1 |
| Comparative Example: 8 | 3.1 | 83 | 38 | $2 \times 10^{6}$ | Magnetite | Phenol polymerization | — |

St-MMA-2EHA: Styrene/methyl methacrylate/2-ethylhexyl acrylate copolymer
ST-2EHMA: Styrene/2-ethylhexyl methacrylate copolymer
ST-PheA: Styrene/phenyl acrylate copolymer

TABLE 4

| | Carrier surface | SEM observation after | Image reproduction test after L/L unloaded drive | |
|---|---|---|---|---|
| | SEM observation | PE bottle shaking test | Solid image | Halftone image |
| Example: | | | | |
| 7 | AA | AA | AA | AA |
| 8 | AA | AA | AA | AA |
| Comparative Example: | | | | |
| 5 | — | C*1 | A | C*2 |
| 6 | A | C*3 | B | C*2 |
| 7 | C*4 | C*5 | C*6 | C*6 |
| Example: | | | | |
| 9 | AA | AA | AA | A |
| 10 | AA | AA | AA | AA |
| 11 | AA | A | B | B |
| 12 | AA | AA | AA | AA |
| Comparative Example: | | | | |
| 8 | — | C*1 | C*7 | C*7 |

AA: Excellent, A: Good, B: Passable, C: Failure
*1Falling-off of magnetic material occurred.
*2Coarse images
*3External additive of toner buried.
*4Uneven coating.
*5Separation of coating material and falling-off of magnetic material occurred.
*6Uneven images.
*7Irregular images.

EXAMPLE 13

| | |
|---|---|
| Styrene | 22.2% |
| 2-Ethylhexyl acrylate | 11.1% |

-continued

| | |
|---|---|
| Reduced iron (particle diameter: 0.32 μm) | 66.7% |

The above materials were heated in a container to a temperature of 70° C., and dissolved to give a monomer mixture. Then, while the monomer mixture was maintained at 70° C., an initiator azobisisonitrile was added thereto and dissolved. A monomer composition was thus prepared. This was introduced in a 2 liter flask holding 1.2 liter of an aqueous 1% polyvinyl alcohol (PVA) solution, followed by stirring at 70° C. for 10 minutes at 4,500 rpm using a homogenizer to granulate the monomer composition. Thereafter, with stirring using a paddle stirrer, polymerization was carried out at 70° C. for 10 hours. After the polymerization was completed, the reaction product was cooled, and the resulting magnetic material dispersed styrene acrylic slurry was washed and filtered. The resulting product was dried to give a carrier core material. This carrier core material had a true specific gravity of 2.4.

The surface of the carrier core material thus obtained was coated with the following coating resin material.

| | |
|---|---|
| Styrene/2-ethylhexyl methacrylate copolymer (monomer composition weight ratio: 40:60; weight average molecular weight (Mw); 42,000; weight average molecular weight/number average molecular weight (Mw/Mn): 2.9) | 50% |
| Vinylidene fluoride/tetrafluoroethylene copolymer (monomer composition weight ratio: 75:25; weight average molecular weight (Mw): 210,000) | 50% |

The above resin materials were dissolved in a concentration of 10% in a mixed solvent of acetone and methyl ethyl ketone (mix weight ratio: 1:1) so that resin coating weight becomes 0.8% according to the calculating system previously described. A carrier coating solution was thus prepared. With this carrier coating solution, the above carrier core material was coated using a coater (trade name: Spiracoater; manufactured by Okada Seiko k.K.) while coating and drying were simultaneously carried out. The resulting carrier core material having been thus coated was dried at a temperature of 40° C. for 1 hour to remove the solvent, followed by heating at a temperature of 110° C. for 2 hours. A carrier for electrophotography comprising the carrier core material coated on its surface with the coating resin material was thus obtained. The resulting carrier for electrophotography was observed using an electron microscope to confirm that the carrier core material was uniformely coated with the resin and magnetic material particles were substantially exposed uniformly on the coating surface. Physical properties of the carrier are shown in Table 5.

| | |
|---|---|
| Polyester resin obtained by condensation of propoxydated bisphenol with fumaric acid | 100 parts |
| Phthalocyanine pigment | 5 parts |
| Chromium complex salt of di-tert-butylsalicylate | 4 parts |

The above materials were thoroughly premixed using a Henschel mixer, and the mixture was thereafter melt-kneaded three times using a three-roll mill. After cooled, the kneaded product was crushed using a hammer mill to have a particle diameter of about 1 to 2 mm. Subsequently, the crushed product was finely pulverized using a fine grinding mill of an air-jet system. The finely pulverized product obtained was then classified to give a cyan color powder (a toner) with a negative chargeability, having a weight average particle diameter of 12.3 μm.

Next, 100 parts of the cyan color powder and 0.4 part of a fine silica powder having been made hydrophobic by treatment with hexamethyldisilazane were mixed to give a cyan toner having fine silica powder on the toner particle surfaces.

This cyan toner and the above carrier for electrophotography were blended in an environment of temperature/humidity of N/N (23° C./60% RH) at a toner concentration of 10% to give a two-component type developer. Next, 100 g of the two-component type developer thus obtained was put in a 250 cc polyethylene bottle, followed by shaking for 1 hour using a tumbling mixer. Thereafter, this two-component type developer was taken out and the developer was observed using an electron microscope. As a result, neither falling-off of magnetic materials from carrier particles, separation of the coating material nor filming due to the toner was seen. Neither falling-off nor burying of external additives of the toner was also seen.

The cyan toner and the above carrier for electrophotography were blended in an environment of temperature/humidity of L/L (15° C./10% RH) at a toner concentration of 10% to give a two-component type developer. In the same environment, this developer was put in a developing assembly used for a full-color laser copier CLC-1, manufactured by Canon Inc., and unloaded drive was continued for 30 minutes by external motor driving (peripheral speed: 300 rpm). Thereafter, using the CLC-1, images were reproduced under development contrast of 300 V. As a result, density of solid images also was sufficiently high and reproduction at halftone areas was good. Results of evaluation are shown in Table 6.

COMPARATIVE EXAMPLE 9

The same carrier as in Example 13 except that the carrier core material was not coated with the resin was used as a carrier for electrophotography to make the same measurement and tests as in Example 13. Physical properties of the carrier are shown in Table 5, and results of evaluation, in Table 6.

As a result of the shaking test, observation using an electron microscope revealed the falling-off of magnetic material from carrier.

COMPARATIVE EXAMPLE 10

Using reduced iron particles of 45 μm in place of the carrier core material used in Example 13, the coating resins used in Example 13 were applied at a resin coating weight of 0.8% in the same manner as in Example 13 to give a carrier for electrophotography, having a true specific gravity of 7.8. Using this carrier for electrophotography, the same measurement and tests as in Example 13 were made. Physical properties of the carrier are shown in Table 5, and results of evaluation, in Table 6.

As a result of the shaking test, the carrier for electrophotography had no difference from the one before shaking, but the burying of external additives on toner surfaces was a little seen. As a result of the image reproduction test, coarse images were seen particularly at halftone areas.

COMPARATIVE EXAMPLE 11

The same carrier core material as used in Example 13 was used.

Vinylidene fluoride/tetrafluoroethylene copolymer (monomer composition weight ratio: 75:25; weight average molecular weight (Mw): 210,000)

Using only the above material in place of the carrier coating resin material used in Example 13, this material was dissolved at a concentration of 10% in a mixed solvent of acetone and methyl ethyl ketone (mixing weight ratio: 1:1) so that resin coating weight becomes 0.8%. A carrier coating solution was thus prepared.

With the carrier coating solution, the surface of the carrier core material was coated in the same manner as in Example 13 to give a carrier for electrophotography comprising the carrier core material coated on its surface with the coating resin material. The carrier for electrophotography obtained was observed using an electron microscope to reveal that the carrier core material was not uniformly coated. Using this carrier for electrophotography, the same measurement and tests as in Example 13 were made. Physical properties of the carrier are shown in Table 5, and results of evaluation, in Table 6.

As a result of the shaking test, the separation of coating material was seen, and the falling-off of magnetic material from carrier was also seen. In addition, uneven images were formed in the image reproduction test.

Example 14

| | |
|---|---|
| Styrene/2-ethylhexyl acrylate copolymer (monomer composition weight ratio: 55:45) | 50% |

-continued

| | |
|---|---|
| Reduced iron | 50% |

The above materials were thoroughly premixed using a Henschel mixer, and the mixture was thereafter melt-kneaded at least twice using a three-roll mill. After cooled, the kneaded product was crushed using a hammer mill to have a particle diameter of about 2 mm. Subsequently, the crushed product was finely pulverized using a fine grinding mill of an air-jet system to have a particle diameter of about 50 μm. The finely pulverized product was introduced in Mechanomill MM-10 (trade name; manufactured by Okada Seiko KK) to mechanically make the particles spherical.

The finely pulverized particles made spherical were then classified to give a carrier core material. This carrier core material had a particle diameter of 48 μm.

The surface of the carrier core material thus obtained was coated with a coating resin material in the same manner as in Example 13 to give a carrier for electrophotography. Using this carrier for electrophotography, the same measurement and tests as in Example 13 were made. Physical properties of the carrier are shown in Table 5, and results of evaluation, in Table 6.

As a result, in the shaking test and also in the image reproduction test, the same good results as in Example 13 were obtained.

EXAMPLE 15

| | |
|---|---|
| Polyester resin obtained by codensation of ethoxydated bisphenol, fumaric acid and trimellitic acid (monomer composition weight ratio: 50:40:10) | 40% |
| Magnetite (particle diameter: 0.26 μm) | 60% |

Using the above materials, a carrier core material made spherical was obtained in the same manner as in Example 14. This carrier core material had a particle diameter of 54 μm.

The surface of the carrier core material thus obtained was coated with the following coating resin material in the same manner as in Example 13.

| | |
|---|---|
| Styrene/phenyl acrylate copolymer (monomer composition weight ratio: 50:50; weight average molecular weight (Mw): 56,000; weight average molecular weight/number average molecular weight (Mw/Mn): 4.5) | 50% |
| Vinylidene fluoride/tetrafluoroethylene copolymer (monomer composition weight ratio: 75:25; weight average molecular weight (Mw): 210,000) | 50% |

Using a carrier coating solution prepared by dissolving the above resin materials in a concentration of 10% in methyl ethyl ketone so that resin coating weight becomes 1.2%, the above carrier core material was coated in the same manner as in Example 13 to give a carrier for electrophotography. The same measurement and test as in Example 13 were carried out to obtain the same good results as in Example 13. Physical properties of the carrier are shown in Table 5, and results of evaluation, in Table 6.

EXAMPLE 16

A carrier core material was prepared in the same manner as in Example 15 except that the amount of magnetite used therein was changed to 38% (the balance was polyester resin). The same resin materials as used in Example 15 were dissolved in a concentration of 10% in a methyl ethyl ketone solution so that resin coating weight becomes 1.2%, to give a carrier coating solution. The carrier core material was coated therewith in the same manner as in Example 15. A carrier for electrophotography was thus obtained. Using this carrier for electrophotography, the same measurement and test as in Example 13 were made. Physical properties of the carrier are shown in Table 5, and results of evaluation, in Table 6.

The same good results as in Example 15 were obtained in the shaking test. In the image reproduction test made in a low-humidity environment, the adhesion of carrier was slightly seen and the density of solid images became slightly lower than that in Example 15, which, however, were not particularly problematic in practical use.

EXAMPLE 17

| | |
|---|---|
| Phenol | 10.0% |
| Formaldehyde (formaldehyde: about 37%; methanol: about 10%; balance: water) | 5.0% |
| Magnetite (particle diameter: 0.25 μm) | 85.0% |

The above materials were stirred in an aqueous phase, using ammonia as a basic catalyst and calcium fluoride as a polymerization stabilizer, during which the temperature was gradually raised to 80° C. and polymerization was carried out for 2 hours to give a carrier core material. This carrier core material had a particle diameter of 38 μm. Using a methyl ethyl ketone solution in which the resin materials as used in Example 15 had been dissolved at a concentration of 10% so that resin coating weight becomes 1.1%, the carrier core material obtained was coated in the same manner as in Example 15 to give a carrier for electrophotography. Using this carrier for electrophotography, the same measurement and test as in Example 13 were carried out to obtain the same good results as in Example 13. Physical properties of the carrier are shown in Table 5, and results of evaluation, in Table 6.

COMPARATIVE EXAMPLE 12

The same carrier as prepared in Example 13 except that the carrier core material was not coated with the coating resin material was used as a carrier for electrophotography to make the same measurement and test as in Example 13. As a result, in the shaking test, the falling-off of magnetic material from carrier was seen. In the image reproduction test, image irregularity occurred which was presumably due to a lowering of applied bias voltage. Physical properties of the carrier are shown in Table 5, and results of evaluation, in Table 6.

EXAMPLE 18

| | |
|---|---|
| Styrene/2-ethylhexyl acrylate/dimethylaminoethyl methacrylate copolymer (monomer composition weight ratio: 80:15:5) | 100 parts |
| Copper phthalocyanine | 4 parts |
| Low-molecular weight polypropylene | 5 parts |

Using the above materials, cyan particles with a weight average particle diameter of 11.7 μm were obtained in the same manner as in Example 13. In 100 parts of this cyan particles, 0.8 part of positively chargeable colloidal silica having been treated with amino-modified silicone oil was mixed using a Henschel mixer to give a positively chargeable cyan toner.

The above cyan toner and the carrier for electrophotography as used in Example 17 were blended at a toner concentration of 8% to produce a two-component type developer, and the same measurement and test as in Example 13 were made using a copier NP-4835, manufactured by Canon Inc. As a result, in the image reproduction test, uniform images with a superior positive chargeability were obtained. Physical properties of the carrier are shown in Table 5, and results of evaluation, in Table 6.

TABLE 5

| | Coat material (%) | Hydroxyl value (KOH mg/g) | Acryl component monomer ratio (%) | Weight average molecular weight (Mw) | Mw/Mn |
|---|---|---|---|---|---|
| Example: | | | | | |
| 13 | St-2EHMA (50) | 0 | 60 | 42,000 | 2.9 |
| | VdF-TFE (50) | — | — | 210,000 | — |
| Comparative Example: | | | | | |
| 9 | — | — | — | — | — |
| 10 | The same as Ex. 13 | | The same as Example 13 | | |
| 11 | VdF-TFE | — | — | 210,000 | — |
| Example: | | | | | |
| 14 | The same as Ex. 13 | | The same as Example 13 | | |
| 15 | St-PheA (50) | 0 | 50 | 56,000 | 4.5 |
| | VdF-TFE (50) | — | — | 210,000 | — |
| 16 | The same as Ex. 15 | | The same as Example 15 | | |
| 17 | The same as Ex. 15 | | The same as Example 15 | | |
| Comparative Example: | | | | | |
| 12 | — | — | — | — | — |
| Example: | | | | | |
| 18 | The same as Ex. 17 | | The same as Example 17 | | |

| | Carrier true specific gravity | Magnetic material $\sigma s$ (emu/g) | Carrier particle diameter ($\mu$m) | Carrier specific resistance ($\Omega \cdot$ cm) | Magnetic material | Core preparation | Coating weight (charge weight) (%) |
|---|---|---|---|---|---|---|---|
| Example: | | | | | | | |
| 13 | 2.4 | 139 | 45 | $3 \times 10^{11}$ | Reduced iron | St-Ac polymerization | 0.8 |
| Comparative Example: | | | | | | | |
| 9 | 2.4 | 139 | 44 | $5 \times 10^{7}$ | Reduced iron | St-Ac polymerization | — |
| 10 | 7.8 | 139 | 45 | $6 \times 10^{9}$ | Reduced iron | — | 0.8 |
| 11 | 2.4 | 139 | 44 | $2 \times 10^{9}$ | Reduced iron | St-Ac polymerization | 0.8 |
| Example: | | | | | | | |
| 14 | 1.8 | 139 | 48 | $5 \times 10^{11}$ | Reduced iron | St-Ac pulverization | 0.8 |
| 15 | 1.9 | 83 | 53 | $9 \times 10^{11}$ | Magnetite | Polyester pulverization | 1.2 |
| 16 | 1.4 | 83 | 49 | $6 \times 10^{14}$ | Magnetite | Polyester pulverization | 1.2 |
| 17 | 3.1 | 83 | 38 | $4 \times 10^{10}$ | Magnetite | Phenol polymerization | 1.1 |
| Comparative Example: | | | | | | | |
| 12 | 3.1 | 83 | 38 | $1 \times 10^{6}$ | Magnetite | Phenol polymerization | — |
| Example | | | | | | | |
| 18 | 3.1 | 83 | 38 | $4 \times 10^{10}$ | Magnetite | Phenol polymerization | 1.1 |

St-2EHMA: Styrene/2-ethylhexyl methacrylate copolymer
VdF-TFE: Vinylidene fluoride/tetrafluoroethylene copolymer
St-PheA: Styrene/phenyl acrylate copolymer

TABLE 6

| | Carrier surface SEM observation | SEM observation after PE bottle shaking test | Image reproduction test after L/L unloaded drive | |
|---|---|---|---|---|
| | | | Solid image | Halftone image |
| Example: | | | | |
| 13 | AA | AA | AA | AA |
| Comparative Example: | | | | |
| 9 | — | C*1 | A | C |
| 10 | A | C*3 | B | C*2 |
| 11 | C*4 | C*5 | C*6 | C |
| Example: | | | | |
| 14 | AA | AA | A | A |
| 15 | AA | AA | A | AA |
| 16 | AA | A | B | B |
| 17 | AA | AA | AA | AA |
| Comparative Example: | | | | |
| 12 | — | C*1 | C*7 | C*8 |
| Example: | | | | |
| 18 | AA | AA | AA | AA |

AA: Excellent, A: Good, B: Passable, C: Failure
*1Falling-off of magnetic material occurred.
*2Coarse images.
*3External additive of toner buried.
*4Uneven coating.
*5Separation of coating material and falling-off of magnetic material occurred.
*6Uneven images.
*7Adhesion of carrier occurred with irregular images.
*8Irregular images.

EXAMPLE 19

| | |
|---|---|
| Styrene | 25.0% |
| 2-Ethylhexyl acrylate | 8.3% |
| Reduced iron (particle diameter: 0.34 μm) | 66.7% |

The above materials were heated in a container to a temperature of 70° C., and dissolved to give a monomer mixture. Then, while the monomer mixture was maintained at 70° C., an initiator azobisisonitrile was added thereto and dissolved. A monomer composition was thus prepared. This was introduced in a 2 liter flask holding 1.2 liter of an aqueous 1% polyvinyl alcohol (PVA) solution, followed by stirring at 70° C. for 10 minutes at 4,500 rpm using a homogenizer to granulate the monomer composition. Thereafter, with stirring using a paddle stirrer, polymerization was carried out at 70° C. for 10 hours. After the polymerization was completed, the reaction product was cooled, and the resulting magnetic material dispersed styrene acrylic slurry was washed and filtered. The resulting product was dried to give a carrier core material.

The surface of the carrier core material thus obtained was coated with the following coating resin material.

Styrene/2-hydroxyethyl methacrylate/methyl methacrylate copolymer (monomer composition weight ratio: 37:10:53; hydroxyl value (KOHmg/g): 28; weight average molecular weight (Mw): 48,000; weight average molecular weight/number average molecular weight (Mw/Mn): 3.4)

To 100 parts of an acetone-methyl ethyl ketone mixed solvent (mix weight ratio: 1:1) solution of 20% of the above styrene copolymer, 1 part of quaternary ammonium salt shown as Exemplary Compound 1 was added in the state of particles, followed by stirring using a stirrer until they became thoroughly mixed. A carrier coating solution was thus prepared.

Next, with this carrier coating solution, the above carrier core material was coated using a coater (trade name: Spiracoater; manufactured by Okada Seiko k.K.). The resulting carrier core material having been thus coated was dried at a temperature of 90° C. for 1 hour to remove the solvent. A carrier for electrophotography comprising the carrier core material coated on its surface with the coating resin material was thus obtained. The resulting carrier for electrophotography was observed using an electron microscope to confirm that the carrier core material was uniformely coated with the resin. Physical properties of the carrier are shown in Table 7.

| | |
|---|---|
| Polyester resin obtained by condensation of propoxydated bisphenol with fumaric acid | 100 parts |
| Phthalocyanine pigment | 5 parts |
| Chromium complex salt of di-tert-butylsalicylate | 4 parts |

The above materials were thoroughly premixed using a Henschel mixer, and the mixture was thereafter melt-kneaded three times using a three-roll mill. After cooled, the kneaded product was crushed using a hammer mill to have a particle diameter of about 1 to 2 mm. Subsequently, the crushed product was finely pulverized using a fine grinding mill of an air-jet system. The finely pulverized product obtained was then classified to give a cyan color powder (a toner) with a negative chargeability, having a weight average particle diameter of 8.8 μm.

Next, 100 parts of the cyan color powder and 0.5 part of a fine silica powder having been made hydrophobic by treatment with hexamethyldisilazane were mixed to give a cyan toner having fine silica powder on the toner particle surfaces.

This cyan toner and the above carrier for electrophotography were left to stand for 4 days in each environment of temperature/humidity of L/L (temperature 15° C./humidity 10% RH), N/N (temperature 23° C./humidity 60% RH) and H/H (temperature 30° C./humidity 90% RH). Thereafter, these were blended at a toner concentration of 5%, and the quantity of triboelectricity was measured by the method shown in FIG. 3. Results obtained are shown in Table 10. As is seen therefrom, the electrostatic charges less change against environmental variations.

Next, the carrier for electrophotography and the cyan toner were blended in the N/N environment at a toner concentration of 5% to produce a two-component type developer. Using a full-color laser copier CLC-500, manufactured by Canon Inc., whose developing contrast was fixed at 350 V, image reproduction tests were carried out in the respective environments described above. Results obtained are shown in Table 10. As is seen therefrom, the developer has a superior running performance and causes less changes against environmental variations.

Next, the cyan toner and the carrier for electrophotography were blended in an environment of temperature/humidity of N/N (23° C./60% RH) in a toner concentration of 5% to give a two-component type developer. Then, 100 g of the two-component type developer thus obtained was put in a 250 cc polyethylene bottle, followed by shaking for 1 hour using a tumbling mixer. Thereafter, this two-component type developer was taken out and the developer was observed using an electron microscope. As a result, neither falling-off of magnetic materials from carrier particles, separation of the coating material nor filming due to the toner was seen. Neither falling-off nor burying of external additives of the toner was also seen.

The cyan toner and the above carrier for electrophotography were blended in an environment of temperature/humidity of L/L (15° C./10% RH) at a toner concentration of 8% to give a two-component type developer. In the same environment, this developer was put in a developing assembly used for a full-color laser copier CLC-500, manufactured by Canon Inc., and unloaded drive was continued for 30 minutes by external motor driving (peripheral speed: 300 rpm). Thereafter, using the CLC-500, images were reproduced under development contrast of 350 V. As a result, density of solid images also was sufficiently high and reproduction at halftone areas was good.

COMPARATIVE EXAMPLE 13

The same carrier as in Example 19 except that the carrier core material was not coated with the resin was used as a carrier for electrophotography to make the same measurement and tests as in Example 19. Physical properties of the carrier are shown in Table 7, and results of evaluation, in Tables 9 and 10.

As a result of the shaking test, observation using an electron microscope revealed the falling-off of magnetic material from carrier.

COMPARATIVE EXAMPLE 14

Using reduced iron particles of 45 μm in place of the carrier core material used in Example 19, the particles were coated in the same manner as in Example 19, with the same coating resin material as used in Example 19. A carrier for electrophotography was thus obtained, and the same measurement and tests as in Example 19 were made. Physical properties of the carrier are shown in Table 7, and results of evaluation, in Tables 9 and 10.

As a result of the shaking test, the carrier for electrophotography had no difference from the one before shaking, but the burying of external additives on toner surfaces was a little seen. As a result of the image reproduction test, coarse images were seen particularly at halftone ares.

COMPARATIVE EXAMPLE 15

Styrene/methyl methacrylate copolymer (monomer composition weight ratio: 60:40; weight average molecular weight (Mw): 133,000; weight average molecular weight/number average molecular weight (Mw/Mn): 29)

Using 100 parts of an acetone-methyl ethyl ketone mixed solvent (mix weight ratio: 1:1) solution of 20% of the above resin material, the same carrier core material as used in Example 19 was coated therewith in the same manner as in Example Example 19, to give a carrier for electrophotography comprising the carrier core material coated on its surface with the coating resin material. Physical properties of the carrier are shown in Table 7. Using this carrier for electrophotography, the same measurement and test s in Example 19 were made. Results of evaluation are shown in Tables 9 and 10. As is seen from the results of evaluation, the carrier comprised of a carrier core material coated with the coating resin material not containing the quaternary ammonium salt according to the present invention undergo great variations in electrostatic charges because of environmental variations.

EXAMPLE 20

Using the same formulation as used in Example 19, the materials were heated in a container to a temperature of 70° C., and dissolved to give a monomer mixture. Then, while the monomer mixture was maintained at 70° C., an initiator azobisisonitrile was added thereto and dissolved. A monomer composition was thus prepared. This was introduced in a 2 liter flask holding 1.2 liter of an aqueous 1% polyvinyl alcohol (PVA) solution, followed by stirring at 70° C. for 10 minutes at 2,500 rpm using a homogenizer to granulate the monomer composition. Thereafter, with stirring using a paddle stirrer, polymerization was carried out at 70° C. for 10 hours. After the polymerization was completed, the reaction product was cooled, and the resulting magnetic material dispersed styrene acrylic slurry was washed and filtered. The resulting product was dried to give a carrier core material. The carrier core material obtained had a particle diameter of 72 μm. The surface of this carrier core material was coated in the same manner as in Example 19 to give a carrier. Physical properties of the carrier are shown in Table 7. Using the carrier thus obtained, the same measurement and test as in Example 19 were made. Results of evaluation are shown in Tables 9 and 10.

As a result of image reproduction test after unloaded drive in the low-humidity environment, coarse images were slightly seen particularly at halftone areas, but were not particularly problematic in practical use.

EXAMPLE 21

| | |
|---|---|
| Styrene/2-ethylhexyl acrylate/butyl acrylate copolymer (monomer compositional ratio: 40:40:20) | 50% |
| Reduced iron (particle diameter: 0.36 μm) | 50% |

The above materials were thoroughly premixed using a Henschel mixer, and the mixture was thereafter melt-kneaded at least twice using a three-roll mill. After cooled, the kneaded product was crushed using a hammer mill to have a particle diameter of about 2 mm. Subsequently, the crushed product was finely pulverized using a fine grinding mill of an air-jet system to have a particle diameter of about 49 μm. The finely pulverized product was introduced in Mechanomill MM-10 (trade name; manufactured by Okada Seiko KK) to mechanically make the particles spherical. The finely pulverized particles made spherical were then classified to give a carrier core material. The carrier core material obtained had a particle diameter of 48 μm.

The surface of the carrier core material thus obtained was coated with a coating resin material in the same manner as in Example 19 to give a carrier for electrophotography. Physical properties of the carrier are shown in Table 7. Using the carrier for electrophotography, thus obtained, the same measurement and test as in Example 19 were made. Results of evaluation are shown in Tables 9 and 10.

As a result, similar to Example 19, the electrostatic charges less changed under environmental variations, and good results were obtained also in the shaking test and image reproduction test.

EXAMPLE 22

The same carrier for electrophotography as used in Example 21 and a toner (containing 100 parts of a mixture of styrene copolymer and paraffin as a binder resin, 9 parts of carbon black as a colorant and 3 parts of negatively chargeable metal complex as a charge control agent) for a copier NP-5000, manufactured by Canon Inc., were blended at a toner concentration of 4% in each environment of temperature/humidity of L/L (15° C./10% RH), N/N (23° C./60% RH) and H/H (30° C./90% RH), and the quantity of triboelectricity was measured by the method shown in FIG. 3. As a result, the electrostatic charges were almost constant without environment dependence. Using the two-component type developer prepared in the N/N environment, an image reproduction test was carried out in each environment, on a modified machine ($\theta_1$: 16°; d: 800 μm; e: 500 μm; AC electric field: 2,000 Hz, −2000 Vpp; DC electric field: 550 V) of a copier NP-5000, manufactured by Canon Inc. Results obtained are shown in Table 10, from which the developer is seen to have a superior running performance and causes less changes against environmental variations. During the above image reproduction test, the adhesion of carrier onto the electrostatic image bearing member or paper hardly occurred. A polyethylene bottle shaking test using a tumbling mixer was also made in the same manner as in Example 19. Results obtained are shown in Table 9.

EXAMPLE 23

| | |
|---|---|
| Polyester resin obtained by condensation of ethoxydated bisphenol, fumaric acid and trimellitic acid (50:40:10) | 40% |
| Magnetite (particle diameter: 0.26 μm) | 60% |

Using the above materials, a carrier core material made spherical was obtained in the same manner as in Example 21. This carrier core material had a particle diameter of 53 μm.

The surface of the carrier core material thus obtained was coated with the following coating resin material.

Styrene/methyl methacrylate/2-ethylhexyl acrylate copolymer (monomer composition weight ratio: 45:35:20; weight average molecular weight (Mw): 41,000; weight average molecular weight/number average molecular weight (Mw/Mn): 2.5)

To 100 parts of a 10% methyl ethyl ketone solution of the above styrene copolymer, 0.5 part of quaternary ammonium salt shown as Exemplary Compound 12 was added in the state of particles, followed by stirring using a stirrer until they became thoroughly mixed. A carrier coating solution was thus prepared.

Next, with this carrier coating solution, the above carrier core material was coated using a coater (trade name: Spiracoater; manufactured by Okada Seiko k.K.). The resulting carrier core material having been thus coated was heated at 60° C. for 3 hours. A carrier for electrophotography comprising the carrier core material coated on its surface with the coating resin material was thus obtained.

Physical properties of the carrier obtained are shown in Table 7. The same measurement and test as in Example 19 were carried out to obtain the same good results as in Example 19. Results of observation are shown in Tables 9 and 10.

EXAMPLE 24

A carrier core material was prepared in the same manner as in Example 23 except that the amount of magnetite used therein was changed to 38% (the balance was polyester resin). This core material was coated with the coating resin material as used in Example 23 in the same manner as in Example 23. A carrier for electrophotography was thus obtained. Physical properties of the carrier are shown in Table 7. The same measurement and test as in Example 19 were made. The same good results as in Example 23 were obtained in the shaking test, but the adhesion of carrier onto the electrostatic image bearing member was slightly seen. In the image reproduction test made in the low-humidity environment, the density of solid images became slightly lower than that in Example 23. These, however, were not particularly problematic in practical use. Results of evaluation are shown in Tables 9 and 10.

EXAMPLE 25

| | |
|---|---|
| Phenol | 13.5% |
| Formaldehyde (formaldehyde: about 37%; methanol: about 10%; balance: water) | 6.0% |
| Magnetite (particle diameter: 0.25 μm) | 80.5% |

The above materials were stirred in an aqueous phase, using ammonia as a basic catalyst and calcium fluoride as a polymerization stabilizer, during which the temperature was gradually raised to 80° C. and polymerization was carried out for 2 hours. The carrier core material thus obtained had a particle diameter of 41 μm. Using a methyl ethyl ketone solution in which the coating resin as used in Example 23 had been dissolved in a concentration of 10%, the carrier core material obtained was coated in the same manner as in Example 23. Physical properties of the resulting carrier for electrophotography are shown in Table 7. Using this carrier for electrophotography, thus obtained, the same measurement and test as in Example 19 were carried out to obtain the same good results as in Example 19.

COMPARATIVE EXAMPLE 16

The same carrier as prepared in Example 25 except that the carrier core material was not coated with the coating resin material was used as a carrier for electrophotography. Physical properties of this carrier for electrophotography are shown in Table 7. The same test as in Example 19 was made. As a result, in the shaking test, the falling-off of magnetic material from carrier was seen. In the image reproduction test, image irregularity occurred which was presumably due to a lowering of applied bias voltage. Results of evaluation are shown in Tables 9 and 10.

EXAMPLE 26

| | |
|---|---|
| Styrene/2-ethylhexyl acrylate/dimethylaminoethyl methacrylate copolymer (monomer composition weight ratio: 80/15/5) | 100 parts |
| Copper phthalocyanine | 4 parts |
| Low-molecular weight polypropylene | 5 parts |

Using the above materials, blue color particles with a weight average particle diameter of 11.7 μm were obtained in the same manner as in Example 19. In 100 parts of this cyan particles, 0.8 part of positively chargeable colloidal silica having been treated with amino-modified silicone oil was mixed using a Henschel mixer to give a positively chargeable cyan toner.

This toner and the carrier as used in Example 25 were blended at a toner concentration of 8%, and the quantity of triboelectricity was measured in each environment in the same manner as in Example 19. Results obtained are shown in Table 10. As is seen therefrom, there are less changes due to environmental variations.

Next, the above toner and the carrier for electrophotography as used in Example 25 were blended in the N/N environment at a toner concentration of 8% to produce a two-component type developer. Using a copier NP-4835, manufactured by Canon Inc., copy running tests was made. As a result, as shown in Table 10, good images with a stable image density were obtained without environment dependence also in the image reproduction test.

Next, the above toner and the carrier for electrophotography as used in Example 25 were blended in an environment of temperature/humidity of N/N (23° C./60% RH) at a toner concentration of 5% to give a two-component type developer. Then, 100 g of the two-component type developer thus obtained was put in a 250 cc polyethylene bottle, followed by shaking for 1 hour using a tumbling mixer. Thereafter, this two-component type developer was taken out and the two-component type developer was observed using an electron microscope. As a result, neither falling-off of magnetic materials from carrier particles, separation of the coating material nor filming due to the toner was seen. Neither falling-off nor burying of external additives of the toner was also seen.

Next, the above toner and the carrier for electrophotography as used in Example 25 were blended in an environment of temperature/humidity of L/L (15° C./10% RH) at a toner concentration of 8% to give a two-component type developer. In the same environment, this developer was put in a developing assembly used for a copier NP-4835, manufactured by Canon Inc., and unloaded drive was continued for 30 minutes by external motor driving. Thereafter, using the NP-4835, images were reproduced. As a result, density of solid images also was sufficiently high and reproduction at halftone areas was good. Results of evaluation are shown in Tables 9 and 10.

COMPARATIVE EXAMPLE 17

Styrene/methyl methacrylate copolymer (monomer composition weight ratio: 60:40; weight average molecular weight (Mw): 133,000; weight average molecular weight/number average molecular weight (Mw/Mn): 29)

To 100 parts of a methyl ethyl ketone solution of 20% of the above styrene copolymer, 1 part of quaternary ammonium salt represented by the following formula was added in the state of particles, and a carrier coating solution was prepared in the same manner as in Example 19. In the step of mixing with stirring, the quaternary ammonium salt was not so well uniformly dissolved as in Example 19 and showed a poor compatibility with the resin.

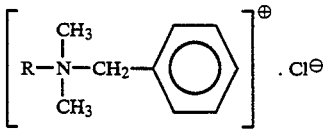

(R represents a $C_{12}$–$C_{18}$ alkyl group.)

(Solubility to water: 1.0 g/100 g ($H_2O$, 20° C.) or more).

With this carrier coating solution, the carrier core material as used in Example 19 was coated in the same manner as in Example 19. A carrier for electrophotography comprising the carrier core material coated on its surface with a coating resin material was thus obtained. Using this carrier for electrophotography, the same copy running test as in Example 19 was made. As a result, as shown in Table 10, the addition of this quaternary ammonium salt in the H/H (temperature 30° C./humidity 90% RH) environment is less effective for environmental stability.

COMPARATIVE EXAMPLE 18

The quaternary ammonium salt as used in Comparative Example 17 was dissolved in distilled water to give a 0.5% solution. In this solution, ferrite particles with an average particle diameter of 45 μm serving as a carrier core material was immersed, stirred for 20 minutes and then filtered, followed by drying at 105° C. for 2 hours to give a carrier for electrophotography. Physical properties of the carrier are shown in Table 8. Using the carrier for electrophotography thus obtained and using the same toner as in Example 19, the same evaluation as in Example 19 was made. As a result, as shown in Table 10, not so different quantity of triboelectricity was obtained in each environment but, with progress of the copy running test, the image density became greatly different because of environment variations. After the shaking test using a tumbling mixer, the carrier surface was observed with an electron microscope to reveal that the filming of toner was seen, as shown in Table 9.

EXAMPLE 27

| | |
|---|---|
| Styrene/2-hydroxyethyl methacrylate/methyl methacrylate copolymer (monomer composition weight ratio: 35:8:57; hydroxyl value (KOH mg/g): 30; weight average molecular weight (Mw): 52,000; weight average molecular weight/number average molecular weight (Mw/Mn): 2.5) | 5 parts |
| Vinylidene fluoride/tetrafluoroethylene copolymer (monomer composition weight ratio: 75:25; weight average molecular weight (Mw): 210,000) | 5 parts |

The above resin materials (10 parts in total) were dissolved in 90 parts of an acetone-methyl ethyl ketone mixed solvent (mix weight ratio: 1:1) to give a solution in a concentration of 10%. To 100 parts of this solution, 0.5 part of quaternary ammonium salt shown as Exemplary Compound 12 was added in the state of particles, followed by stirring using a stirrer until they became thoroughly mixed. A carrier coating solution was thus prepared.

With this carrier coating solution, the carrier core material as used in Example 25 was coated using a coater (trade name: Spiracoater; manufactured by Okada Seiko k.K.) in the same manner as in Example 25. The resulting carrier core material having been thus coated was dried at a temperature of 40° C. for 1 hour to remove the solvent, followed by heating at 110° C. for 1 hour. A carrier for electrophotography comprising the carrier core material coated on its surface with the coating resin material was thus obtained. This carrier was observed using an electron microscope to confirm that the carrier core material was uniformely coated with the coating resin. Physical properties of the carrier are shown in Table 8.

| | |
|---|---|
| Styrene/2-ethylhexyl acrylate/dimethylaminoethyl methacrylate copolymer (monomer composition weight ratio: 80:15:5) | 100 parts |
| Copper phthalocyanine | 4 parts |
| Low-molecular weight polypropylene | 6 parts |

The above materials were mixed, melt-kneaded, pulverlized and classified to produce cyan fine resin particles with a weight average particle diameter of 11 μm. Then, 100 parts of the cyan fine resin particles and 0.8% of positively chargeable hydrophobic colloidal silica having been treated with amino-modified silicone oil were mixed using a Henschel mixer to give a cyan toner.

The above carrier for electrophotography and the above toner were blended at a toner concentration of 8% in each environment of temperature/humidity of L/L (15° C./10% RH), N/N (23° C./60% RH) and H/H (30° C./90% RH), and the quantity of triboelectricity was measured by the method shown in FIG. 3. Results obtained are shown in Table 10. As a result, as shown therein, influence of environmental variations was found to be very small. Using a two-component type developer prepared in the N/N environment, an image reproduction running test was carried out in each environment, on a blue-color-developing device NP-4835, manufactured by Canon Inc.

As a result, as shown in Table 10, the initial reflection image density was sufficiently high without regard to environmental variations, and the reflection image density was sufficiently high also after running on 10,000 sheets, where good images free from fogging and blue spots around line images were obtained. From the two-component type developer having been used for 10,000 sheet running, the carrier was recovered, and observed using an electron microscope to confirm that, as shown in Table 9, no deterioration was seen, such as conspicuous carrier-spent owing to the toner or separation of the resin coat layer of the coated particles.

During the continuous image reproduction tests, the adhesion of carrier onto the electrostatic image bearing member or paper hardly occurred.

EXAMPLE 28

Styrene/2-hydroxyethyl methacrylate/butyl methacrylate copolymer (monomer composition weight ratio: 40:10:50; weight average molecular weight (Mw): 45,000; weight average molecular weight/number average molecular weight (Mw/Mn): 2.8)

100 parts of a methyl ethyl ketone solution of 20% of the above resin material and 20 parts of an ethanol solution of 1.0% of an quaternary ammonium salt (solubility: 1.0 g/100 g (ethanol) or more), in which the quaternary ammonium salt shown as Exemplary Compound 8 had been dissolved, were stirred using a stirrer until they became thoroughly mixed. A carrier coating solution was thus prepared.

With this carrier coating solution, the same carrier core material as used in Example 25 was coated using a coater (trade name: Spiracoater; manufactured by Okada Seiko k.K.) in the same manner as in Example 25. The resulting carrier core material having been thus coated was dried at a temperature of 60° C. for 3 hours to remove the solvent. A carrier for electrophotography comprising the carrier core material coated on its surface with the coating resin material was thus obtained. Physical properties of the carrier are shown in Table 8.

This carrier for electrophotography and a toner (binder resin: 100 parts of a mixture of styrene copolymer and paraffin; colorant; 9 parts of carbon black; charge control agent: 3 parts of negatively chargeable metal complex) for a copier NP-5000, manufactured by Canon Inc., were blended at a toner concentration of 2% in each environment of temperature/humidity of L/L (15° C./10% RH), N/N (23° C./60% RH) and H/H (30° C./90% RH), and the quantity of triboelectricity was measured by the method shown in FIG. 3. Results obtained are shown in Table 9.

Using the two-component type developer prepared in the N/N environment, an image reproduction test was carried out in each environment, on a modified machine ($\theta_1$: 16°; d: 800 μm; e: 500 μm; AC electric field: 2,000 Hz, −2000 Vpp; DC electric field: 550 V) of a copier NP-5000, manufactured by Canon Inc.

As a result, good images were obtained, having a reflection image density sufficiently as high as 1.31 in H/H, 1.33 in N/N and 1.34 in L/L at the initial stage, and also as high as 1.29 in H/H, 1.32 in N/N and 1.31 in L/L after 10,000 sheet running, with less influence by environment variations. Results of evaluation are shown in Table 10.

From the two-component type developer having been used for 10,000 sheet running, the carrier was recovered, and observed using an electron microscope to confirm that no deterioration was seen, such as conspicuous carrier-spent owing to the toner or separation of the resin coat layer.

During a series of the image reproduction tests, the adhesion of carrier onto the electrostatic image bearing member or paper hardly occurred.

COMPARATIVE EXAMPLE 19

With the carrier coating solution as prepared in Comparative Example 18, the same carrier core material as used in Example 25 was coated using a coater (trade name: Spiracoater; manufactured by Okada Seiko k.K.). The resulting carrier core material having been thus coated was heated at 60° C. for 3 hours to remove the solvent. A carrier for electrophotography comprising the carrier core material coated on its surface with the coating resin material was thus obtained.

Using this carrier for electrophotography, the same measurement and test as in Example 28 were made. As a result, as shown in Table 10, the improvement in environmental stability is not due to the addition of Nigrosine N-07 (see Table 8) as a charge control agent. Image reproduction tests were also carried out to reveal that reflection image density was 1.03 in H/H, 1.25 in N/N and 1.42 in L/L at the initial stage, and 0.72 in H/H, 0.94 in N/N and 1.13 in L/L after 10,000 sheet running, showing that the reflection image density greatly decreased compared with that of the initial stage. Moreover, black fog was seen on images after running. The image deterioration was found to have been caused by the Nigrosine N-07 which fell off from the carrier surface, and developed or scattered. A polyethylene bottle shaking test using a tumbling mixer was also made. Results obtained are shown in Table 9.

TABLE 7

| | Coat material | Hydroxyl value (KOH mg/g) | Acryl component monomer ratio (%) | Weight average molecular weight (Mw) | Mw/Mn |
|---|---|---|---|---|---|
| Example: | | | | | |
| 19 | St-2HEMA-MMA | 28 | 63 | 48,000 | 3.4 |
| Comparative Example: | | | | | |
| 13 | — | — | — | — | — |
| 14 | The same as Ex. 19 | | The same as Example 19 | | |
| 15 | The same as Ex. 19 | 0 | 40 | 133,000 | 29 |
| Example: | | | | | |
| 20 | The same as Ex. 19 | | The same as Example 19 | | |
| 21 | The same as Ex. 19 | | The same as Example 19 | | |
| 22 | The same as Ex. 19 | | The same as Example 19 | | |
| 23 | St-MMA-2EHA | 0 | 55 | 41,000 | 2.5 |
| 24 | The same as Ex. 23 | | The same as Example 23 | | |
| 25 | The seme as Ex. 23 | | The same as Example 23 | | |
| Comparative Example: | | | | | |
| 16 | — | — | — | — | — |

| | Carrier true specific gravity | Magnetic material σs (emu/g) | Carrier particle diameter (μm) | Carrier specific resistance (Ω · cm) | Magnetic material | Core preparation | Quaternary ammonium salt (%) |
|---|---|---|---|---|---|---|---|
| Example: | | | | | | | |
| 19 | 2.4 | 139 | 45 | $2.5 \times 10^{12}$ | Iron powder | Polymerization | 1* |
| Comparative Example: | | | | | | | |
| 13 | 2.4 | 139 | 44 | $5.7 \times 10^{7}$ | Iron powder | Polymerization | None |
| 14 | 7.8 | 139 | 45 | $7.4 \times 10^{11}$ | Iron powder | Iron powder particles | 1* |
| 15 | 2.4 | 139 | 47 | $4.1 \times 10^{14}$ | Iron powder | Polymerization | None |
| Example: | | | | | | | |
| 20 | 2.4 | 139 | 72 | $9.8 \times 10^{11}$ | Iron powder | Polymerization | 1* |
| 21 | 1.8 | 139 | 50 | $3.6 \times 10^{13}$ | Iron powder | Pulverization | 1* |
| 22 | 1.8 | 139 | 50 | $3.6 \times 10^{18}$ | Iron powder | Pulverization | 1* |
| 23 | 1.9 | 83 | 54 | $4.8 \times 10^{13}$ | Magnetite | Pulverization | 12* |
| 24 | 1.4 | 83 | 52 | $8.6 \times 10^{14}$ | Magnetite | Pulverization | 12* |
| 25 | 3.6 | 83 | 42 | $4.9 \times 10^{13}$ | Magnetite | Polymerization | 12* |
| Comparative Example: | | | | | | | |
| 16 | 3.6 | 83 | 40 | $4.8 \times 10^{7}$ | Magnetite | Polymerization | None |

St-2HEMA-MMA: Styrene/2-hydroxyethyl methacrylate/methyl methacrylate copolymer
St-MMA-2EHA: Styrene/methyl methacrylate/2-ethylhexyl methacrylate copolymer
*Exemplary Compound number

TABLE 8

| | Coat material (%) | Hydroxyl value (KOH mg/g) | Acryl component monomer ratio (%) | Weight average molecular weight (Mw) | Mw/Mn |
|---|---|---|---|---|---|
| Example: | | | | | |
| 26 | The same as Ex. 19 | | The same as Example 19 | | |
| Comparative Example: | | | | | |
| 17 | St-MMA | 0 | 40 | 133,000 | 29 |
| 18 | — | — | — | — | — |
| Example: | | | | | |

TABLE 8-continued

| | | | | | |
|---|---|---|---|---|---|
| 27 | St-2HEMA-MMA/ VdF-TFE | 30 | 65 | 52,000 | 2.5 |
| 28 | St-2EHMA-BMA | 0 | 60 | 45,000 | 2.8 |
| Comparative Example: | | | | | |
| 19 | The same as Comparative Ex. 18 | | The same as Comparative Example 18 | | |

| | Carrier true specific gravity | Magnetic material σs (emu/g) | Carrier particle diameter (μm) | Carrier specific resistance (Ω · cm) | Magnetic material | Core preparation | Quaternary ammonium salt (%) |
|---|---|---|---|---|---|---|---|
| Example: | | | | | | | |
| 26 | 3.6 | 83 | 42 | $4.9 \times 10^{13}$ | Magnetite | Polymerization | 12* |
| Comparative Example: | | | | | | | |
| 17 | 2.4 | 139 | 46 | $7.7 \times 10^{11}$ | Iron powder | Polymerization | (1) |
| 18 | 5.1 | 62 | 45 | $4.3 \times 10^{9}$ | Ferrite | Ferrite particles | (2) |
| Example: | | | | | | | |
| 27 | 3.6 | 83 | 41 | $6.5 \times 10^{12}$ | Magnetite | Polymerization | 12* |
| 28 | 3.6 | 83 | 42 | $3.1 \times 10^{12}$ | Magnetite | Polymerization | 12* |
| Comparative Example: | | | | | | | |
| 19 | 3.6 | 83 | 42 | $7.7 \times 10^{12}$ | Magnetite | Polymerization | (*3) |

St-MMA: Styrene/methyl methacrylate copolymer
St-2HEMA-MMA: Styrene/2-hydroxyethyl methacrylate/methyl methacrylate copolymer
VdF-TFE: Vinylidene fluoride/tetrafluoroethylene copolymer
St-2EHMA-BMA: Styrene/2-ethylhexyl methacrylate/butyl methacrylate copolymer
*Exemplary Compound number
(1) Anion $Cl^{\ominus}$ type one was added.
(2) The same as Comparative Example 17.
(3) Nigrosine N-07 was added.

TABLE 9

| | Coated carrier surface SEM observation | SEM observation after PE bottle shaking test | Image reproduction test: Solid image | Image reproduction test: Halftone image |
|---|---|---|---|---|
| Example: | | | | |
| 13 | AA*1 | AA | AA | AA |
| Comparative Example: | | | | |
| 13 | — | C*2 | C*3 | C*3 |
| 14 | B*4 | A*5 | B | B |
| 15 | B*4 | B*6 | C | B |
| Example: | | | | |
| 20 | AA*1 | AA | A | A |
| 21 | AA*1 | AA | AA | AA |
| 22 | AA*1 | AA | — | — |
| 23 | AA*1 | AA | AA | AA |
| 24 | AA*1 | AA | A | A |
| 25 | AA*1 | AA | AA | AA |
| Comparative Example: | | | | |
| 16 | — | C*2 | C | C |
| Example: | | | | |

TABLE 9-continued

| | Coated carrier surface SEM observation | SEM observation after PE bottle shaking test | Image reproduction test: Solid image | Image reproduction test: Halftone image |
|---|---|---|---|---|
| 26 | — | AA | AA | AA |
| Comparative Example: | | | | |
| 17 | B*4 | B*6 | A | A |
| 18 | — | B*6 | C | C |
| Example: | | | | |
| 27 | AA*1 | AA | AA | AA |
| 28 | AA*1 | AA | — | — |
| Comparative Example: | | | | |
| 19 | B*4 | B*6 | — | — |

AA: Excellent, A: Good, B: Passable, C: Failure
*1Uniform coating.
*2Falling-off of magnetic material from carrier occurred.
*3Bias voltage leaked.
*4Slightly uneven.
*5Silica on the toner particle surface buried.
*6Toner filming occurred on the carrier surface.

TABLE 10

| | Quantity of triboelectricity of toner (μc/g) | | | Image density (Practial machine): Initial stage | | | Image density (Practial machine): After 10,000 sheet running | | |
|---|---|---|---|---|---|---|---|---|---|
| | L/L | N/N | H/H | L/L | N/N | H/H | L/L | N/N | H/H |
| Example: | | | | | | | | | |
| 19 | −23.5 | −22.4 | −20.2 | 1.55 | 1.58 | 1.59 | 1.54 | 1.56 | 1.54 |
| Comparative Example: | | | | | | | | | |
| 13 | −55.2 | −37.8 | −19.3 | — | — | — | — | — | — |
| 14 | −24.2 | −23.8 | −18.9 | 1.53 | 1.55 | 1.61 | 1.49 | 1.51 | 1.52 |
| 15 | −62.5 | −48.3 | −24.5 | 1.21 | 1.33 | 1.52 | 1.18 | 1.20 | 1.47 |

TABLE 10-continued

| | Quantity of triboelectricity of toner (μc/g) | | | Image density (Practial machine) Initial stage | | | After 10,000 sheet running | | |
|---|---|---|---|---|---|---|---|---|---|
| | L/L | N/N | H/H | L/L | N/N | H/H | L/L | N/N | H/H |
| Example: | | | | | | | | | |
| 20 | −24.1 | −23.8 | −21.6 | 1.52 | 1.55 | 1.58 | 1.38 | 1.50 | 1.48 |
| 21 | −36.3 | −34.7 | −32.1 | 1.40 | 1.43 | 1.44 | 1.39 | 1.41 | 1.42 |
| 22 | −8.8 | −8.3 | −7.4 | 1.30 | 1.32 | 1.37 | 1.31 | 1.30 | 1.35 |
| 23 | −34.2 | −33.5 | −31.4 | 1.42 | 1.41 | 1.46 | 1.42 | 1.40 | 1.38 |
| 24 | −41.0 | −37.3 | −34.9 | 1.37 | 1.39 | 1.40 | 1.31 | 1.36 | 1.38 |
| 25 | −37.8 | −35.7 | −33.4 | 1.38 | 1.40 | 1.43 | 1.36 | 1.40 | 1.40 |
| Comparative Example: | | | | | | | | | |
| 16 | −80.6 | −51.1 | −24.3 | 1.10 | 1.29 | 1.48 | 0.92 | 1.18 | 1.42 |
| Example: | | | | | | | | | |
| 26 | +18.3 | +17.4 | +16.2 | 1.31 | 1.34 | 1.30 | 1.30 | 1.33 | 1.29 |
| Comparative Example: | | | | | | | | | |
| 17 | −22.6 | −19.4 | −15.7 | 1.47 | 1.51 | 1.72 | 1.47 | 1.45 | 1.81 |
| 18 | −34.6 | −33.2 | −31.0 | 1.41 | 1.43 | 1.45 | 1.18 | 1.33 | 1.59 |
| Example: | | | | | | | | | |
| 27 | +21.2 | +19.6 | +18.3 | 1.29 | 1.29 | 1.32 | 1.30 | 1.28 | 1.31 |
| 28 | −8.9 | −8.1 | −7.8 | 1.34 | 1.33 | 1.31 | 1.31 | 1.32 | 1.29 |
| Comparative Example: | | | | | | | | | |
| 19 | −12.3 | −10.5 | −6.3 | 1.42 | 1.25 | 1.03 | 1.13 | 0.94 | 0.72 |

EXAMPLE 29

| | |
|---|---|
| Polyester resin obtained by condensation of propoxydated bisphenol with fumaric acid | 100 parts |
| Phthalocyanine pigment | 5 parts |
| Chromium complex salt of di-tert-butylsalicylate | 4 parts |

The above materials were thoroughly premixed using a Henschel mixer, and the mixture was thereafter melt-kneaded at least twice using a three-roll mill. After cooled, the kneaded product was crushed using a cutter mill. Subsequently, the crushed product was finely pulverized using a fine grinding mill of an air-jet system. The finely pulverized product obtained was then classified using a stationary wall type air classifier to form a classified powder. The classified powder obtained was further classified using a multi-division classifier utilizing the Coanda effect (Elbojet Classifier, manufactured by Nittetsu Kogyo KK.) to strictly classify and remove ultrafine powder and coarse powder simultaneously. Thus a cyan color powder (a toner) with a weight average particle diameter of 7.6 was obtained. This toner had a particle size distribution as shown in Table 11.

Next, 100 parts of the cyan toner and 0.5 part of a fine silica powder having been made hydrophobic by treatment with hexamethyldisilazane were mixed to give a cyan toner having fine silica powder on the toner particle surfaces.

Tests were made in the same manner as in Example 19 except that the toner used therein was replaced with the cyan toner thus obtained. As a result, the same results as in Example 19 were obtained. In particular, much better results than those in Example 19 were obtained in respect of resolution and toner consumption.

| | Particle size distribution of toner | | | | |
|---|---|---|---|---|---|
| | Particles of ≦5 μm, % by number | Particles of ≦16 μm, % by volume | Particles of 8–12.7 μm, % by number | Weight average particle diameter (μm) | ≦5 μm, % by number/ % by volume |
| Example 29: | | | | | |
| | 36 | 0 | 15 | 7.6 | 3.5 |

What is claimed is:

1. A carrier for electrophotography, comprising a carrier comprised of a core material, and a coating comprised of a resin coating material, a surface of said carrier core material being coated with said resin coating material, wherein:

said carrier core material comprises a binder resin and fine magnetic material particles dispersed in said binder resin; and said resin coating material contains at least one member selected from the group consisting of;

(a) a vinyl copolymer having a hydroxyl value in the range of 1 to 100 (KOHmg/g);

(b) a styrene-acrylic copolymer having an acrylic component in a monomer percentage in the range of 30% by weight to 90% by weight, a weight average molecular weight (Mw) in the range of 30,000 to 70,000 and a weight average molecular weight/number average molecular weight (Mw/Mn) in the range of 2 to 10; and (c) an insulating resin and a quaternary ammonium salt represented by the following Formula (I):

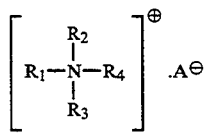

(I)

wherein $R_1$, $R_2$, $R_3$, and $R_4$ may be the same or different, each representing an alkyl group, and aryl group or an aralkyl group; and A represents an organic anion or a polyacid ion.

2. The carrier according to claim 1, wherein said resin coating material contains a vinyl copolymer having a hydroxyl value in the range of 1 to 100 (KOHmg/g).

3. The carrier according to claim 1, wherein said resin coating material contains a vinyl copolymer having a hydroxyl value in the range of 1 to 100 (KOHmg/g), and a fluorine-containing resin.

4. The carrier according to claim 2, wherein said vinyl copolymer comprises a hydroxyl value in the range of 5 to 70 (KOHmg/g).

5. The carrier according to claim 2, wherein said vinyl copolymer comprises a copolymer of a vinyl monomer having a hydroxyl group and one vinyl monomer having one vinyl group per molecule.

6. The carrier according to claim 5, wherein said vinyl monomer having one vinyl group per molecule comprises a methacrylic acid alkyl ester including an alkyl group having 1 to 5 carbon atoms or an acrylic acid alkyl ester including an alkyl group having 1 to 5 carbon atoms.

7. The carrier according to claim 2, wherein said vinyl copolymer has a weight average molecular weight in the range of 10,000 to 70,000.

8. The carrier according to claim 3, wherein said fluorine-containing resin is exposed on the surface of said coating resin material coated on the surface of the carrier core material.

9. The carrier according to claim 3, wherein said fluorine-containing resin comprises a perfluoropolymer, a fluorocopolymer or a fluoroterpolymer.

10. The carrier according to claim 3, wherein said fluorine-containing resin and said vinyl copolymer are mixed in a proportion in the range of 5:95 to 95:5.

11. The carrier according to claim 3, wherein said fluorine-containing resin has a weight average molecular weight in the range of 50,000 to 400,000.

12. The carrier according to claim 1, wherein said resin coating material has a styrene-acrylic copolymer having an acrylic component in a monomer percentage in the range of 30% by weight to 90% by weight, a weight average molecular weight (Mw) in the range of 30,000 to 70,000 and a weight average molecular weight/number average molecular weight (Mw/Mn) in the range of 2 to 10.

13. The carrier according to claim 1, wherein said resin coating resin material has a styrene-acrylic copolymer having an acrylic component in a monomer percentage in the range of 30% by weight to 90% by weight, a weight average molecular weight (Mw) in the range of 30,000 to 70,000 and a weight average molecular weight/number average molecular weight (Mw/Mn) in the range of 2 to 10, and a fluorine-containing resin.

14. The carrier according to claim 1, wherein said styrene-acrylic copolymer has a styrene-acrylate copolymer or a styrene-methacrylate copolymer.

15. The carrier according to claim 12, wherein said styrene-acrylic copolymer has an acrylic component in a monomer percentage in the range of 40% by weight to 90% by weight, a weight average molecular weight (Mw) in the range of 30,000 to 60,000 and a weight average molecular weight/number average molecular weight (Mw/Mn) in the range of 2 to 8.

16. The carrier according to claim 13, wherein said fluorine-containing resin comprises a perfluoropolymer, a fluorocopolymer or a fluoroterpolymer.

17. The carrier according to claim 13, wherein said fluorine-containing resin and said styrene-acrylic copolymer are mixed in a proportion in the range of 5:95 to 95:5.

18. The carrier according to claim 13, wherein said fluorine-containing resin has a weight average molecular weight in the range of 50,000 to 400,000.

19. The carrier according to claim 1, wherein said resin coating material contains an insulating resin and a quaternary ammonium salt represented by the following Formula (I):

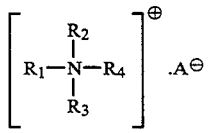

(I)

wherein $R_1$, $R_2$, $R_3$ and $R_4$ may be the same or different, each representing an alkyl group, an aryl group or an aralkyl group; and A represents an organic anion or a polyacid ion.

20. The carrier according to claim 19, wherein said quaternary ammonium salt has a solubility to water, of less than 1.0 g/100 g ($H_2O$, 20° C.).

21. The carrier according to claim 19, wherein said quaternary ammonium salt is contained in an amount in the range of 5% to 30% by weight on the basis of said resin coating material.

22. The carrier according to claim 19, wherein said insulating resin contains a styrene-acrylic copolymer.

23. The carrier according to claim 22, wherein said styrene-acrylic copolymer has a hydroxyl value in the range of 1 to 100 (KOHmg/g).

24. The carrier according to claim 19, wherein said quaternary ammonium salt is a lake compound.

25. The carrier according to claim 19, wherein $R_4$ represents an aryl group or an aralkyl group.

26. The carrier according to claim 19, wherein $R_1$, $R_2$ and $R_3$ each represents an alkyl group or an aryl group, and $R_4$ represents an aryl group or an aralkyl group represented by the formula:

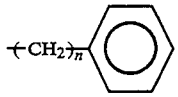

wherein n is an integer of 0, 1, 2 or 3.

27. The carrier according to claim 19, wherein $R_4$ represents an alkyl group.

28. The carrier according to claim 19, wherein $R_1$, $R_2$, $R_3$ and $R_4$ each represents an alkyl group.

29. The carrier according to claim 1, which has a true specific gravity in the range of 1.5 to 5.0.

30. The carrier according to claim 1, which has a particle diameter in the range of 10 μm to 60 μm.

31. The carrier according to claim 1, the carrier having a specific resistance in the range of 10 Ω. cm to $10^{14}$ Ω. cm.

32. The carrier according to claim 1, wherein said magnetic material has a magnetic force of not less than 60 emu/g under application of a magnetic field of 10 kOe.

33. The carrier according to claim 1, wherein said carrier core material is produced by polymerization.

34. The carrier according to claim 1, wherein said fine magnetic material particles are contained in said binder resin in an amount of not less than 30% by weight on the basis of said carrier core material.

35. The carrier according to claim 1, wherein said resin carrier core material is coated with said coating material in a coating weight satisfying the following relationship.

$$\frac{1}{2}X \leqq \text{coating weight of coating resin material} \leqq 50/X \text{ (\% by weight)},$$

wherein X represents a true specific gravity of the carrier.

36. A two-component type developer for developing electrostatic images, comprising a toner and a carrier, said carrier comprising a carrier comprised of a core material, and a coating comprised of a resin coating material, the surface of said carrier core material being coated with said resin coating material, wherein;

said carrier core material comprises a binder resin and fine magnetic material particles dispersed in said binder resin; and said resin coating material contains at least one member selected from the group consisting of:

(a) a vinyl copolymer having a hydroxyl value in the range of 1 to 100 (KOHmg/g);

(b) a styrene-acrylic copolymer having an acrylic component in a monomer percentage in the range of 30% by weight to 90% by weight/number average molecular weight (Mw/Mn) in the range of 30,000 to 70,000 and a weight average molecular weight/number average molecular weight (Mw/Mn) in the range of 2 to 10; and (c) an insulating resin and a quaternary ammonium salt represented by the following Formula (I):

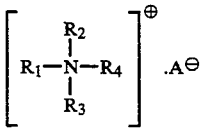

(I)

wherein $R_1$, $R_2$, $R_3$, and $R_4$ may be the same or different, each representing an alkyl group, an aryl group or an aralkyl group; and A represents an organic anion or a polyacid ion.

37. The two-component type developer according to claim 36, wherein said resin coating material contains a vinyl copolymer having a hydroxyl value in the range of 1 to 100 (KOHmg/g).

38. The two-component type developer according to claim 37, wherein said resin coating material contains a vinyl copolymer having a hydroxyl value in the range of 1 to 100 (KOHmg/g), and a fluorine-containing resin.

39. The two-component type developer according to claim 37, wherein said vinyl copolymer comprises a hydroxyl value in the range of 5 to 70 (KOHmg/g).

40. The two-component type developer according to claim 37, wherein said vinyl copolymer comprises a copolymer of a vinyl monomer having a hydroxyl group and a vinyl monomer having one vinyl group.

41. The two-component type developer according to claim 40, wherein said vinyl monomer having one vinyl group comprises an alkyl group including a methacrylic acid alkyl ester having 1 to 5 carbon atoms, or an alkyl group including an acrylic acid alkyl ester having 1 to 5 carbon atoms.

42. The two-component type developer according to claim 37, wherein said vinyl copolymer has a weight average molecular weight in the range of 10,000 to 70,000.

43. The two-component type developer according to claim 38, wherein said fluorine-containing resin is exposed to the surface of said resin coating material coated on the surface of the two-component type developer core material.

44. The two-component type developer according to claim 38, wherein said fluorine-containing resin comprises a perfluoropolymer a fluorocopolymer or a fluoroterpolymer.

45. The two-component type developer according to claim 38, wherein said fluorine-containing resin and said vinyl copolymer are mixed in a proportion in the range of 5:95 to 95:5.

46. The two-component type developer according to claim 38, wherein said fluorine-containing resin has a weight average molecular weight in the range of 50,000 to 400,000.

47. The two-component type developer according to claim 36, wherein said resin coating material has a styrene-acrylic copolymer having an acrylic component in a monomer percentage in the range of 30% by weight to 90% by weight, a weight average molecular weight (Mw) in the range of 30,000 to 70,000 and a weight average molecular weight/number average molecular weight (Mw/Mn) in the range of 2 to 10.

48. The two-component type developer according to claim 36, wherein said coating resin material has a styrene-acrylic copolymer having an acrylic component in a monomer percentage in the range of 30% by weight to 90% by weight, a weight average molecular weight (Mw) in the range of 30,000 to 70,000 and a weight average molecular weight/number average molecular weight (Mw/Mn) in the range of 2 to 10, and a fluorine-containing resin.

49. The two-component type developer according to claim 47, wherein said styrene-acrylic copolymer comprises a styrene-acrylate copolymer or a styrene-methacrylate copolymer.

50. The two-component type developer according to claim 47, wherein said styrene-acrylic copolymer comprises an acrylic component in a monomer percentage in the range of 40% by weight to 90% by weight, a weight average molecular weight (Mw) in the range of 30,000 to 60,000 and a weight average molecular weight/number average molecular weight (Mw/Mn) of from 2 to 8.

51. The two-component type developer according to claim 48, wherein said fluorine-containing resin comprises a perfluoropolymer a fluorocopolymer or a fluoroterpolymer.

52. The two-component type developer according to claim 48, wherein said fluorine-containing resin and said styrene-acrylic copolymer are mixed in a proportion in the range of 5:95 to 95:5.

53. The two-component type developer according to claim 48, wherein said fluorine-containing resin has a weight average molecular weight in the range of 50,000 to 400,000.

54. The two-component type developer according to claim 36, wherein said coating resin material contains an insulating resin and a quaternary ammonium salt represented by the following Formula (I):

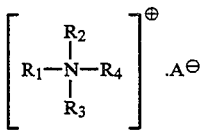

(I)

wherein $R_1$, $R_2$, $R_3$ and $R_4$ may be the same or different, each representing an alkyl group, an aryl group or an aralkyl group; and A represents an organic anion or a polyacid ion.

55. The two-component type developer according to claim 54, wherein said quaternary ammonium salt has a solubility to water, or less than 1.0 g/100 g ($H_2O$, 20° C.).

56. The two-component type developer according to claim 54, wherein said quaternary ammonium salt is contained in an amount in the range of 5% to 30% by weight on the basis of said resin coating material.

57. The two-component type developer according to claim 54, wherein said insulating resin contains a styrene-acrylic copolymer.

58. The two-component type developer according to claim 57, wherein said styrene-acrylic copolymer has a hydroxyl value in the range of 1 to 100 (KOHmg/g).

59. The two-component type developer according to claim 54, wherein said quaternary ammonium salt is a lake compound.

60. The two-component type developer according to claim 54, wherein $R_4$ represents an aryl group or an aralkyl group.

61. The two-component type developer according to claim 54, wherein $R_1$, $R_2$, and $R_3$ each represents an alkyl group or an aryl group, and $R_4$ represents an aryl group or an aralkyl group represented by the formula:

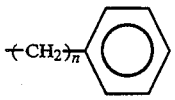

wherein n is an integer of 0, 1, 2 or 3.

62. The two-component type developer according to claim 54, wherein $R_4$ represents an alkyl group.

63. The two-component type developer according to claim 54, wherein $R_1$, $R_2$, $R_3$ and $R_4$ each represents an alkyl group.

64. The two-component type developer according to claim 36, wherein said carrier has a true specific gravity in the range of 1.5 to 5.0.

65. The two-component type developer according to claim 36, wherein said carrier has a particle diameter in the range of 10 μm to 60 μm.

66. The two-component type developer according to claim 36, wherein said carrier has a specific resistance in the range of 10 Ω.cm to $10^{14}$ Ω.cm.

67. The two-component type developer according to claim 36, wherein said magnetic material has a magnetic force of not less than 60 emu/g under application of a magnetic field of 10 kOe.

68. The two-component type developer according to claim 36, wherein said carrier core material is produced by polymerization.

69. The two-component type developer according to claim 36, wherein said fine magnetic material particles are contained in said binder resin in an amount of not less than 30% by weight on the basis of said carrier core material.

70. The two-component type developer according to claim 36, wherein said carrier core material is coated with said resin coating material in a coating weight satisfying the following relation ship:

$$\tfrac{1}{2}X \leqq \text{coating weight of coating resin material} \leqq 50/X \text{ (\% by weight)},$$

wherein X represents a true specific gravity of the carrier.

71. The two-component type developer according to claim 36, wherein said carrier is blended in an amount in the range of 10 parts to 1,000 parts by weight based on 10 parts by weight of said toner.

72. The two-component type developer according to claim 36, wherein said toner has a weight average particle diameter in the range of 1 μm to 20 μm.

73. The two-component type developer according to claim 36, wherein said toner has a weight average particle diameter in the range of 4 μm to 13 μm.

74. The two-component type developer according to claim 36, wherein said toner comprises toner particles with particle diameters of 5 μm or less in an amount in the range of 17% to 60% by number of the whole particles, toner particles with particle diameters in the range of 8 to 12.7 μm in an amount in the range of 1% to 30% by number of the whole particles and toner particles with particle diameters in the range of 16 μm or more in an amount of less than 2.0% by volume of the whole particles.

75. A process for producing a carrier for electrophotography, comprising the steps of:

preparing a coating solution or coating dispersion in which a resin material is dissolved or dispersed; said resin coating material containing at least one member selected from the group consisting of: (a) a vinyl copolymer having a hydroxyl value in the range of 1 to 100 (KOHmg/g); (b) a styrene-acrylic copolymer having an acrylic component in a monomer percentage in the range of 30% by weight to 90% by weight, a weight average molecular weight (Mw) in the range of 30,000 to 70,000 and a weight average molecular weight/number average molecular weight (Mw/Mn) in the range of 2 to 10; and (c) an insulating resin and a quaternary ammonium salt represented by the following Formula (I):

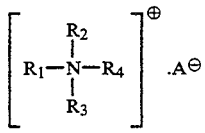

(I)

wherein $R_1$, $R_2$, $R_3$, and $R_4$ may be the same or different, each representing an alkyl group, an aryl group or an aralkyl group; and A represents an organic anion or a polyacid ion;

coating the surface of a carrier core material with the coating solution or coating dispersion thus prepared; said carrier core material comprising a binder resin and fine magnetic particles dispersed in said binder resin; and drying the coated carrier core material to give a carrier.

76. The process according to claim 75, wherein said resin coating material contains a vinyl copolymer having a hydroxyl value in the range of 1 to 100 (KOHmg/g), and a fluorine-containing resin.

77. The process according to claim 75, wherein said resin coating material has a styrene-acrylic copolymer having an acrylic component in a monomer percentage in the range of 30% by weight to 90% by weight, a weight average molecular weight (Mw) in the range of 30,000 to 70,000 and a weight average molecular weight/number average molecular weight (Mw/Mn) in the range of 2 to 10.

78. The process according to claim 75, wherein said coating resin material comprises a styrene-acrylic copolymer having an acrylic component in a monomer percentage in the range of 30% by weight to 90% by weight, a weight average molecular weight (Mw) in the range of 30,000 to 70,000 and a weight average molecular weight/number average molecular weight (Mw/Mn) in the range of 2 to 10, and a fluorine-containing resin; said fluorine-containing resin and said styrene-acrylic copolymer being in a weight proportion in the range of 5:95 to 95:5.

79. The process according to claim 75, wherein said coating resin material contains an insulating resin and a quaternary ammonium salt represented by the following Formula (I):

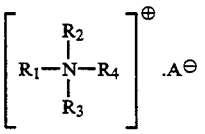

(I)

wherein $R_1$, $R_2$, $R_3$ and $R_4$ may be the same or different, each representing an alkyl group, an aryl group or an aralkyl group; and A represents an organic anion or a polyacid ion.

80. The process according to claim 75, wherein said carrier core material is prepared by kneading a binder resin and fine magnetic material particles, and cooling the kneaded product, followed by pulverization and classification.

81. The process according to claim 75, wherein said carrier core material is prepared by mixing fine magnetic material particles in a solvent in which a binder resin has been dissolved to give a slurry, and granulating said slurry by spray drying, followed by drying.

82. The process according to claim 75, wherein said carrier core material is prepared by adding fine magnetic material particles and a polymerization initiator in a monomer solution of a binder resin to prepare a polymer composition, and suspending and dispersing said polymer composition in a dispersion medium to carry out granulation and polymerization.

83. The process according to claim 75, wherein the surface of said carrier core material is coated with said coating solution or coating dispersion in such a coating weight satisfying the following relation ship:

$$\tfrac{1}{2}X \leqq \text{coating weight of coating resin material} \leqq 50/X \text{ (\% by weight)},$$

wherein X represents a true specific gravity of the carrier.

84. The process according to claim 79, wherein said coating solution is prepared by dissolving the quaternary ammonium salt in a solvent having a solubility to said quaternary ammonium salt, of not less than 1.0 g/100 g (solvent) to prepare a quaternary ammonium salt solution, and mixing and dispersing said quaternary ammonium salt solution in a solution in which an insulating resin has been dissolved or dispersed.

85. The process according to claim 84, wherein said solvent comprises toluene, xylene, tetrahydrofuran or a ketone.

86. The process according to claim 79, wherein said coating dispersion is prepared by mixing and dispersing the quaternary ammonium salt in the state of non-soluble particles in a solution in which an insulating resin has been dissolved or dispersed.

87. The process according to claim 86, wherein R1, R2 and R3 in the formula representing said quaternary ammonium salt may be the same or different, each representing an alkyl group or an aryl group; $R_4$ represent an alkyl group, an aryl group or an aralkyl group, and said alkyl group or aralkyl group may have a substituent; and A represents an organic anion.

88. An image forming method comprising:

developing a latent image formed on an electrostatic image bearing member, by the use of a two-component type developer comprising a toner and a carrier, under application of a bias voltage in a developing zone;

said carrier comprising a carrier comprised of a core material, and a coating comprised of a resin coating material, the surface of said carrier core material being coated with said resin coating material, wherein;

said carrier core material comprises a binder resin and fine magnetic material particles dispersed in said binder resin; and said resin coating material contains at least one member selected from the group consisting of:

(a) a vinyl copolymer having a hydroxyl value in the range of 1 to 100 (KOHmg/g);

(b) a styrene-acrylic copolymer having an acrylic component in a monomer percentage in the range of 30% by weight to 90% by weight, a weight average molecular weight (Mw) in the range of 30,000 to 70,000 and a weight average molecular weight/number average molecular weight (Mw/Mn) in the range of 2 to 10; and (c) an insulating resin and a quaternary ammonium salt represented by the following Formula (I):

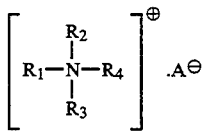

(I)

wherein $R_1$, $R_2$, $R_3$, and $R_4$ may be the same or different, each representing an alkyl group, an aryl group or an aralkyl group; and A represents an organic anion or a polyacid ion.

89. The method according to claim 88, wherein said coating resin material contains a vinyl copolymer having a hydroxyl value in the range of 1 to 100 (KOHmg/g).

90. The method according to claim 88, wherein said resin coating material contains a vinyl copolymer having a hydroxyl value in the range of 1 to 100 (KOHmg/g), and a fluorine-containing resin.

91. The method according to claim 88, wherein said resin coating material has a styrene-acrylic copolymer having an acrylic component in a monomer percentage in the range of 30% by weight to 90% by weight, a weight average molecular weight (Mw) in the range of 30,000 to 70,000 and a weight average molecular weight/number average molecular weight (Mw/Mn) in the range of 2 to 10.

92. The method according to claim 88, wherein said resin coating material comprises a styrene-acrylic copolymer having an acrylic component in a monomer percentage in the range of 30% by weight to 90% by weight, a weight average molecular weight (Mw) in the range of 30,000 to 70,000 and a weight average molecular weight/number average molecular weight (Mw/Mn) in the range of 2 to 10, and a fluorine-containing resin; said fluorine-containing resin and said styrene-acrylic copolymer being in a weight proportion in the range of 5:95 to 95:5.

93. The method according to claim 88, wherein said resin coating resin material contains an insulating resin and a quaternary ammonium salt represented by the following Formula (I):

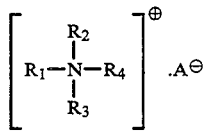

(I)

wherein $R_1$, $R_2$, $R_3$ and $R_4$ may be the same or different each representing represent an alkyl group, an aryl group or an aralkyl group; and A represents an organic anion or a polyacid ion.

94. The method according to claim 88, wherein said applied bias voltage comprises a direct current electric field and an alternating current electric field.

95. The method according to claim 94, wherein said alternating current electric field is 2,000 Vpp or less.

96. The method according to claim 94, wherein said direct current electric field is 1,000 V or less.

97. The method according to claim 88, wherein an opposing gap distance e between a developer carrying member and the electrostatic image bearing member is in the range of 50 to 800.

98. The method according to claim 88, wherein a distance d between a non-magnetic blade and the electrostatic image bearing member is in the range of 100 to 900.

99. The method according to claim 88, wherein an angle $\theta_1$ formed by imaginary lines $L_1$ and $L_2$ is in the range of $-5°$ to $35°$.

100. The method according to claim 88, wherein said electrostatic image bearing member comprises an OPC.

101. The method according to claim 88, wherein said electrostatic image bearing member comprises $\alpha$-Si.

* * * * *

UNITED STATES PATENT AND TRADEMARK OFFICE

CERTIFICATE OF CORRECTION

PATENT NO. : 5,340,677

DATED : August 23, 1994

INVENTOR(S) : YOSHINOBU BABA ET AL.

It is certified that error appears in the above-identified patent and that said Letters Patent is hereby corrected as shown below:

TITLE PAGE:

AT [75] INVENTORS

"Tada Tatsuya" should read --Tatsuya Tada--.

COLUMN 1

Line 10, "invention" should read --Invention--.
Line 15, "comprises" should read --comprised--.
Line 53, "carrier that composes" should read --carriers that compose--.

COLUMN 3

Line 28, "make" should read --makes--.
Line 29, "to" should read --to the--.
Line 33, "is" should read --is a--.
Line 34, "become" should read --becomes--.
Line 38, "tends" should read --tend--.
Line 43, "leak-of" should read --leak of--.

COLUMN 4

Line 62, "particles" should read --particle--.

COLUMN 9

Line 3, "the the" should read --the--.
Line 11, "well" should be deleted.
Line 26, "undecyl methacrylate, do-" should be deleted.
Line 27, "decyl methacrylate," should be deleted.
Line 62, "an" should read --a--.

UNITED STATES PATENT AND TRADEMARK OFFICE

CERTIFICATE OF CORRECTION

PATENT NO. : 5,340,677

DATED : August 23, 1994

INVENTOR(S) : YOSHINOBU BABA ET AL.

It is certified that error appears in the above-identified patent and that said Letters Patent is hereby corrected as shown below:

COLUMN 11

Line 9, "contribute" should read --contribute to--.
Line 17, "from," should read --from--.

COLUMN 12

Line 18, "monodispers" should read --monodispersed--.
Line 45, "includes" should read --include--.
Line 46, "ions" (3rd occurrence) should read --ions and--.
Line 47, "irons" should read --ions--.

COLUMN 13

Line 13, "uniformely" should read --uniformly--.
Line 18, "well" should be deleted.
Line 19, "is" should read --which is--.

COLUMN 15

Line 41, "—$H_2$—" should read -- -$CH_2$— --.

COLUMN 16

Line 25, "0.5" should read --0.5%--.

COLUMN 18

Line 11, "is" should read --are--.
Line 46, "has" should read --have--.

UNITED STATES PATENT AND TRADEMARK OFFICE

CERTIFICATE OF CORRECTION

PATENT NO. : 5,340,677

DATED : August 23, 1994

INVENTOR(S) : YOSHINOBU BABA ET AL.

It is certified that error appears in the above-identified patent and that said Letters Patent is hereby corrected as shown below:

COLUMN 20

Line 22, "suspention" should read --suspension--.
Line 64, "is" should read --are--.

COLUMN 22

Line 54, "17≦N≦N≦60" should read --17≦N≦60--.

COLUMN 27

Line 29, "have" should read --has--.

COLUMN 28

Line 53, "teating" should read --treating--.
Line 54, "adhere" should read --adhering--.
Line 63, "tirornanosilyl" should read --trioryanosilyl--.
Line 64, "tirmethylsilyl" should read --trimethylsilyl-- and "tirornanosilyl" should read --triorganosilyl--.

COLUMN 29

Line 61, "A" should read --An--.

COLUMN 31

Line 17, "serve" should read --serves--.
Line 62, "ranges" should read --range--.

UNITED STATES PATENT AND TRADEMARK OFFICE

CERTIFICATE OF CORRECTION

PATENT NO. : 5,340,677

DATED : August 23, 1994

INVENTOR(S) : YOSHINOBU BABA ET AL.

It is certified that error appears in the above-identified patent and that said Letters Patent is hereby corrected as shown below:

COLUMN 33

Line 14, "well" should be deleted.
Line 68, "indicates" should read --indicate--.

COLUMN 34

Line 46, "Okada Seiko k.K.)" should read --Okada Seiko K.K.)--.
Line 55, "uniformely" should read --uniformly--.

COLUMN 38

Line 45, "this" should read --these--.
Table 1, "VdF-TFE(5)" should read --VdF-TFE(50)--.

COLUMN 41

Line 35, "Okada Seiko k.K.)" should read --Okada Seiko K.K.)--.
Line 45, "uniformely" should read --uniformly--.

COLUMN 43

Line 4, "Okada Seiko k.K.)" should read --Okada Seiko K.K.)--.
Line 58, "from" should read --from the--.

UNITED STATES PATENT AND TRADEMARK OFFICE

CERTIFICATE OF CORRECTION

PATENT NO. : 5,340,677

DATED : August 23, 1994

INVENTOR(S) : YOSHINOBU BABA ET AL.

It is certified that error appears in the above-identified patent and that said Letters Patent is hereby corrected as shown below:

COLUMN 44

Line 38, "from" should read --from the--.

COLUMN 49

Line 9, "Okada Seiko k.K.)" should read --Okada Seiko K.K.)--.
Line 18, "uniformely" should read --uniformly--.

COLUMN 53

Line 1, "this" should read --these--.

COLUMN 56

Line 3, "Okada Seiko k.K.)." should read --Okada Seiko K.K.).--.
Line 11, "uniformely" should read --uniformly--.

COLUMN 57

Line 45, "ares." should read --areas.--.
Line 62, "test s" should read --tests--.

COLUMN 59

Line 60, "Okada Seiko k.K.)." should read --Okada Seiko K.K.).--.

UNITED STATES PATENT AND TRADEMARK OFFICE

CERTIFICATE OF CORRECTION

PATENT NO. : 5,340,677

DATED : August 23, 1994

INVENTOR(S) : YOSHINOBU BABA ET AL.

It is certified that error appears in the above-identified patent and that said Letters Patent is hereby corrected as shown below:

COLUMN 62

Line 67, "Okada Seiko k.K.)." should read --Okada Seiko K.K.).--.

COLUMN 63

Line 7, "uniformely" should read --uniformly--.

COLUMN 64

Line 6, "Okada Seiko k.K.)" should read --Okada Seiko K.K.)--.
Line 52, "Okada Seiko k.K.)." should read --Okada Seiko K.K.).--.
Line 59, "test" should read --tests--.

COLUMN 70

Line 32, "of ≤16 μm," should read --of ≥16 μm,--.

COLUMN 71

LIne 28, "coating resin" should read --resin coating--.

COLUMN 72

Line 60, "10 Ω. cm" should read --$10^7$ Ω·cm--.
Line 61, "Ω. cm" should read --Ω·cm--.

UNITED STATES PATENT AND TRADEMARK OFFICE

CERTIFICATE OF CORRECTION

PATENT NO. : 5,340,677

DATED : August 23, 1994

INVENTOR(S) : YOSHINOBU BABA ET AL.

It is certified that error appears in the above-identified patent and that said Letters Patent is hereby corrected as shown below:

COLUMN 73

Line 6, "resin" should be deleted and "coating" should read --resin coating--.
Line 8, "relationship." should read --relationship:--.
Line 30, "weight/num-" should read --weight,--.
Line 31, "ber" should read --a weight-- and "(Mw/Mn)" should read --(Mw)--.

COLUMN 74

Line 51, "of" should read --in the range of--.

COLUMN 75

Line 56, "10 Ω.cm to $10^{14}$5/8.cm." should read --$10^{7}$ Ω.cm to $10^{14}$ Ω·cm.--.

COLUMN 76

Line 4, "relation ship:" should read --relationship:--.
Line 34, "resin" should read --resin coating--.
Line 36, "of:(a)" shoud read --of: ¶ (a)--.
Line 38, "(b)" should read --¶ (b)--.

COLUMN 77

Line 11, "coating resin" should read --resin coating--.
Line 22, "coating resin" should read --resin coating.
Line 57, "relation ship:" should read --relationship:--.

UNITED STATES PATENT AND TRADEMARK OFFICE

CERTIFICATE OF CORRECTION

PATENT NO. : 5,340,677

DATED : August 23, 1994

INVENTOR(S) : YOSHINOBU BABA ET AL. Page 8 of 8

It is certified that error appears in the above-identified patent and that said Letters Patent is hereby corrected as shown below:

COLUMN 78

Line 12, "R1," should read --$R_1$,--.
Line 13, "R2 and R3" should read --$R_2$ and $R_3$--.
Line 15, "represent" should read --represents--.
Line 59, "coating resin" should read --resin coating--.

COLUMN 79

Line 30, "resin" (2nd occurrence) should be deleted.

COLUMN 80

Line 8, "different" should read --different,--.
Line 9, "represent" should be deleted.

Signed and Sealed this

Seventh Day of March, 1995

Bruce Lehman

*Attest:*

BRUCE LEHMAN

*Attesting Officer*

*Commissioner of Patents and Trademarks*